US007712522B2

(12) United States Patent
Shuster et al.

(10) Patent No.: US 7,712,522 B2
(45) Date of Patent: May 11, 2010

(54) EXPANSION CONE AND SYSTEM

(75) Inventors: Mark Shuster, Vorrburg (NL); Malcolm Gray, Houston, TX (US); Grigoriy Grinberg, Sylvania, OH (US); Matthew M. Shade, Whitehouse, OH (US); Alla Petlyuk, West Chester, PA (US); Scott Costa, Katy, TX (US); Patrick Wenning, Sidney, OH (US); Claudio Oliosi, Monzambano (IT); Hariharasudhan Palaniswamy, Naperville, TX (US); Gracious Ngaile, Apex, NC (US); Taylan Altan, Columbus, OH (US)

(73) Assignee: Enventure Global Technology, LLC, Houston, TX (US)

( * ) Notice: Subject to any disclaimer, the term of this patent is extended or adjusted under 35 U.S.C. 154(b) by 398 days.

(21) Appl. No.: 11/695,811

(22) Filed: Apr. 3, 2007

(65) Prior Publication Data

US 2007/0277972 A1 Dec. 6, 2007

Related U.S. Application Data

(60) Provisional application No. 60/746,813, filed on May 9, 2006.

(51) Int. Cl.
*E21B 43/10* (2006.01)

(52) U.S. Cl. ..... 166/207; 166/384; 166/216

(58) Field of Classification Search ..... 166/384, 166/206, 207, 216
See application file for complete search history.

(56) References Cited

U.S. PATENT DOCUMENTS 46,818 A 3/1865 Patterson
331,940 A 12/1885 Bole
332,184 A 12/1885 Bole
341,237 A 5/1886 Healey
519,805 A 5/1894 Bavier
802,880 A 10/1905 Phillips, Jr.
806,156 A 12/1905 Marshall
958,517 A 5/1910 Mettler
984,449 A 2/1911 Stewart
1,166,040 A 12/1915 Burlingham
1,233,888 A 7/1917 Leonard
1,358,818 A 11/1920 Bering
1,494,128 A 5/1924 Primrose
1,589,781 A 6/1926 Anderson
1,590,357 A 6/1926 Feisthamal
1,597,212 A 8/1926 Spengler
1,613,461 A 1/1927 Johnson
1,739,932 A 12/1929 Ventresca (Continued)

FOREIGN PATENT DOCUMENTS

AU 01/269810 B2 6/2000

(Continued)

OTHER PUBLICATIONS

United Kingdom 0707073.6 Search and Examination Report, Jan. 2, 2009.

(Continued)

*Primary Examiner*—Kenneth Thompson
(74) *Attorney, Agent, or Firm*—Conley Rose, P.C.

(57) ABSTRACT

An apparatus for the radial expansion and plastic deformation of a tubular member.

30 Claims, 31 Drawing Sheets

U.S. PATENT DOCUMENTS

| | | | |
|---|---|---|---|
| 1,756,531 | A | 4/1930 | Aldeen et al. |
| 1,880,218 | A | 10/1932 | Simmons |
| 1,952,652 | A | 3/1934 | Brannon |
| 1,981,525 | A | 11/1934 | Price |
| 2,046,870 | A | 7/1936 | Clasen et al. |
| 2,087,185 | A | 7/1937 | Dillon |
| 2,110,913 | A | 3/1938 | Lowrey |
| 2,122,757 | A | 7/1938 | Scott |
| 2,145,179 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,273,017 | A | 2/1942 | Boynton |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,407,552 | A | 9/1946 | Hoesel |
| 2,447,629 | A | 8/1948 | Beissinger et al. |
| 2,481,637 | A | 9/1949 | Yancey |
| 2,500,276 | A | 3/1950 | Church |
| 2,546,295 | A | 3/1951 | Boice |
| 2,583,316 | A | 1/1952 | Bannister |
| 2,609,258 | A | 9/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,695,449 | A | 11/1954 | Chauvin |
| 2,723,721 | A | 11/1955 | Corsette |
| 2,734,580 | A | 2/1956 | Layne |
| 2,735,485 | A | 2/1956 | Metcalf, Jr. |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 3/1960 | Steinberg |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,162,245 | A | 12/1964 | Howard et al. |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Hearn |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides |
| 3,568,773 | A | 3/1971 | Chancellor |
| 3,572,777 | A | 3/1971 | Blose et al. |
| 3,574,357 | A | 4/1971 | Tirgoviste |
| 3,578,081 | A | 5/1971 | Bodine |
| 3,579,805 | A | 5/1971 | Kast |
| 3,581,817 | A | 6/1971 | Kammerer |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curlington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley |
| 3,780,562 | A | 12/1973 | Kinley |
| 3,781,966 | A | 1/1974 | Lieberman |
| 3,785,193 | A | 1/1974 | Kinley |
| 3,797,259 | A | 3/1974 | Kammerer, Jr. |
| 3,805,567 | A | 4/1974 | Agius Sinerco |
| 3,812,912 | A | 5/1974 | Wuenschel |
| 3,818,734 | A | 6/1974 | Bateman |
| 3,826,124 | A | 7/1974 | Baksay |
| 3,830,294 | A | 8/1974 | Swanson, Jr. |
| 3,830,295 | A | 8/1974 | Crowe |
| 3,834,742 | A | 9/1974 | McPhillips |
| 3,848,668 | A | 11/1974 | Sizer |
| 3,866,954 | A | 2/1975 | Slator et al. |
| 3,874,446 | A | 4/1975 | Crowe |
| 3,885,298 | A | 5/1975 | Pognowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,915,763 | A | 10/1975 | Jennings |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,963,076 | A | 6/1976 | Winslow |
| 3,970,336 | A | 7/1976 | O'Sickey |
| 3,977,076 | A | 8/1976 | Vieira et al. |
| 3,977,473 | A | 8/1976 | Page, Jr. |
| 3,989,280 | A | 11/1976 | Schwarz |

3,997,193 A 12/1976 Tsuda et al.
3,999,605 A 12/1976 Braddick
4,011,652 A 3/1977 Black
4,018,634 A 4/1977 Fencl
4,019,579 A 4/1977 Thuse
4,026,583 A 5/1977 Gottlieb
4,047,568 A 9/1977 Aulenbacher
4,053,247 A 10/1977 Marsh, Jr.
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchison
4,118,954 A 10/1978 Jenkins
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr. et al.
4,304,428 A 12/1981 Grigorian et al.
4,328,983 A 5/1982 Gibson
4,355,664 A 10/1982 Cook
4,358,511 A 11/1982 Smith, Jr. et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida et al.
4,495,073 A 1/1985 Beimgraben
4,501,327 A 2/1985 Retz
4,505,017 A 3/1985 Schukei
4,505,987 A 3/1985 Yamada
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,521,258 A 6/1985 Tamehiro et al.
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Landriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,573,540 A 3/1986 Dellinger et al.
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres
4,595,063 A 6/1986 Jennings et al.
4,596,913 A 6/1986 Takechi et al.
4,598,938 A 7/1986 Boss et al.
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,627,488 A 12/1986 Szarka
4,629,218 A 12/1986 Dubois
4,629,224 A 12/1986 Landriault
4,630,849 A 12/1986 Fukui
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh
4,651,836 A 3/1987 Richards
4,656,779 A 4/1987 Fedeli et al.
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.
4,739,916 A 4/1988 Ayres
4,754,781 A 7/1988 Jan de Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett 4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward
4,892,337 A 1/1990 Gunderson et al.
4,893,658 A 1/1990 Kimura et al.
4,904,136 A 2/1990 Matsumoto
4,907,828 A 3/1990 Chang
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,949,745 A 8/1990 McKeon
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundell
5,074,355 A 12/1991 Lennon
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet et al.
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,249,628 A 10/1993 Surjaatmadia
5,253,713 A 10/1993 Gregg et al.
RE34,467 E 12/1993 Reeves
5,273,075 A 12/1993 Skaer
5,275,242 A 1/1994 Payne
5,282,508 A 2/1994 Ellingsen et al.
5,286,393 A 2/1994 Oldiges et al.
5,297,629 A 3/1994 Barrington et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Baro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,419,595 A 5/1995 Yamamoto et al.
5,425,559 A 6/1995 Nobileau
5,426,130 A 6/1995 Thurber et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart 5,472,055 A 12/1995 Simson et al.
5,474,334 A 12/1995 Eppink
5,492,173 A 2/1996 Kilgore et al.
5,494,106 A 2/1996 Gueguen et al.
5,498,809 A 3/1996 Emert et al.
5,507,343 A 4/1996 Carlton et al.
5,511,620 A 4/1996 Baugh et al.
5,513,703 A 5/1996 Mills et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,409 A 8/1998 Flanders
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris et al.
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,594 A 5/1999 Wasson
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck et al.
5,985,053 A 11/1999 Hara
6,009,611 A 1/2000 Adams et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,013,724 A 1/2000 Mizutani
6,015,012 A 1/2000 Reddick
6,017,168 A 1/2000 Fraser, Jr. et al.
6,021,850 A 2/2000 Wood et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,148,915 A 11/2000 Mullen
6,155,613 A 12/2000 Quadflieg et al.
6,158,785 A 12/2000 Beaulier et al.
6,158,963 A 12/2000 Hollis et al.
6,167,970 B1 1/2001 Stout
6,182,775 B1 2/2001 Hipp
6,183,013 B1 2/2001 Mackenzie et al.
6,183,573 B1 2/2001 Fujiwara et al.
6,189,616 B1 2/2001 Gano et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,286,614 B1 9/2001 Gano et al.
6,302,211 B1 10/2001 Nelson et al.
6,311,792 B1 11/2001 Scott et al.
6,315,040 B1 11/2001 Donnelly
6,315,043 B1 11/2001 Farrant et al.

6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,349,521 B1 2/2002 McKeon et al.
6,352,112 B1 3/2002 Mills
6,354,373 B1 3/2002 Vercaemer et al.
6,357,485 B2 3/2002 Quigley
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox
6,443,247 B1 9/2002 Wardley
6,446,323 B1 9/2002 Metcalfe et al.
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,461,999 B1 10/2002 Fanta
6,464,008 B1 10/2002 Roddy et al.
6,464,014 B1 10/2002 Bernat
6,470,966 B2 10/2002 Cook et al.
6,470,996 B1 10/2002 Kyle et al.
6,478,091 B1 11/2002 Gano
6,478,092 B2 11/2002 Voll et al.
6,491,108 B1 12/2002 Slup
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,460 B2 5/2003 Hester
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Haut et al.
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson et al.
6,604,763 B1 8/2003 Cook et al.
6,607,220 B2 8/2003 Sivley, IV
6,609,735 B1 8/2003 DeLange
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,930 B2 12/2003 Hoffman
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,723,683 B2 4/2004 Crossman
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,749,954 B2 6/2004 Toyooka
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,826,937 B2 12/2004 Su
6,832,649 B2 12/2004 Bode et al.
6,834,725 B2 12/2004 Whanger et al.
6,843,322 B2 1/2005 Burtner
6,857,473 B2 2/2005 Cook et al.
6,880,632 B2 4/2005 Tom et al.
6,892,819 B2 5/2005 Cook et al.
6,902,000 B2 6/2005 Simpson
6,907,652 B1 6/2005 Heijnen
6,923,261 B2 8/2005 Metcalfe et al.
6,935,429 B2 8/2005 Badrak
6,935,430 B2 8/2005 Harrall et al.
6,966,370 B2 11/2005 Cook et al.
6,968,618 B2 11/2005 Cook et al.
6,976,539 B2 12/2005 Metcalfe et al.
6,976,541 B2 12/2005 Brisco et al.
7,000,953 B2 2/2006 Berghaus
7,007,760 B2 3/2006 Lohbeck
7,011,161 B2 3/2006 Ring et al.
7,021,390 B2 4/2006 Cook et al.
7,036,582 B2 5/2006 Cook et al.
7,040,396 B2 5/2006 Cook et al.
7,044,218 B2 5/2006 Cook et al.
7,044,221 B2 5/2006 Cook et al.
7,048,062 B2 5/2006 Ring et al.
7,048,067 B1 5/2006 Cook et al.

7,055,608 B2 6/2006 Cook et al.
7,063,142 B2 6/2006 Cook et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,684 B2 9/2006 Cook et al.
7,100,685 B2 9/2006 Cook et al.
7,108,061 B2 9/2006 Cook et al.
7,108,072 B2 9/2006 Cook et al.
7,114,559 B2 10/2006 Sonnier et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,146,702 B2 12/2006 Cook et al.
7,147,053 B2 12/2006 Cook et al.
7,159,665 B2 1/2007 Cook et al.
7,159,667 B2 1/2007 Cook et al.
7,164,964 B2 1/2007 Stacklies
7,168,496 B2 1/2007 Cook et al.
7,168,499 B2 1/2007 Cook et al.
7,172,019 B2 2/2007 Cook et al.
7,172,021 B2 2/2007 Brisco et al.
7,172,024 B2 2/2007 Cook et al.
7,174,964 B2 2/2007 Cook et al.
7,185,710 B2 3/2007 Cook et al.
7,191,841 B2 3/2007 Sivley, IV
7,225,879 B2 6/2007 Wylie e tal.
7,231,985 B2 6/2007 Cook et al.
7,234,531 B2 6/2007 Kendziora
7,234,968 B2 6/2007 Lottmann et al.
7,240,728 B2 7/2007 Cook et al.
7,240,729 B2 7/2007 Cook et al.
2001/0002626 A1 6/2001 Frank et al.
2001/0018354 A1 8/2001 Pigni
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Sivley, IV
2003/0075337 A1 4/2003 Maguire
2003/0075338 A1* 4/2003 Sivley, IV ..... 166/380
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith et al.
2003/0159764 A1 8/2003 Goto
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045646 A1 3/2004 Kuehn
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0159446 A1 8/2004 Haugen et al.
2004/0174017 A1 9/2004 Brill et al.
2004/0188099 A1 9/2004 Cook et al.
2004/0194278 A1 10/2004 Brill et al.
2004/0194966 A1 10/2004 Zimmerman
2004/0216506 A1 11/2004 Simpson et al.
2004/0216873 A1 11/2004 Frost, Jr. et al.
2004/0221996 A1 11/2004 Burge
2004/0228679 A1 11/2004 Reavis et al.
2004/0231839 A1 11/2004 Ellington et al.
2004/0231843 A1 11/2004 Simpson et al.
2004/0231855 A1 11/2004 Cook et al.
2004/0238181 A1 12/2004 Cook et al.
2004/0244968 A1 12/2004 Cook et al.
2004/0251034 A1 12/2004 Kendziora et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Ring et al.
2005/0056434 A1 3/2005 Watson et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.

| | | | |
|---|---|---|---|
| 2005/0150660 | A1 | 7/2005 | Cook et al. |
| 2005/0161228 | A1 | 7/2005 | Cook et al. |
| 2005/0166387 | A1 | 8/2005 | Cook et al. |
| 2005/0166388 | A1 | 8/2005 | Cook et al. |
| 2005/0172473 | A1 | 8/2005 | Cook et al. |
| 2005/0173108 | A1 | 8/2005 | Cook |
| 2005/0183863 | A1 | 8/2005 | Cook et al. |
| 2005/0205253 | A1 | 9/2005 | Cook et al. |
| 2005/0217768 | A1 | 10/2005 | Asahi et al. |
| 2005/0217865 | A1 | 10/2005 | Ring |
| 2005/0217866 | A1 | 10/2005 | Watson et al. |
| 2005/0223535 | A1 | 10/2005 | Cook et al. |
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Waddell et al. |
| 2005/0236159 | A1 | 10/2005 | Costa et al. |
| 2005/0236163 | A1 | 10/2005 | Cook et al. |
| 2005/0244578 | A1 | 11/2005 | Van Egmond et al. |
| 2005/0246883 | A1 | 11/2005 | Alliot et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2006/0027371 | A1 | 2/2006 | Gorrara |
| 2006/0032640 | A1 | 2/2006 | Costa et al. |
| 2006/0048948 | A1 | 3/2006 | Noel |
| 2006/0054330 | A1 | 3/2006 | Ring et al. |
| 2006/0065403 | A1 | 3/2006 | Watson et al. |
| 2006/0065406 | A1 | 3/2006 | Shuster et al. |
| 2006/0070742 | A1 | 4/2006 | Sivley, IV |
| 2006/0096762 | A1 | 5/2006 | Brisco |
| 2006/0102360 | A1 | 5/2006 | Brisco |
| 2006/0112768 | A1 | 6/2006 | Shuster et al. |
| 2006/0113086 | A1 | 6/2006 | Costa et al. |
| 2006/0162937 | A1 | 7/2006 | Costa et al. |
| 2006/0163460 | A1 | 7/2006 | Kerstan et al. |
| 2006/0196679 | A1 | 9/2006 | Brisco et al. |
| 2006/0207760 | A1 | 9/2006 | Watson et al. |
| 2006/0208488 | A1 | 9/2006 | Costa |
| 2006/0213668 | A1 | 9/2006 | Cook et al. |
| 2006/0219414 | A1 | 10/2006 | Shuster |
| 2006/0225892 | A1 | 10/2006 | Watson et al. |
| 2006/0243444 | A1 | 11/2006 | Brisco et al. |
| 2006/0266527 | A1 | 11/2006 | Brisco et al. |
| 2006/0272826 | A1 | 12/2006 | Shuster et al. |
| 2007/0012456 | A1 | 1/2007 | Cook et al. |
| 2007/0017572 | A1 | 1/2007 | Cook et al. |
| 2007/0034383 | A1 | 2/2007 | Shuster et al. |
| 2007/0039742 | A1 | 2/2007 | Costa |
| 2007/0131431 | A1 | 6/2007 | Shuster et al. |
| 2007/0154270 | A1 | 7/2007 | Waddell et al. |

FOREIGN PATENT DOCUMENTS

| | | | |
|---|---|---|---|
| AU | 767364 | | 6/2000 |
| AU | 770008 | | 8/2000 |
| AU | 770359 | | 8/2000 |
| AU | 771884 | | 8/2000 |
| AU | 776580 | | 1/2001 |
| AU | 782901 | | 4/2001 |
| AU | 783245 | | 5/2001 |
| AU | 773168 | | 7/2001 |
| AU | 780123 | | 8/2001 |
| AU | 01/283026 | | 2/2002 |
| AU | 01/292695 | B2 | 3/2002 |
| AU | 01/294802 | B2 | 4/2002 |
| AU | 02/239857 | B2 | 9/2002 |
| CA | 736288 | | 6/1966 |
| CA | 771462 | | 11/1967 |
| CA | 1171310 | | 7/1984 |
| CA | 2289811 | | 11/1999 |
| CA | 2292171 | | 6/2000 |
| CA | 2497854 | | 6/2000 |
| CA | 2298139 | | 8/2000 |
| CA | 2414449 | | 2/2002 |
| CA | 2419806 | | 4/2002 |
| CA | 2453034 | | 1/2003 |
| CA | 2234386 | | 3/2003 |
| CA | 2398001 | | 4/2003 |
| CA | 2466685 | | 3/2004 |
| CA | 2249139 | | 1/2007 |
| DE | 174521 | | 9/1952 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | A | 6/1988 |
| EP | 0294264 | A1 | 12/1988 |
| EP | 0553566 | A1 | 8/1993 |
| EP | 620289 | A1 | 10/1994 |
| EP | 0633391 | A2 | 1/1995 |
| EP | 0713953 | B1 | 11/1995 |
| EP | 0823534 | A1 | 2/1998 |
| EP | 0881354 | A2 | 12/1998 |
| EP | 0881359 | A1 | 12/1998 |
| EP | 0899420 | A1 | 3/1999 |
| EP | 0937861 | A2 | 6/1999 |
| EP | 0952305 | A1 | 10/1999 |
| EP | 0952306 | A1 | 10/1999 |
| EP | 1141515 | | 6/2000 |
| EP | 1235972 | | 5/2001 |
| EP | 1106778 | A1 | 6/2001 |
| EP | 1152119 | A2 | 11/2001 |
| EP | 1152120 | A2 | 11/2001 |
| EP | 1152120 | A3 | 6/2002 |
| EP | 1306519 | A2 | 5/2003 |
| EP | 1505251 | | 2/2005 |
| EP | 1505251 | A2 | 2/2005 |
| EP | 1555386 | A1 | 7/2005 |
| EP | 1505251 | A3 | 2/2007 |
| FR | 1325596 | | 3/1963 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 2275705 | | 3/1942 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1008383 | | 10/1965 |
| GB | 1062610 | | 3/1967 |
| GB | 1111536 | | 5/1968 |
| GB | 1520552 | | 8/1976 |
| GB | 1448304 | | 9/1976 |
| GB | 1460864 | | 1/1977 |
| GB | 1542847 | | 3/1979 |
| GB | 1563740 | | 3/1980 |
| GB | 1582767 | | 1/1981 |
| GB | 2058877 | | 4/1981 |
| GB | 2108228 | | 5/1983 |
| GB | 2115860 | | 9/1983 |
| GB | 2124275 | A | 2/1984 |
| GB | 2125876 | | 3/1984 |
| GB | 2194978 | A | 3/1988 |
| GB | 2211446 | A | 7/1989 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 1/1993 |

| | | | |
|---|---|---|---|
| GB | 2275705 | A | 9/1994 |
| GB | 2279383 | | 1/1995 |
| GB | 2305682 | A | 4/1997 |
| GB | 2322655 | A | 9/1998 |
| GB | 2325949 | A | 12/1998 |
| GB | 2326896 | A | 1/1999 |
| GB | 2329916 | A | 4/1999 |
| GB | 2331103 | A | 5/1999 |
| GB | 2329918 | A | 7/1999 |
| GB | 2336383 | A | 10/1999 |
| GB | 2343691 | A | 5/2000 |
| GB | 2344606 | A | 6/2000 |
| GB | 2345308 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2348661 | A | 10/2000 |
| GB | 2350137 | B | 11/2000 |
| GB | 2355738 | A | 12/2000 |
| GB | 2356651 | A | 5/2001 |
| GB | 2357099 | A | 6/2001 |
| GB | 2359837 | B | 9/2001 |
| GB | 2361724 | A | 10/2001 |
| GB | 2365898 | A | 2/2002 |
| GB | 2367842 | A | 4/2002 |
| GB | 2368865 | A | 5/2002 |
| GB | 2370301 | A | 6/2002 |
| GB | 2371064 | A | 7/2002 |
| GB | 2371574 | A | 7/2002 |
| GB | 2373524 | A | 9/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382607 | A | 6/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2384807 | C | 8/2003 |
| GB | 2348223 | B | 9/2003 |
| GB | 2347952 | B | 10/2003 |
| GB | 2348657 | B | 10/2003 |
| GB | 2358358 | B | 10/2003 |
| GB | 2358359 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2391028 | A | 1/2004 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396689 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399837 | A | 9/2004 |
| GB | 2399848 | A | 9/2004 |
| GB | 2399849 | A | 9/2004 |

| | | | |
|---|---|---|---|
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2040402 | A | 2/2005 |
| GB | 2400624 | B | 2/2005 |
| GB | 2404676 | A | 2/2005 |
| GB | 2404677 | A | 2/2005 |
| GB | 2404680 | A | 2/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2407593 | A | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2410280 | | 7/2005 |
| GB | 2390622 | B | 8/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2410518 | A | 8/2005 |
| GB | 2380503 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2400393 | B | 10/2005 |
| GB | 2412681 | A | 10/2005 |
| GB | 2412682 | A | 10/2005 |
| GB | 2394979 | B | 11/2005 |
| GB | 2414493 | A | 11/2005 |
| GB | 2409217 | B | 12/2005 |
| GB | 2410518 | B | 12/2005 |
| GB | 2414749 | A | 12/2005 |
| GB | 2414750 | A | 12/2005 |
| GB | 2414751 | A | 12/2005 |
| GB | 2415003 | A | 12/2005 |
| GB | 2415215 | | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415982 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2408278 | B | 2/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2406126 | A | 3/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2414493 | B | 8/2006 |
| GB | 2418690 | B | 8/2006 |
| GB | 2418944 | B | 8/2006 |
| GB | 2421257 | B | 8/2006 |
| GB | 2421258 | B | 8/2006 |
| GB | 2421259 | B | 8/2006 |
| GB | 2422859 | A | 8/2006 |
| GB | 2422860 | A | 8/2006 |
| GB | 2423317 | A | 8/2006 |
| GB | 2404676 | B | 9/2006 |
| GB | 2418941 | B | 9/2006 |
| GB | 2418942 | B | 9/2006 |
| GB | 2418943 | B | 9/2006 |
| GB | 2424077 | A | 9/2006 |
| GB | 2405893 | B | 10/2006 |
| GB | 2413136 | A | 10/2006 |
| GB | 2417273 | B | 10/2006 |

| | | | |
|---|---|---|---|
| GB | 2418216 | B | 10/2006 |
| GB | 2418217 | B | 10/2006 |
| GB | 2419907 | B | 10/2006 |
| GB | 2422860 | B | 10/2006 |
| GB | 2406125 | B | 11/2006 |
| GB | 2415004 | B | 12/2006 |
| GB | 2422859 | B | 12/2006 |
| GB | 2423317 | B | 12/2006 |
| GB | 2426993 | A | 12/2006 |
| GB | 2427636 | A | 1/2007 |
| GB | 2427885 | A | 1/2007 |
| GB | 2427886 | A | 1/2007 |
| GB | 2410280 | B | 4/2007 |
| GB | 2412178 | B | 5/2007 |
| GB | 2415215 | B | 5/2007 |
| ID | P01.012.197/2005 | | 8/2004 |
| ID | 044.392 | A | 9/2005 |
| ID | 046.2804 | A | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 113267 | B1 | 5/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 6/1978 |
| SU | 620582 | | 8/1978 |
| SU | 641070 | | 1/1979 |
| SU | 909114 | | 5/1979 |
| SU | 874952 | | 6/1979 |
| SU | 832049 | | 5/1981 |
| SU | 976019 | | 5/1981 |
| SU | 976020 | | 5/1981 |
| SU | 853089 | | 8/1981 |
| SU | 894169 | | 12/1981 |
| SU | 899850 | | 1/1982 |
| SU | 907220 | | 2/1982 |
| SU | 953172 | | 8/1982 |
| SU | 959878 | | 9/1982 |
| SU | 989038 | | 1/1983 |
| SU | 1002514 | | 3/1983 |
| SU | 1041671 | | 9/1983 |
| SU | 1051222 | A | 10/1983 |
| SU | 1077803 | A | 3/1984 |
| SU | 1086118 | A | 4/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | A1 | 7/1988 |
| SU | 1430498 | A1 | 10/1988 |
| SU | 1432190 | A1 | 10/1988 |
| SU | 1601330 | A1 | 10/1990 |
| SU | 1627663 | A | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A1 | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| WO | WO 81/00132 | A1 | 1/1981 |
| WO | WO 90/05598 | A | 5/1990 |
| WO | WO 92/01859 | A1 | 2/1992 |
| WO | WO 92/08875 | A2 | 5/1992 |
| WO | WO 93/25799 | A1 | 12/1993 |
| WO | WO 93/25800 | | 12/1993 |
| WO | WO 93/25800 | A1 | 12/1993 |
| WO | WO 94/21887 | A1 | 9/1994 |
| WO | WO 94/25655 | A1 | 11/1994 |
| WO | WO 95/03476 | A1 | 2/1995 |
| WO | WO 96/01937 | A1 | 1/1996 |
| WO | WO 96/10710 | | 4/1996 |
| WO | WO 96/21083 | A1 | 7/1996 |
| WO | WO 96/26350 | A1 | 8/1996 |
| WO | WO 96/10710 | | 11/1996 |
| WO | WO 96/37681 | A1 | 11/1996 |
| WO | WO 97/06346 | A1 | 2/1997 |
| WO | WO 97/11306 | A1 | 3/1997 |
| WO | WO 97/17524 | A2 | 5/1997 |
| WO | WO 97/17526 | A2 | 5/1997 |
| WO | WO 97/17527 | A2 | 5/1997 |
| WO | WO 97/20130 | A2 | 6/1997 |
| WO | WO 97/21901 | A2 | 6/1997 |
| WO | WO 97/35084 | A1 | 9/1997 |
| WO | WO 98/00626 | A1 | 1/1998 |
| WO | WO 98/07957 | A1 | 2/1998 |
| WO | WO 98/09053 | A2 | 3/1998 |
| WO | WO 98/22690 | A1 | 5/1998 |
| WO | WO 98/26152 | A1 | 6/1998 |
| WO | WO 98/42947 | A1 | 10/1998 |
| WO | WO 98/49423 | A1 | 11/1998 |
| WO | WO 99/02818 | A1 | 1/1999 |
| WO | WO 99/04135 | A1 | 1/1999 |
| WO | WO 99/06670 | A1 | 2/1999 |
| WO | WO 99/08827 | A1 | 2/1999 |
| WO | WO 99/08828 | A1 | 2/1999 |
| WO | WO 99/18328 | A1 | 4/1999 |
| WO | WO 99/23354 | A1 | 5/1999 |
| WO | WO 99/25524 | A1 | 5/1999 |
| WO | WO 99/25951 | A1 | 5/1999 |
| WO | WO 99/35368 | A1 | 7/1999 |
| WO | WO 99/43923 | A1 | 9/1999 |
| WO | WO 00/01926 | A1 | 1/2000 |
| WO | WO 00/04271 | A1 | 1/2000 |
| WO | WO 00/08301 | A2 | 2/2000 |
| WO | WO 00/18635 | | 4/2000 |
| WO | WO 00/26500 | A1 | 5/2000 |
| WO | WO 00/26501 | A1 | 5/2000 |
| WO | WO 00/26502 | A1 | 5/2000 |
| WO | WO 00/31375 | A1 | 6/2000 |
| WO | WO 00/37766 | A2 | 6/2000 |
| WO | WO 00/37767 | A2 | 6/2000 |
| WO | WO 00/37768 | A1 | 6/2000 |
| WO | WO 00/37771 | A1 | 6/2000 |

| | | | |
|---|---|---|---|
| WO | WO 00/37772 | A1 | 6/2000 |
| WO | WO 00/39432 | A1 | 7/2000 |
| WO | WO 00/46484 | A1 | 8/2000 |
| WO | WO 00/50727 | A1 | 8/2000 |
| WO | WO 00/50732 | A1 | 8/2000 |
| WO | WO 00/50733 | A1 | 8/2000 |
| WO | WO 00/66877 | | 11/2000 |
| WO | WO 00/77431 | A2 | 12/2000 |
| WO | WO 01/04520 | A1 | 1/2001 |
| WO | WO 01/04535 | A1 | 1/2001 |
| WO | WO 01/47161 | | 2/2001 |
| WO | WO 01/18353 | | 3/2001 |
| WO | WO 01/18354 | A1 | 3/2001 |
| WO | WO 01/21929 | A1 | 3/2001 |
| WO | WO 01/26860 | A1 | 4/2001 |
| WO | WO 01/33037 | A1 | 5/2001 |
| WO | WO 01/38693 | A1 | 5/2001 |
| WO | WO 01/60545 | A1 | 8/2001 |
| WO | WO 01/83943 | A1 | 11/2001 |
| WO | WO 01/98623 | A1 | 12/2001 |
| WO | WO 02/01102 | A1 | 1/2002 |
| WO | WO 02/10550 | A1 | 2/2002 |
| WO | WO 02/10551 | A1 | 2/2002 |
| WO | WO 02/20941 | A1 | 3/2002 |
| WO | WO 02/23007 | A1 | 3/2002 |
| WO | WO 02/25059 | A1 | 3/2002 |
| WO | WO 02/28560 | | 4/2002 |
| WO | WO 02/29199 | A1 | 4/2002 |
| WO | WO 02/38343 | A2 | 5/2002 |
| WO | WO 02/38343 | A3 | 5/2002 |
| WO | WO 02/40825 | A1 | 5/2002 |
| WO | WO 02/053867 | A2 | 7/2002 |
| WO | WO 02/053867 | A3 | 7/2002 |
| WO | WO 02/059456 | A1 | 8/2002 |
| WO | WO 02/066783 | A1 | 8/2002 |
| WO | WO 02/068792 | A1 | 9/2002 |
| WO | WO 02/073000 | A1 | 9/2002 |
| WO | WO 02/075107 | A1 | 9/2002 |
| WO | WO 02/077411 | A1 | 10/2002 |
| WO | WO 02/081863 | A1 | 10/2002 |
| WO | WO 02/081864 | A2 | 10/2002 |
| WO | WO 02/086285 | A1 | 10/2002 |
| WO | WO 02/086286 | A2 | 10/2002 |
| WO | WO 02/090713 | A1 | 11/2002 |
| WO | WO 02/095181 | A1 | 11/2002 |
| WO | WO 02/163192 | | 11/2002 |
| WO | WO 02/103150 | A2 | 12/2002 |
| WO | WO 03/000690 | | 1/2003 |
| WO | WO 03/004819 | A2 | 1/2003 |
| WO | WO 03/004819 | A3 | 1/2003 |
| WO | WO 03/004820 | A2 | 1/2003 |
| WO | WO 03/004820 | A3 | 1/2003 |
| WO | WO 03/004837 | | 1/2003 |
| WO | WO 03/008756 | A1 | 1/2003 |
| WO | WO 03/012255 | A1 | 2/2003 |
| WO | WO 03/014153 | | 2/2003 |
| WO | WO 03/016669 | A2 | 2/2003 |
| WO | WO 03/016669 | A3 | 2/2003 |
| WO | WO 03/023178 | A2 | 3/2003 |
| WO | WO 03/023178 | A3 | 3/2003 |
| WO | WO 03/023179 | A2 | 3/2003 |
| WO | WO 03/023179 | A3 | 3/2003 |
| WO | WO 03/029607 | A1 | 4/2003 |
| WO | WO 03/029608 | A1 | 4/2003 |
| WO | 03036012 | A3 | 5/2003 |
| WO | WO 03/036018 | A2 | 5/2003 |
| WO | WO 03/042486 | A2 | 5/2003 |
| WO | WO 03/042486 | A3 | 5/2003 |
| WO | WO 03/042487 | A2 | 5/2003 |
| WO | WO 03/042487 | A3 | 5/2003 |
| WO | WO 03/042489 | A2 | 5/2003 |
| WO | WO 03/048520 | A1 | 6/2003 |
| WO | WO 03/048521 | A2 | 6/2003 |
| WO | WO 03/055616 | A2 | 7/2003 |
| WO | WO 03/058022 | A2 | 7/2003 |
| WO | WO 03/058022 | A3 | 7/2003 |
| WO | WO 03/059549 | A1 | 7/2003 |
| WO | WO 03/064813 | A1 | 8/2003 |
| WO | WO 03/069115 | A3 | 8/2003 |
| WO | WO 03/071086 | A2 | 8/2003 |
| WO | WO 03/071086 | A3 | 8/2003 |
| WO | WO 03/078785 | A2 | 9/2003 |
| WO | WO 03/078785 | A3 | 9/2003 |
| WO | WO 03/086675 | A2 | 10/2003 |
| WO | WO 03/086675 | A3 | 10/2003 |
| WO | WO 03/089161 | A2 | 10/2003 |
| WO | WO 03/089161 | A3 | 10/2003 |
| WO | WO 03/093623 | A2 | 11/2003 |
| WO | WO 03/093623 | A3 | 11/2003 |
| WO | WO 03/093624 | | 11/2003 |
| WO | WO 03/102365 | A1 | 12/2003 |
| WO | WO 03/104601 | A2 | 12/2003 |
| WO | WO 03/104601 | A3 | 12/2003 |
| WO | WO 03/106130 | A2 | 12/2003 |
| WO | WO 03/106130 | A3 | 12/2003 |
| WO | WO 2004/000337 | A1 | 1/2004 |
| WO | WO 2004/007711 | | 1/2004 |
| WO | WO 2004/008073 | | 1/2004 |
| WO | WO 2004/009950 | A1 | 1/2004 |
| WO | WO 2004/010039 | A2 | 1/2004 |
| WO | WO 2004/010039 | A3 | 1/2004 |
| WO | WO 2004/010317 | | 1/2004 |
| WO | WO 2004/010712 | | 1/2004 |
| WO | WO 2004/010762 | | 2/2004 |
| WO | WO 2004/011776 | A2 | 2/2004 |
| WO | WO 2004/011776 | A3 | 2/2004 |
| WO | WO 2004/011973 | | 2/2004 |
| WO | WO 2004/013462 | | 2/2004 |
| WO | WO 2004/015241 | | 2/2004 |
| WO | WO 2004/018823 | A2 | 3/2004 |
| WO | WO 2004/018823 | A3 | 3/2004 |
| WO | WO 2004/018824 | A2 | 3/2004 |
| WO | WO 2004/018824 | A3 | 3/2004 |
| WO | WO 2004/020895 | A2 | 3/2004 |
| WO | WO 2004/020895 | A3 | 3/2004 |
| WO | WO 2004/023014 | A2 | 3/2004 |
| WO | WO 2004/023014 | A3 | 3/2004 |
| WO | WO 2004/026017 | A2 | 4/2004 |
| WO | WO 2004/026017 | A3 | 4/2004 |
| WO | WO 2004/026073 | A2 | 4/2004 |
| WO | WO 2004/026073 | A3 | 4/2004 |
| WO | WO 2004/026500 | A2 | 4/2004 |
| WO | WO 2004/026500 | A3 | 4/2004 |
| WO | WO 2004/027200 | A2 | 4/2004 |
| WO | WO 2004/027200 | A3 | 4/2004 |
| WO | WO 2004/027201 | | 4/2004 |
| WO | WO 2004/027201 | A2 | 4/2004 |
| WO | WO 2004/027204 | A2 | 4/2004 |
| WO | WO 2004/027204 | A3 | 4/2004 |
| WO | WO 2004/027205 | A2 | 4/2004 |
| WO | WO 2004/027205 | A3 | 4/2004 |
| WO | WO 2004/027318 | | 4/2004 |
| WO | WO 2004/027392 | A1 | 4/2004 |
| WO | WO 2004/027786 | A2 | 4/2004 |
| WO | WO 2004/027786 | A3 | 4/2004 |
| WO | WO 2004/028936 | | 4/2004 |
| WO | WO 2004/053434 | A2 | 6/2004 |
| WO | WO 2004/053434 | A3 | 6/2004 |
| WO | WO 2004/057715 | A2 | 7/2004 |
| WO | WO 2004/057715 | A3 | 7/2004 |
| WO | WO 2004/067961 | A2 | 8/2004 |
| WO | WO 2004/067961 | A3 | 8/2004 |
| WO | WO 2004/072436 | A1 | 8/2004 |
| WO | WO 2004/074622 | A2 | 9/2004 |
| WO | WO 2004/074622 | A3 | 9/2004 |
| WO | WO 2004/076798 | A2 | 9/2004 |

| | | | |
|---|---|---|---|
| WO | WO 2004/076798 | A3 | 9/2004 |
| WO | WO 2004/081346 | A2 | 9/2004 |
| WO | WO 2004/083591 | A2 | 9/2004 |
| WO | WO 2004/083591 | A3 | 9/2004 |
| WO | WO 2004/083592 | A2 | 9/2004 |
| WO | WO 2004/083592 | A3 | 9/2004 |
| WO | WO 2004/083593 | A2 | 9/2004 |
| WO | WO 2004/083594 | A2 | 9/2004 |
| WO | WO 2004/083594 | A3 | 9/2004 |
| WO | WO 2004/085790 | A2 | 10/2004 |
| WO | WO 2004/089608 | A2 | 10/2004 |
| WO | WO 2004/089608 | A3 | 10/2004 |
| WO | WO 2004/092527 | A2 | 10/2004 |
| WO | WO 2004/092528 | A2 | 10/2004 |
| WO | WO 2004/092528 | A3 | 10/2004 |
| WO | WO 2004/092530 | A2 | 10/2004 |
| WO | WO 2004/092530 | A3 | 10/2004 |
| WO | WO 2004/094766 | A2 | 11/2004 |
| WO | WO 2004/094766 | A3 | 11/2004 |
| WO | WO 2005/017303 | A2 | 2/2005 |
| WO | WO 2005/021921 | A2 | 3/2005 |
| WO | WO 2005/021921 | A3 | 3/2005 |
| WO | WO 2005/021922 | A2 | 3/2005 |
| WO | WO 2005/021922 | A3 | 3/2005 |
| WO | WO 2005/023391 | | 3/2005 |
| WO | WO 2005/024170 | A2 | 3/2005 |
| WO | WO 2005/024170 | A3 | 3/2005 |
| WO | WO 2005/024171 | A3 | 3/2005 |
| WO | WO 2005/027318 | | 3/2005 |
| WO | WO 2005/028446 | | 3/2005 |
| WO | WO 2005/028451 | | 3/2005 |
| WO | WO 2005/028453 | | 3/2005 |
| WO | WO 2005/028473 | | 3/2005 |
| WO | WO 2005/028641 | | 3/2005 |
| WO | WO 2005/028642 | | 3/2005 |
| WO | WO 2005/028669 | | 3/2005 |
| WO | WO 2005/028803 | A2 | 3/2005 |
| WO | WO 2005/028819 | | 3/2005 |
| WO | WO 2005/028936 | | 3/2005 |
| WO | WO 2005/043122 | | 5/2005 |
| WO | WO 2005/061852 | | 7/2005 |
| WO | WO 2005/071212 | A1 | 8/2005 |
| WO | WO 2005/079186 | A2 | 9/2005 |
| WO | WO 2005/079186 | A3 | 9/2005 |
| WO | WO 2005/081803 | A2 | 9/2005 |
| WO | WO 2005/086614 | A2 | 9/2005 |
| WO | WO 2006/002449 | | 1/2006 |
| WO | WO 2006/010674 | | 2/2006 |
| WO | WO 2006/014333 | A2 | 2/2006 |
| WO | WO 2006/017459 | A2 | 2/2006 |
| WO | WO 2006/020723 | A2 | 2/2006 |
| WO | WO 2006/020726 | A2 | 2/2006 |
| WO | WO 2006/020734 | A2 | 2/2006 |
| WO | WO 2006/020734 | A3 | 2/2006 |
| WO | WO 2006/020809 | A2 | 2/2006 |
| WO | WO 2006/020810 | A2 | 2/2006 |
| WO | WO 2006/020810 | A3 | 2/2006 |
| WO | WO 2006/020827 | A2 | 2/2006 |
| WO | WO 2006/020827 | A3 | 2/2006 |
| WO | WO 2006/020913 | A2 | 2/2006 |
| WO | WO 2006/020913 | A3 | 2/2006 |
| WO | WO 2006/020960 | A2 | 2/2006 |
| WO | WO 2006/033720 | A2 | 3/2006 |
| WO | WO 2006/060387 | A2 | 6/2006 |
| WO | WO 2006/060387 | A3 | 6/2006 |
| WO | WO 2006/079072 | A2 | 7/2006 |
| WO | WO 2006/079072 | A3 | 7/2006 |
| WO | WO 2006/088743 | A2 | 8/2006 |
| WO | WO 2006/088743 | A3 | 8/2006 |
| WO | WO 2006/096762 | A1 | 9/2006 |
| WO | WO 2006/102171 | A2 | 9/2006 |
| WO | WO 2006/102556 | A2 | 9/2006 |
| WO | WO 2007/014339 | A2 | 2/2007 |

OTHER PUBLICATIONS

Neal J. Adams, Drilling Engineering, A Complete Well Planning Approach, 1985, pp. 618-627, PennWell Publishing Company, Tulsa, Oklahoma.

Harvey J. Arbuckle, Advanced Laser Texturing Tames Tough Tasks.

Baker Hughes, EXPatch Expandable Cladding System, Copyright 2002, Baker Hughes Inc.

Baker Hughes, EXPress Expandable Screen System, Baker Hughes Inc.

Baker Hughes, FORMlock Expandable Liner Hanger, Baker Hughes Inc.

Dorel Banabic, Analysis of Metal Sheet Formability and its Factors of Influence, Deep-Drawing Optimization by Controlling the Blank-Holding Force, Mathematical Modelling of Some Special Sheet Metal Forming Procedures, Finite Element Simulation of Deep-Drawing, Theoretical and Experimental Research on Anisotropic Behavior of Sheet Metal.

Kate Blasingame, Gerry Cales, Solid Expandable Tubular Technology in Mature Basins, Copyright 2003, pp. 1-10, AAPG/SPE.

J.C.M. Braas, C.O. Aihevba, M. Shandoodi, R.H. Van Noort, M.N. Baaijens, Water Production Management—PDO's Successful Application of Expandable Technology, Copyright 2002, pp. 1-8, Society of Petroleum Engineers.

V. Brizmer, Y. Kligerman, I. Etson, A Laser Surface Textured Parallel Thrust Bearing, 2003, pp. 397-403, vol. 46, Issue 3.

Jim Brock, Scott Costa, Lev Ring, Andrei Filippov, An Expanded Horizon, Feb. 2000, pp. 115-117.

Bill Buckler, Nick Steinsberger, Kevin Waddell, Rune Gusevik, Edwin Zwald, Expandable Cased-hole Liner Remediates Prolific Gas Well and Minimizes Loss of Production, Copyright 2002, pp. 1-6.

Michael D. Bullock, Tubulars Technology—Expandable Tubular Technology Continues to Broaden Range of Applications, Advances Grow Expandable Applications, Sep. 2004, The American Oil & Gas Reporter.

G.L. Cales, The Development and Applications of Solid Expandable Tubular Technology, Jun. 10, 2003, pp. 1-11.

Gerry Cales, Tom Grant, Larry Book, Reducing Non-Productive Time Through the Use of Solid Expandable Tubulars: How to Beat the Curve Through Pre-Planning, Copyright 2004, Offshore Technology Conference.

Gerry Cales, David Shepherd, Brad Wiest, Pat York, Chan Daigle, Larry Rose, Mike Patterson, Subsidence Remedlation—Extending Well Life Through the Use of Solid Expandable Casing Systems, Mar. 27, 2001, pp. 1-16, American Association of Drilling Engineers.

Don Campo, Gerald Cales, Colley Andrews, Mike Bullock, Mark Rivenbark, Patrick York, Case Histories—Drilling and Recompletion Applications Using Solid Expandable Tubular Technology, Copyright 2002, pp. 1-13, Society of Petroleum Engineers.

Chris Carstens, Mike Breaux, Kate Blasingame, Solid Expandable Tublar Technology: The Value of Planned Installation vs. Contingency, pp. 1-10.

Case History—Eemskanaal—2, Groningen, Feb. 2002, Enventure Global Technology.

Case History—Graham Ranch No. 1, Newark East Barnett Field, Feb. 2002, Enventure Global Technology.

Case History—K.K. Camel No. 1, Ridge Field, Lafayette Parish, Louisiana, Feb. 2002, Enventure Global Technology.

Case History—Mississippi Canyon 809, URSA TLP, OCS-G 5868, No. A-12, Mar. 2004, Enventure Global Technology.

Case History—Unocal Sequoia, Mississippi Canyon 941 Well No. 2, 2005, Enventure Global Technology.

Case History—Yibal 381, Oman, Feb. 2002, Enventure Global Technology.

Lance Cook, Same Internal Casing Diameter From Surface to TD—Drilling Deeper than Ever Before, pp. 1-2, Jul. 2002, Offshore Magazine.

Adrian Cottrill, Core Ideas Expanding Into the Mainstream, Jul. 26, 2002, pp. 26-27, Upstream Magazine.

Chan L. Daigle, Donald B. Campo, Carey J. Naquin, Rudy Cardenas, Lev M. Ring, Patrick L. York, Expandable Tubulars: Field Examples of Application in Well Construction and Remediation, Copyright 2000, pp. 1-14, Society of Petroleum Engineers.
Ali Daneshy, Management Report , Technology Strategy Breeds Value, May 2004.
Data Sheet—Enventure Cased-Hole Liner (CHL) System, Dec. 2002, pp. 1-2, Enventure Global Technology.
Data Sheet—Enventure Openhold Liner (OHL) System, Dec. 2002, pp. 1-2, Enventure Global Technology.
Data Sheet—Window Exit Applications OHL Window Exit Expansion, Jun. 2003, pp. 1-2, Enventure Global Technology.
Bill Dean, Lance Cook, David Brisco, Monodiameter Drilling Liner—From Concept to Reality, Copyright 2003, pp. 1-15, Society of Petroleum Engineers.
Karl Demong, Breakthroughs using Solid Expandable Tubulars to Construct Extended Reach Wells, Copyright, 2004, pp. 1-13, Society of Petroleum Engineers.
Karl Demong, Mark Swift, Mark Rivenbark, Carl Dismuke, Saudi Aramco, Casing Design in Complex Wells: The Use of Expandables and Multilateral Technology to Attack the Size Reduction Issue, pp. 1-11.
Karl Demong, Mark Rivenbark, Carl Dismuke, Expandable Tubulars Enable Multilaterals without Compromise on Hole Size, Casing Design in Complex Wells, Jun. 2003, PennWell Corporation.
Karl Demong, Mark Rivenbark, Khalid Syed Hussain, Planning the Well Construction Process for the use of Solid Expandable Casing, Copyright 2003, pp. 1-10, Society of Petroleum Engineers.
Laurence Demoulin, Tendance Technologie, Les tubes expansibles changent la face du forage petrolier, Jul. 3, 2003, pp. 50-52, Issue No. 2878.
Kenneth Dupal, Donald B. Campo, Colley J. Andrews, R. Lance Cook, Lev M. Ring, Patrick L. York, Realization of the MonoDiameter Well: Evolution of a Game-Changing Technology, Copyright 2002, pp. 1-10, Issue No. 14312, Offshore Technology Conference.
Kenneth K. Dupal, Donald B. Campo, John E. Lofton, Don Weisinger, R. Lance Cook, Michael D. Bullock, Thomas P. Grant, Patrick L. York, Solid Expandable Tubular Technology—A Year of Case Histories in the Drilling Environment, Copyright 27, 2001, pp. 1-16, Issue No. 67770, Society of Petroleum Engineers.
Ken Dupal, Carey J. Naquin, Chan Daigle, Lance Cook, Pat York, Deep Offshore Technology, Well Design With Expandable Tubulars Reduces Costs and Increases Success in Deepwater Applications, 2000, pp. 2-16.
Gier Owe Egge, Production Enhancement Technology, Mar. 10, 2003, pp. 1-18.
EIS Expandable Isolation Sleeve, Feb. 2003.
Letter from Darin H. Duphorne of Baker Hughes to William Norvell of Beirne, Maynard & Parsons, L.L.P. dated Apr. 1, 2005.
SET Technology: The Facts, Copyright 2004, pp. 1-25.
Solid expandable tubulars are enabling technology, Drilling Contractor, Mar./Apr. 2001.
Enventure ready to rejuvenate the North Sea, Pipe & Tubular Services, Sep. 2004.
Carlos Escobar, Bill Dean, Brian, Race, Kevin Waddell, Increasing Solid Expandable Tubular Technology Reliability in a Myriad of Downhole Environments, Copyright 2003, Society of Petroleum Engineers.
Izhak Etsion, Improving Tribological Performance of Mechanical Seals by Laser Surface Texturing, Surface Technologies LTD.
Izhak Etsion, Gregory Halperin, A laser surface textured hydrostatic mechanical seal, Sealing Technology, Mar. 2003.
Expandable Casing Accesses Remote Reservoirs, Petroleum Engineer International, Apr. 1999.
Expandable Sand Screens, Weatherford Completion Systems, Copyright 2002, pp. 1-40.
Andrei Filippov, Robert Mack, Lance Cook, Patrick York, Lev Ring, Terry Mccoy, Expandable Tubular Solutions, Copyright 1999, pp. 1-16, Issue 56500, Society of Petroleum Engineers.
First ever SET workshop held in Aberdeen, Roustabout, Oct. 2004.
Perry A. Fischer, Expendables and the dream of the monodiameter well: a status report, Jul. 2004, World Oil.
Rick Von Flatern, Oilfield Service trio target Jules Verne Territory, Aug. 17, 2001, OilOnline—The Original Online Source for the Oil Industry.
Rick Fontova, Solid Expandable Tubulars (SET) Provide Value to Operators Worldwide in a Variety of Applications, Apr. 2005, EP Journal of Technology, pp. 1-17.
Fraunhofer IWU—Research Area: Sheet Metal Forming—Superpositions of Vibrations, Copyright 2001.
William Furlow, Casing expansion, test process fine tuned on ultra-deepwater well, Offshore, Dec. 2000, PennWell Corporation.
William Furlow, Expandable solid casing reduces telescope effect, Offshore, pp. 102, 140, Issue: Aug. 1998, PennWell Corporation.
William Furlow, Agbada well solid tubulars expanded bottom up, screens expanded top down, Offshore, Issue: Jan. 2002, PennWell Corporation.
Mike Gilmer, Brent Emerson, World's First Completion Set Inside Expandable Screen, High Tech Wells, Copyright 2003, pp. 1-7.
Thomas P. Grant, Michael D. Bullock, Deepwater Expandable Openhole Liner Case Histories: LearnIngs Through Field Applications, Offshore Technology Conference, Copyright 2002, pp. 1-6, Issue 14218.
Philip Guichelaar, Karalyn Folkert, Izhak Etsion, Steven Pride, Effect of Micro-Surface Texturing on Breakaway Torque and Blister Formation on Carbon-Graphite Faces in a Mechanical Seal, Journal of the Society of Tribologists and Lubrication Engineers, Aug. 2002, pp. 18-21.
Rune Gusevik, Randy Merritt, Reaching Deep Reservoir Targets Using Solid Expandable Tubulars, Society of Petroleum Engineers, Copyright 2002, pp. 1-8, Issue 77612.
Henry Haefke, Yvonne Gerbig, Gabriel Dumitru, Valerio Romano, Microtexturing of Functional Surfaces for Improving Their Tribological Performance, Proceedings of the International Tribology Conference, 2000, pp. 217-221, Nagasaki.
Completion Products, Halliburton, Copyright 1996.
Ian D. Harris, Tube Welding, www.tubenet .org, accessed Oct. 25, 2006.
Richard C. Haut, Qamar Sharif, Meeting Economic Challenges of Deepwater Drilling With Expandable—Tubular Technology, Deep Offshore Technology Conference, 1999.
Jennifer Pallanich Hull, MonoDiameter technology keeps hole diameter to TD, Offshore, Copyright 2002, pp. 1-2, Issue—Oct. 2002, PennWell Corporation.
Innovators Chart the Course, pp. 1-21, PennWell Custom Publishing, Tulsa/U.S.A.
Diane Langley, Case Study: Value in Drilling Derived From Application-Specific Technology.
G.R. Linsell, Trib-Gel A Chemical Cold Welding Agent, Trib Tech, Jan. 5, 2004, pp. 1-5.
Todd E. Lizotte, Scratching the surface, PT Design, pp. 41-44, Issue—Jun. 1999.
C. Lee Lohoefer, Ben Mathis, David Brisco, Kevin Waddell, Lev Ring, Patrick York, Expandable Liner Hanger Provides Cost-Effective Alternative Solution, Society of Petroleum Engineers, Copyright 2000, pp. 1-12, Issue 59151.
R.D. Mack, Terry Mccoy, Lev Ring, How in situ expansion affects casing and tubing properties, World Oil magazine, pp. 69-71, Issue Jul. 1999, Gulf Publishing Company.
Robert Mack, Andrei Filippov, Larry Kendziora, Lev Ring, In-Situ Expansion of Casing and Tubing—Effect on Mechanical Properties and Resistance to Sulfide Stress Cracking, Corrosion 2000, Copyright 2000, pp. 1-13, Issue 00164.
Randy M. Merritt, Casing Remediation—Extending Well Life Through the Use of Solid Expandable Casing Systems, pp. 1-15.
Randy M. Merritt, William Buckler, Nick Steinsberger, Rune Gusevik, Well Remediation Using Expandable Cased-Hole Liners—Summary of Case Histories.
Randy M. Merritt, Rune Gusevik, William Buckler, Nick Steinsberger, Well remediation using expandable cased-hole liners, World Oil, Copyright 2002, pp. 56-65, Issue Jul. 2002, Gulf Publishing Company, U.S.A.
Expandable Tubular Energy, Mohawk Energy, Houston, TX / U.S.A.

Melvin J. Moore, Donald B. Campo, Joel Hockaday, Lev Ring, Expandable Liner Hangers: Case Histories, Copyright 2002, pp. 1-11, Issue 14313, Offshore Technology Conference.
Melvin J. Moore, Warren J. Winters, Edwin Zwald, David Brisco, Field Trial Proves Upgrades to Solid Expandable Tubulars, Offshore Technology Conference, Copyright 2002, pp. 1-11, Issue 14217.
Shell and Halliburton Agree to Form Company to Develop and Market Expandable Casing Technology, News Release—Joint Venture, Jun. 3, 1998, pp. 1-2.
Norlizah Mohd Nor, Edmund Huang, Chin Hon Voon, James Lau, Michael Ruggier, Transforming Conventional Wells to Bigbore Completions Using Solid Expandable Tubular Technology, Offshore Technology Conference, Copyright 2002, pp. 1-8, Issue 14315.
Michael Patin, Doug Keel, Craig Johnson, Virgil Newton, Overcoming Well Control Challenges with Solid Expandable Tubular Technology, Offshore Technology Conference, Copyright 2003, pp. 1-5, Issue 15152.
Pipeline Rehabilitation by Sliplining with Polyethylene Pipe, pp. 389-412.
Design and optimization of an ultrasonic die system for forming metal cans, Power Ultrasonics, Jul. 1, 2000.
Matt Ratliff, Changing Safety Paradigms in the Oil and Gas Industry, Society of Petroleum Engineers, Copyright 2004, pp. 1-6, Issue 90828.
Conoco and Tesco Unveil Revolutionary Drilling Rig, Rigzone News, Feb. 11, 2002.
Tesco Provides Casing Drilling Operations Update, Rigzone News, Oct. 16, 2001.
Mark Rivenbark, Expandable Tubular Technology—Drill Deeper, Farther, More Economically, Enventure Global Technology.
Mark Rivenbark, Karl Demong, Sami S. Mulhem, Glen Olivera, Solid Expandable Tubular Technology: The Value of Planned Installation vs. Contingency, Society for Petroleum Engineers, Copyright 2004, pp. 1-8, Issue 90821.
Mark Rivenbark, Karl Demong, Omar Al Faraj, Window Exit Sidetrack Enhancements Through the Use of Solid Expandable Casing, Society of Petroleum Engineers / International Association of Drilling Contractors, Copyright 2004, pp. 1-7, Issue 88030.
Eduardo Perez-Roca, Stacey Andrews, Doug Keel, Addressing Common Drilling Challenges Using Solid Expandable Tubular Technology, Society of Petroleum Engineers, Copyright 2003, pp. 1-9, Issue 80446.
Aviram Ronen, Izhak Etsion, Yuri Kligerman, Friction-Reducing Surface-Texturing in Reciprocating Automotive Components, Tribology Transactions, 2001, pp. 359-366, vol. 44.
G. Ryk, Y. Kligerman, I. Etsion, Experimental Investigation of Laser Surface Texturing for Reciprocating Automotive Components, Tribology Transactions, 2002, pp. 444-449, vol. 45.
Tom Sanders, Rune Gusevik, Ron Nida, James Griffith, Practices for Providing Zonal Isolation in Conjunction with Expandable Casing Jobs—Case Histories, pp. 1-5.
Tom Sanders, Tim Baseflug, Neal Keith, Three Diverse Applications on Three Continents for a Single Major Operator, Offshore Technology Conference, Copyright 2004, pp. 1-8, Issue 16667.
SET Technology: The Facts, Enventure Global Technology, Copyright 2004, pp. 1-25.
Gertjan Siemers, Thompson Ukomah, Robert Mack, Greg Noel, John Donald, Development and Field Testing of Solid Expandable Corrosion Resistant Cased-hole Liners to Boost Gas Production in Corrosive Environments, Offshore Technology Conference, Copyright 2003, pp. 1-6, Issue 15149.
Slim Well: Stepping Stone to MonoDiameter, Enventure Global Technology, pp. 1-16, Issue Jun. 2003.
Maurice Smith, Pipe Dream Reality, New Technology Magazine, pp. 1-3, Issue Dec. 2003.
Solid Expandable Tubulars, Enventure Global Technology, pp. 1-16, Issue Mar. 2002.
Steven W. Sparling, Greg Noel, Expanding Oil Field Tubulars Through a Window Demonstrates Value and Provides New Well Construction Option, Offshore Technology Conference, Copyright 2004, pp. 1-9, Issue 16664.
Mike Sumrow, Shell drills world's first MonoDiameter well in South Texas, Oil & Gas Journal, Copyright 2002, Issue Oct. 21, 2002, PennWell Corporation.
Nicolas Touboul, Lee Womble, John Kotrla, Neal Keith, New Technologies Combine to Reduce Drilling Costs in Ultradeepwater Applications, Society of Petroleum Engineers, Copyright 2004, Ppp. 1-10, Issue 90830.
Letter from Tod T. Tumey of Tumey L.L.P. to Andrei Filippov of Mohawk Energy regarding analyzation of patents 6892819, 6695012, 6640903, 6631769, 6631759, 5348095, May 6, 2006.
Donald L. Turcotte, Gerald Schubert, Geodynamics Applications of Continuum Physics to Geological Problems, Copyright 1982, John Wiley & Sons, Inc., Canada.
Roger Van Noort, Mark Rivenbark, Mike Jones, Using Solid Expandable Tubulars for Openhole Water Shutoff, Society of Petroleum Engineers, Copyright 2002, pp. 1-6, Issue 78495.
Roger Van Noort, Majid Shandoodi, Mike Jones, Water Production Reduced Using Solid Expandable Tubular Technology to "Clad" in Fractured Carbonite Formation, Offshore Technology Conference, Copyright 2003, pp. 1-9, Issue 15153.
Rick Von Flatern, From exotic to routine—the offshore quick-step, Offshore Engineer, pp. 77-83, Issue Apr. 2004.
Rick Von Flatern, Oilfield service trio target Jules Verne territory, Offshore Engineer, pp. 1-4, Issue Aug. 2001.
Kevin Waddell, Advances in Single-diameter Well Technology: The Next Step to Cost-Effective Optimization, Society of Petroleum Engineers, Copyright 2004, pp. 1-10, Issue 90818.
Kevin Waddell, Rutmer Schuurmans, Installation of Solid Expandable Tubular Systems Through Milled Casing Windows, Society of Petroleum Engineers, Copyright 2004, pp. 1-10, Issue 87208.
Peggy Williams, Straightening the Drilling Curve, Drilling Technology, Issue Jan. 2003.
Threadlockers, Oilfield Catalog Jet-Lok Product Application Descriptions, www.jetlube.com, accessed Aug. 8, 2003.
Low Temperature Bonding of Dissimilar and Hard-to-Bond Materials and Metals-Including, Materials Resources International, www.materialsresources.com, Accessed Jan. 5, 2004.
3d Surface Texture Parameters, www.michmet.com, accessed Jan. 22, 2004.
Glavanic Protection, Metallurgical Bonds, Custom Fabrication—Spur Industries, www.spurind.com, accessed Jan. 5, 2004.
Examination Report dated Sep. 4, 2006 on Australian patent application No. 2001/278196.
Examination Report dated Oct. 4, 2006 on Australian patent application No. 2002/237757.
Examination Report dated Apr. 21, 2005 on Australian patent application No. 2001/278196.
Examination Report dated Apr. 28, 2005 on Australian patent application No. 2002/237757.
Examination Report dated Apr. 13, 2005 on Australian patent application No. 2002/240366.
Examination Report dated Jan. 19, 2006 on Australian patent application No. 2003/257878.
Examination Report dated Jan. 30, 2006 on Australian patent application No. 2003/257878.
Examination Report dated Jan. 19, 2006 on Australian patent application No. 2003/257881.
Examination Report dated Jan. 30, 2006 on Australian patent application No. 2003/257881.
Examination Report dated Jun. 14, 2006 on Australian patent application No. 2004/202805.
Examination Report dated Jun. 14, 2006 on Australian patent application No. 2004/202809.
Examination Report dated Jun. 14, 2006 on Australian patent application No. 2004/202812.
Examination Report dated Jun. 14, 2006 on Australian patent application No. 2004/202813.
Examination Report dated Jun. 14, 2006 on Australian patent application No. 2004/202815.
Examination Report dated Nov. 15, 2006 on Canadian patent application No. 2298139.

Examination Report dated Feb. 7, 2007 on Canadian patent application No. 2383231.
Examination Report dated Jan. 24, 2007 on Canadian patent application No. 2419806.
Examination Report dated Jan. 30, 2007 on Canadian patent application No. 2432030.
Examination Report dated Jan. 24, 2007 on Canadian patent application No. 2438807.
Examination Report dated Jan. 30, 2007 on Canadian patent application No. 2517524.
Examination Report dated Mar. 1, 2007 on Chinese PCT national patent application No. 02827985.9.
Examination Report dated Apr. 24, 2006 on European patent application No. 03728326.4.
Examination Report dated Jun. 28, 2006 on European patent application No. 03752486.5.
Search Report dated Nov. 14, 2005 on European application No. 03071281.2.
Search Report dated Nov. 7, 2005 on European application No. 03701281.
Search Report dated May 3, 2006 on European application No. 03723674.2.
Search Report dated Mar. 7, 2006 on European application No. 03728326.
Search Report dated Apr. 24, 2006 on European application No. 03728326.4.
Search Report dated Feb. 8, 2006 on European application No. 03752486.5.
Search Report dated Feb. 24, 2006 on European application No. 03759400.
Search Report dated Mar. 24, 2006 on European application No. 03759400.9.
Search Report dated Mar. 14, 2006 on European application No. 03793078.
Search Report dated Jun. 16, 2006 on European application No. 03793078.1.
Search Report dated Feb. 9, 2005 on European application No. 02806451.7.
Search Report dated Nov. 7, 2005 on European application No. 03701281.
Search Report dated Nov. 22, 2005 on European application No. 03723674.2.
Examination Report dated Oct. 31, 2003 on British patent application No. 0219757.2.
Examination Report dated Nov. 25, 2003 on British patent application No. 0013661.4.
Examination Report dated Apr. 4, 2003 on British patent application No. 0208367.3.
Examination Report dated Nov. 4, 2003 on British patent application No. 0208367.3.
Examination Report dated Nov. 17, 2003 on British patent application No. 0208367.3.
Examination Report dated Jan. 30, 2004 on British patent application No. 0208367.3.
Examination Report dated Apr. 10, 2003 on British patent application No. 0212443.6.
Examination Report dated Feb. 9, 2004 on British patent application No. 0216409.3.
Examination Report dated Nov. 28, 2003 on British patent application No. 0300085.8.
Examination Report dated Dec. 1, 2003 on British patent application No. 030086.6.
Examination Report dated Sep. 10, 2004 on British patent application No. 0306046.4.
Examination Report dated Jul. 15, 2004 on British patent application No. 0314846.7.
Examination Report dated May 25, 2004 on British patent application No. 0320747.9.
Examination Report dated Jan. 31, 2006 on British patent application No. 03701281.2.
Examination Report dated Feb. 6, 2006 on British patent application No. 03723674.2.
Examination Report dated Oct. 29, 2004 on British patent application No. 0400018.8.
Examination Report dated Nov. 4, 2005 on British patent application No. 0400019.6.
Examination Report dated Oct. 29, 2004 on British patent application No. 0400019.6.
Examination Report dated Sep. 2, 2005 on British patent application No. 0400019.6.
Examination Report dated May 20, 2004 on British patent application No. 0404796.5.
Examination Report dated Jun. 28, 2004 on British patent application No. 0406257.6.
Examination Report dated Sep. 2, 2005 on British patent application No. 0406257.6.
Examination Report dated Feb. 21, 2006 on British patent application No. 0406257.6.
Examination Report dated Mar. 3, 2006 on British patent application No. 0406257.6.
Examination Report dated May 20, 2004 on British patent application No. 0406258.4.
Examination Report dated Jul. 12, 2004 on British patent application No. 0408672.4.
Examination Report dated Feb. 13, 2006 on British patent application No. 0412876.5.
Examination Report dated Dec. 8, 2004 on British patent application No. 0422419.2.
Examination Report dated Nov. 8, 2005 on British patent application No. 0422419.2.
Examination Report dated Dec. 15, 2005 on British patent application No. 0422893.8.
Examination Report dated Aug. 8, 2005 on British patent application No. 0422893.8.
Examination Report dated Nov. 24, 2005 on British patent application No. 0425948.7.
Examination Report dated Nov. 24, 2005 on British patent application No. 0425956.0.
Examination Report dated Feb. 9, 2005 on British patent application No. 0428141.5.
Examination Report dated Feb. 21, 2006 on British patent application No. 0428141.6.
Examination Report dated Apr. 5, 2006 on British patent application No. 0500275.3.
Examination Report dated Sep. 12, 2005 on British patent application No. 0500184.7.
Examination Report dated Sep. 6, 2005 on British patent application No. 0500600.2.
Examination Report dated Jan. 27, 2006 on British patent application No. 0501667.0.
Examination Report dated Nov.15, 2005 on British patent application No. 0503250.3.
Examination Report dated Mar. 2, 2006 on British patent application No. 0503250.3.
Examination Report dated Sep. 22, 2005 on British patent application No. 0503470.7.
Examination Report dated Sep. 21, 2005 on British patent application No. 0506699.8.
Examination Report dated May 11, 2006 on British patent application No. 0506699.8.
Examination Report dated Jan. 17, 2006 on British patent application No. 0507979.3.
Examination Report dated Jun. 16, 2005 on British patent application No. 0507979.3.
Examination Report dated Sep. 29, 2005 on British patent application No. 0507980.1.
Examination Report dated Feb. 3, 2006 on British patent application No. 0509618.5.
Examination Report dated Feb. 14, 2006 on British patent application No. 0509620.1.
Examination Report dated Feb. 3, 2006 on British patent application No. 0509627.6.
Examination Report dated Feb. 3, 2006 on British patent application No. 0509629.2.

Examination Report dated Sep. 27, 2005 on British patent application No. 0509629.2.
Examination Report dated Feb. 3, 2006 on British patent application No. 0509630.0.
Examination Report dated Feb. 14, 2006 on British patent application No. 0509631.8.
Examination Report dated Nov. 9, 2005 on British patent application No. 0517448.7.
Examination Report dated Oct. 27, 2005 on British patent application No. 0518025.2.
Examination Report dated Nov. 29, 2005 on British patent application No. 0518039.3.
Examination Report dated Oct. 28, 2005 on British patent application No. 0518252.2.
Examination Report dated Nov. 9, 2005 on British patent application No. 0518799.2.
Examination Report dated Dec. 16, 2005 on British patent application No. 0518893.3.
Examination Report dated Mar. 8, 2006 on British patent application No. 0519989.8.
Examination Report dated Dec. 22, 2005 on British patent application No. 0521024.0.
Examination Report dated Dec. 13, 2005 on British patent application No. 0522050.4.
Examination Report dated Mar. 20, 2006 on British patent application No. 0602877.3.
Examination Report dated Aug. 28, 2002 on British patent application No. 0004285.3.
Examination Report dated Mar. 28, 2003 on British patent application No. 0004285.3.
Search and Examination Report dated Mar. 7, 2006 on British patent application No. 0522155.1.
Search and Examination Report dated Feb. 3, 2006 on British patent application No. 0525768.8.
Search and Examination Report dated Feb. 3, 2006 on British patent application No. 0525770.4.
Search and Examination Report dated Feb. 2, 2006 on British patent application No. 0525772.0.
Search and Examination Report dated Feb. 2, 2006 on British patent application No. 0525774.6.
Search and Examination Report dated Jun. 3, 2003 on British patent application No. 0004282.0.
Search and Examination Report dated Jul. 1, 2003 on British patent application No. 0225505.7.
Search and Examination Report dated Jun. 2, 2003 on British patent application No. 0308290.6.
Search and Examination Report dated Jun. 2, 2003 on British patent application No. 0308293.0.
Search and Examination Report dated Jul. 14, 2003 on British patent application No. 0308293.0.
Search and Examination Report dated Jun. 2, 2003 on British patent application No. 0308294.8.
Search and Examination Report dated Jul. 14, 2003 on British patent application No. 0308294.8.
Search and Examination Report dated Jun. 2, 2003 on British patent application No. 0308295.5.
Search and Examination Report dated Jul. 14, 2003 on British patent application No. 0308295.5.
Search and Examination Report dated Jun. 2, 2003 on British patent application No. 0308296.3.
Search and Examination Report dated Jul. 14, 2003 on British patent application No. 0308296.3.
Search and Examination Report dated Jun. 2, 2003 on British patent application No. 0308297.1.
Search and Examination Report dated Jul. 1, 2003 on British patent application No. 0308297.1.
Search and Examination Report dated Jun. 2, 2003 on British patent application No. 0308299.7.
Search and Examination Report dated Jun. 2, 2003 on British patent application No. 0308302.9.
Search and Examination Report dated Jun. 2, 2003 on British patent application No. 0308303.7.
Search and Examination Report dated Jul. 14, 2003 on British patent application No. 0308303.7.
Search and Examination Report dated Jun. 24, 2003 on British patent application No. 0310090.6.
Search and Examination Report dated Jun. 24, 2003 on British patent application No. 0310099.7.
Search and Examination Report dated Jun. 24, 2003 on British patent application No. 0310101.1.
Search and Examination Report dated Jun. 24, 2003 on British patent application No. 0310104.5.
Search and Examination Report dated Jun. 24, 2003 on British patent application No. 0310118.5.
Search and Examination Report dated Jun. 12, 2003 on British patent application No. 0310757.0.
Search and Examination Report dated Jun. 12, 2003 on British patent application No. 0310759.6.
Search and Examination Report dated Jun. 12, 2003 on British patent application No. 0310770.3.
Search and Examination Report dated Jun. 12, 2003 on British patent application No. 0310772.9.
Search and Examination Report dated Jun. 21, 2003 on British patent application No. 0310785.1.
Search and Examination Report dated Jun. 12, 2003 on British patent application No. 0310795.0.
Search and Examination Report dated Jun. 12, 2003 on British patent application No. 0310797.6.
Search and Examination Report dated Jun. 12, 2003 on British patent application No. 0310799.2.
Search and Examination Report dated Jun. 12, 2003 on British patent application No. 0310801.6.
Search and Examination Report dated Jun. 12, 2003 on British patent application No. 0310833.9.
Search and Examination Report dated Jun. 12, 2003 on British patent application No. 0310836.2.
Examination Report dated Aug. 7, 2003 on British patent application No. 0310836.2.
Search and Examination Report dated Sep. 3, 2003 on British patent application No. 0313406.1.
Search and Examination Report dated Aug. 14, 2003 on British patent application No. 0316883.8.
Search and Examination Report dated Nov. 25, 2003 on British patent application No. 0316883.8.
Search and Examination Report dated Aug. 14, 2003 on British patent application No. 0316886.1.
Search and Examination Report dated Nov. 25, 2003 on British patent application No. 0316886.1.
Search and Examination Report dated Aug. 14, 2003 on British patent application No. 0316887.9.
Search and Examination Report dated Nov. 25, 2003 on British patent application No. 0316887.9.
Search and Examination Report dated Sep. 3, 2003 on British patent application No. 0318545.1.
Search and Examination Report dated Sep. 3, 2003 on British patent application No. 0318547.4.
Search and Examination Report dated Sep. 3, 2003 on British patent application No. 0318547.7.
Search and Examination Report dated Sep. 3, 2003 on British patent application No. 0318549.3.
Search and Examination Report dated Sep. 3, 2003 on British patent application No. 0318550.1.
Search and Examination Report dated Dec. 16, 2003 on British patent application No. 0320579.6.
Search and Examination Report dated Dec. 17, 2003 on British patent application No. 0320580.4.
Search and Examination Report dated Dec. 19, 2003 on British patent application No. 0323891.2.
Search and Examination Report dated Nov. 4, 2003 on British patent application No. 0324172.6.
Search and Examination Report dated Nov. 4, 2003 on British patent application No. 0324172.6.
Search and Examination Report dated Nov. 4, 2003 on British patent application No. 0324174.2.

Search and Examination Report dated Nov. 18, 2003 on British patent application No. 0325071.9.
Examination Report dated Feb. 2, 2004 on British patent application No. 0325071.9.
Search and Examination Report dated Dec. 3, 2003 on British patent application No. 0325072.7.
Examination Report dated Feb. 5, 2004 on British patent application No. 0325072.7.
Examination Report dated Apr. 13, 2004 on British patent application No. 0325072.7.
Search and Examination Report dated Jun. 9, 2004 on British patent application No. 0403891.5.
Search and Examination Report dated Jun. 9, 2004 on British patent application No. 0403893.1.
Search and Examination Report dated Jun. 9, 2004 on British patent application No. 0403894.9.
Search and Examination Report dated Jun. 9, 2004 on British patent application No. 0403894.9.
Search and Examination Report dated Jun. 9, 2004 on British patent application No. 0403897.2.
Search and Examination Report dated Jun. 10, 2004 on British patent application No. 0403920.2.
Search and Examination Report dated Jun. 10, 2004 on British patent application No. 0403921.0.
Search and Examination Report dated Jun. 10, 2004 on British patent application No. 0403926.9.
Search and Examination Report dated Apr. 21, 2004 on British patent application No. 0404826.0.
Search and Examination Report dated Apr. 21, 2004 on British patent application No. 0404828.6.
Search and Examination Report dated Apr. 21, 2004 on British patent application No. 0404830.2.
Examination Report dated Aug. 17, 2004 on British patent application No. 0404830.2.
Search and Examination Report dated Apr. 21, 2004 on British patent application No. 0404832.8.
Search and Examination Report dated Apr. 21, 2004 on British patent application No. 0404833.6.
Search and Examination Report dated Aug. 19, 2004 on British patent application No. 0404833.6.
Search and Examination Report dated May 17, 2004 on British patent application No. 0404837.7.
Examination Report dated Jul. 12, 2004 on British patent application No. 0404837.7.
Search and Examination Report dated May 14, 2004 on British patent application No. 0404839.3.
Search and Examination Report dated May 14, 2004 on British patent application No. 0404842.7.
Search and Examination Report dated May 14, 2004 on British patent application No. 0404845.0.
Search and Examination Report dated May 17, 2004 on British patent application No. 0404849.2.
Search and Examination Report dated Jun. 30, 2004 on British patent application No. 0411698.4.
Search and Examination Report dated Jul. 14, 2004 on British patent application No. 0411892.3.
Search and Examination Report dated Jul. 15, 2004 on British patent application No. 0411893.1.
Search and Examination Report dated Jul. 14, 2004 on British patent application No. 0411893.3.
Search and Examination Report dated Jun. 30, 2004 on British patent application No. 0411894.9.
Search and Examination Report dated Jul. 22, 2004 on British patent application No. 0412190.1.
Search and Examination Report dated Jul. 22, 2004 on British patent application No. 0412191.9.
Search and Examination Report dated Jul. 22, 2004 on British patent application No. 0412192.7.
Search and Examination Report dated Sep. 27, 2005 on British patent application No. 0412876.5.
Search and Examination Report dated Aug. 11, 2004 on British patent application No. 0416834.0.
Search and Examination Report dated Nov. 16, 2004 on British patent application No. 0416834.0.
Search and Examination Report dated Aug. 25, 2004 on British patent application No. 0417810.9.
Search and Examination Report dated Aug. 25, 2004 on British patent application No. 0417811.7.
Search and Examination Report dated Aug. 25, 2004 on British patent application No. 0418005.5.
Search and Examination Report dated Sep. 10, 2004 on British patent application No. 0418425.5.
Search and Examination Report dated Sep. 10, 2004 on British patent application No. 0418426.3.
Search and Examination Report dated Sep. 10, 2004 on British patent application No. 0418427.1.
Search and Examination Report dated Sep. 10, 2004 on British patent application No. 0418429.7.
Search and Examination Report dated Sep. 10, 2004 on British patent application No. 0418429.7.
Search and Examination Report dated Sep. 10, 2004 on British patent application No. 0418430.5.
Search and Examination Report dated Sep. 10, 2004 on British patent application No. 0418431.3.
Search and Examination Report dated Sep. 10, 2004 on British patent application No. 0418432.1.
Search and Examination Report dated Sep. 10, 2004 on British patent application No. 0418433.9.
Search and Examination Report dated Sep. 10, 2004 on British patent application No. 0418439.6.
Search and Examination Report dated Sep. 10, 2004 on British patent application No. 0418442.0.
Search and Examination Report dated Nov. 24, 2004 on British patent application No. 0422893.8.
Search and Examination Report dated Nov. 12, 2004 on British patent application No. 0423416.7.
Search and Examination Report dated Nov. 12, 2004 on British patent application No. 0423417.5.
Search and Examination Report dated Nov. 12, 2004 on British patent application No. 0423418.3.
Search and Examination Report dated Apr. 14, 2005 on British patent application No. 0425948.7.
Search and Examination Report dated Apr. 14, 2005 on British patent application No. 0425951.1.
Search and Examination Report dated Apr. 14, 2005 on British patent application No. 0425956.0.
Search and Examination Report dated Jan. 12, 2005 on British patent application No. 0426155.8.
Search and Examination Report dated Jan. 12, 2005 on British patent application No. 0426156.6.
Search and Examination Report dated Jan. 12, 2005 on British patent application No. 0426157.4.
Search and Examination Report dated Feb. 15, 2005 on British patent application No. 0500600.2.
Search and Examination Report dated Mar. 21, 2005 on British patent application No. 0503470.7.
Search and Examination Report dated Jul. 22, 2005 on British patent application No. 0505039.8.
Search and Examination Report dated May 20, 2005 on British patent application No. 0506697.2.
Search and Examination Report dated Jun. 26, 2006 on British patent application No. 0506699.8.
Search and Examination Report dated Sep. 20, 2005 on British patent application No. 0506700.4.
Search and Examination Report dated Jun. 26, 2006 on British patent application No. 0506702.0.
Search and Examination Report dated Jun. 19, 2006 on British patent application No. 0507980.1.
Search and Examination Report dated Sep. 27, 2005 on British patent application No. 0509618.5.
Search and Examination Report dated Sep. 27, 2005 on British patent application No. 0509620.1.
Search and Examination Report dated Sep. 27, 2005 on British patent application No. 0509626.8.

Search and Examination Report dated Sep. 27, 2005 on British patent application No. 0509627.6.
Search and Examination Report dated Sep. 27, 2005 on British patent application No. 0509529.2.
Search and Examination Report dated Sep. 27, 2005 on British patent application No. 0509630.0.
Search and Examination Report dated Sep. 27, 2005 on British patent application No. 0509631.8.
Search and Examination Report dated Jul. 26, 2005 on British patent application No. 0512396.3.
Search and Examination Report dated Jul. 27, 2005 on British patent application No. 0512398.9.
Search and Examination Report dated Nov. 7, 2005 on British patent application No. 0516429.8.
Search and Examination Report dated Nov. 8, 2005 on British patent application No. 0516430.6.
Search and Examination Report dated Nov. 8, 2005 on British patent application No. 0516431.4.
Search and Examination Report dated Apr. 3, 2006 on British patent application No. 0521931.6.
Search and Examination Report dated Aug. 8, 2006 on British patent application No. 0522052.0.
Search and Examination Report dated Jan. 5, 2006 on British patent application No. 0522892.9.
Search and Examination Report dated Jan. 12, 2006 on British patent application No. 0523075.0.
Search and Examination Report dated Dec. 14, 2005 on British patent application No. 0523076.8.
Search and Examination Report dated Dec. 13, 2005 on British patent application No. 0523078.4.
Search and Examination Report dated Jan. 12, 2006 on British patent application No. 0523132.9.
Search and Examination Report dated Dec. 19, 2005 on British patent application No. 0524692.1.
Search and Examination Report dated Jan. 26, 2006 on British patent application No. 0525663.1.
Search and Examination Report dated Sep. 25, 2006 on British patent application No. 0602877.3.
Search and Examination Report dated Jul. 19, 2006 on British patent application No. 0609173.0.
Search and Examination Report dated Nov. 2, 2006 on British patent application No. 0613405.0.
Search and Examination Report dated Nov. 2, 2006 on British patent application No. 0613406.8.
Search Report dated Mar. 9, 2005 on British patent application No. 0415835.8.
Search Report dated Mar. 10, 2005 on British patent application No. 0415835.8.
Search Report dated Dec. 2, 2004 on British patent application No. 0415835.8.
Search Report dated Mar. 7, 2006 on British patent application No. 0519989.8.
Search Report dated Jul. 13, 2000 on British patent application No. 0003251.6.
Search Report dated Jan. 15, 2001 on British patent application No. 0004282.0.
Search Report dated Jul. 31, 2001 on British patent application No. 0004282.0.
Search Report dated Jul. 14, 2000 on British patent application No. 0004285.3.
Search Report dated Jan. 17, 2001 on British patent application No. 0004285.3.
Search Report dated Aug. 28, 2002 on British patent application No. 0004285.3.
Search Report dated Jul. 24, 2000 on British patent application No. 0005399.1.
Search Report dated Feb. 15, 2001 on British patent application No. 0005399.1.
Search Report dated Oct. 23, 2000 on British patent application No. 0013661.4.
Search Report dated Apr. 18, 2001 on British patent application No. 0013661.4.
Search Report dated Feb. 20, 2003 on British patent application No. 0013661.4.
Search Report dated Nov. 26, 2002 on British patent application No. 0219757.2.
Search Report dated Jan. 21, 2003 on British patent application No. 0219757.2.
Search Report dated Dec. 6, 2002 on British patent application No. 0220872.6.
Search Report dated Mar. 13, 2003 on British patent application No. 0220872.6.
Examination Report dated Oct. 29, 2004 on British patent application No. 0220872.6.
Search Report dated Mar. 6, 2003 on British patent application No. 0225505.7.
Examination Report dated Oct. 27, 2004 on British patent application No. 0225505.7.
Search Report dated Apr. 24, 2006 on British patent application No. 0507980.1.
Search Report dated Mar. 27, 2000 on British patent application No. 9926449.1.
Search Report dated Mar. 30, 2000 on British patent application No. 9926449.1.
Search Report dated Jul. 4, 2001 on British patent application No. 9926449.1.
Search Report dated Sep. 5, 2001 on British patent application No. 9926449.1.
Search Report dated Feb. 28, 2000 on British patent application No. 9926450.9.
Search Report dated May 15, 2000 on British patent application No. 9926450.9.
Search Report dated Nov. 22, 2002 on British patent application No. 9926450.9.
Search Report dated Jun. 27, 2000 on British patent application No. 9930398.4.
Examination Report dated Feb. 15, 2007 on Norwegian patent application No. 1999 5991.
Examination Report dated Sep. 20, 2006 on Norwegian patent application No. 2000 2876.
Examination Report dated Jan. 24, 2007 on Norwegian patent application No. 2002 0070.
Search Report dated Aug. 20, 2002 on Norwegian patent application 1999 5593.
Search Report dated May 13, 2006 on Norwegian patent application No. 2002 1613.
Search Report dated May 29, 2006 on Norwegian patent application No. 2002 3885.
Combined Search Report and Written Opinion dated Apr. 17, 2006 on PCT/US05/28869.
International Preliminary Examination Report dated Sep. 4, 2003 on PCT/US01/28960.
International Preliminary Examination Report dated Aug. 6, 2004 on PCT/US02/24399.
International Preliminary Examination Report dated Jun. 1, 2005 on PCT/US02/25608.
International Preliminary Examination Report dated Jul. 7, 2004 on PCT/US02/25727.
International Preliminary Examination Report dated Apr. 14, 2004 on PCT/US02/36157.
International Preliminary Examination Report dated Jan. 4, 2005 on PCT/US02/36267.
International Preliminary Examination Report dated Feb. 18, 2005 on PCT/US02/39418.
International Preliminary Examination Report dated Nov. 8, 2005 on PCT/US02/39425.
International Preliminary Examination Report dated Dec. 9, 2004 on PCT/US03/04837.
International Preliminary Examination Report dated May 10, 2005 on PCT/US03/06544.
International Preliminary Examination Report dated Jul. 7, 2004 on PCT/US03/10144.
International Preliminary Examination Report dated Aug. 15, 2005 on PCT/US03/11765.

International Preliminary Examination Report dated Sep. 16, 2004 on PCT/US03/11765.
International Preliminary Examination Report dated Dec. 10, 2004 on PCT/US03/11765.
International Preliminary Examination Report dated Jul. 18, 2005 on PCT/US03/11765.
International Preliminary Examination Report dated Mar. 2, 2005 on PCT/US03/13787.
International Preliminary Examination Report dated Apr. 7, 2005 on PCT/US03/13787.
International Preliminary Examination Report dated May 12, 2005 on PCT/US03/14153.
International Preliminary Examination Report dated Nov. 14, 2005 on PCT/US03/15020.
International Preliminary Examination Report dated May 9, 2005 on PCT/US03/15020.
International Preliminary Examination Report dated Sep. 30, 2004 on PCT/US03/20870.
International Preliminary Examination Report dated May 25, 2005 on PCT/US03/25667.
International Preliminary Examination Report dated Aug. 30, 2005 on PCT/US03/25675.
International Preliminary Examination Report dated Aug. 17, 2004 on PCT/US03/25676.
International Preliminary Examination Report dated Aug. 17, 2004 on PCT/US03/25677.
International Preliminary Examination Report dated Dec. 20, 2004 on PCT/US03/25742.
International Preliminary Examination Report dated Dec. 8, 2004 on PCT/US03/29460.
International Preliminary Examination Report dated May 23, 2005 on PCT/US03/29858.
International Preliminary Examination Report dated Aug. 16, 2004 on PCT/US03/29859.
International Preliminary Examination Report dated May 23, 2005 on PCT/US03/38550.
International Preliminary Report on Patentability, Application PCT/US04/00631, Mar. 2, 2006.
International Preliminary Report on Patentability, Application PCT/US04/11973, Dec. 27, 2006.
International Preliminary Report on Patentability, Application PCT/US04/02122, May 13, 2005.
International Preliminary Report on Patentability, Application PCT/US04/04740, Jun. 27, 2006.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Mar. 17, 2003.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/08170, Jan. 13, 2005.
International Preliminary Report on Patentability, Application PCT/US04/08170, Sep. 29, 2005.
International Preliminary Report on Patentability, Application PCT/US04/08171, Sep. 13, 2005.
International Preliminary Report on Patentability, Application PCT/US04/10317, Jun. 23, 2006.
International Preliminary Report on Patentability, Application PCT/US04/11177, Jun. 9, 2005.
International Preliminary Report on Patentability, Application PCT/US04/28423, Jul. 13, 2005.
International Preliminary Report on Patentability, Application PCT/US04/28423, Jun. 19, 2006.
International Preliminary Report on Patentability, Application PCT/US04/28438, Sep. 20, 2005.
International Preliminary Report on Patentability, Application PCT/US04/28438, Sep. 20, 2005.
International Preliminary Report on Patentability, Application PCT/US04/28887, Sep. 27, 2006.
International Preliminary Report on Patentability, Application PCT/US04/28889, Aug. 1, 2006.
International Preliminary Report on Patentability, Application PCT/US05/28642, Jul. 14, 2006.
International Preliminary Report on Patentability, Application PCT/US05/28819, Feb. 12, 2007.
International Search Report, Application PCT/IL00/00245, Sep. 18, 2000.
International Search Report, Application PCT/US00/18635, Nov. 24, 2000.
International Search Report, Application PCT/US00/27645, Dec. 19, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01130256, Jan. 3, 2002.
International Search Report, Application PCT/US01/41446, Oct. 30, 2001.
International Search Report, Application PCT/US02/00093, May 30, 2002.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477, Oct. 31, 2003.
International Search Report, Application PCT/US02/20477, Apr. 6, 2004.
International Search Report, Application PCT/US02/24399, Feb. 20, 2004.
International Search Report, Application PCT/US02/24399, Feb. 27, 2004.
International Search Report, Application PCT/US02/24399, Aug. 6, 2004.
international Search Report, Application PCT/US02/25608, May 24, 2004.
International Search Report, Application PCT/US02/25727, Feb. 19, 2004.
Examination Report, Application PCT/US02125727, Jul. 7, 2004.
International Search Report, Application PCT/US02/29856, Dec. 16, 2002.
international Search Report, Application PCT/US02/36157, Sep. 29, 2003.
International Search Report, Application PCT/US02/36267, May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.

International Search Report, Application PCT/US03/10144, Oct. 31, 2003.
International Search Report, Application PCT/US03/11765, Nov. 13, 2003.
International Search Report, Application PCT/US03/13787, May 28, 2004.
International Search Report, Application PCT/US03/14153, May 28, 2004.
International Search Report, Application PCT/US03/15020, Nov. 14, 2005.
International Search Report, Application PCT/US03/15020, Jul. 30, 2003.
International Search Report, Application PCT/US03/18530, Jun. 24, 2004.
International Search Report, Application PCT/US03/19993, May 24, 2004.
International Search Report, Application PCT/US03/20694, Nov. 12, 2003.
International Search Report, Application PCT/US03/20870, May 24, 2004.
International Search Report, Application PCT/US03/20870, Sep. 30, 2004.
International Search Report, Application PCT/US03/24779, Mar. 3, 2004.
International Search Report, Application PCT/US03/25667, Feb. 26, 2004.
International Search Report, Application PCT/US03/25675, May 25, 2004.
International Search Report, Application PCT/US03/25676, May 17, 2004.
International Search Report, Application PCT/US03/25677, May 21, 2004.
International Search Report, Application PCT/US03/25707, Jun. 23, 2004.
International Search Report, Application PCT/US03/25715, Apr. 9, 2004.
International Search Report, Application PCT/US03/25716, Jan. 16, 2005.
International Search Report, Application PCT/US03/25742, May 27, 2004.
International Search Report, Application PCT/US03/29460, May 25, 2004.
International Search Report, Application PCT/US03/29858, Jun. 30, 2004.
International Search Report, Application PCT/US03/29859, May 21, 2004.
International Search Report, Application PCT/US03/38550, Jun. 15, 2004.
International Search Report, Application PCT/US04/00631, Mar. 28, 2005.
International Search Report, Application PCT/US04/10317, May 25, 2006.
International Search Report, Application PCT/US04/28831, Dec. 19, 2005.
International Search Report, Application PCT/US04/28889, Nov. 14, 2005.
International Search Report, Application PCT/US05/28669, Apr. 17, 2006.
International Search Report and Written Opinion, Application PCT/US04/26345, Oct. 5, 2006.
International Search Report and Written Opinion, Application PCT/US05/28446, Oct. 27, 2006.
International Search Report and Written Opinion, Application PCT/US06/02449, Oct. 24, 2006.
International Search Report and Written Opinion, Application PCT/US04/10762, Sep. 1, 2005.
International Search Report and Written Opinion, Application PCT/US04/00631, Mar. 28, 2005.
International Search Report and Written Opinion, Application PCT/US04/02122, Feb. 24, 2005.
international Search Report and Written Opinion, Application PCT/US04/04740, Jan. 19, 2005.
International Search Report and Written Opinion, Application PCT/US04/06246, Jan. 26, 2005.
International Search Report and Written Opinion, Application PCT/US04/07711, Nov. 28, 2006.
International Search Report and Written Opinion, Application PCT/US04/08030, Jan. 6, 2005.
international Search Report and Written Opinion, Application PCT/US04/08073, Mar. 4, 2005.
International Search Report and Written Opinion, Application PCT/US04/08170, Jan. 13, 2005.
International Search Report and Written Opinion, Application PCT/US04/08171, Feb. 16, 2005.
international Search Report and Written Opinion, Application PCT/US04/11177, Feb. 14, 2005.
International Search Report and Written Opinion, Application PCT/US04/11973, Sep. 27, 2005.
International Search Report and Written Opinion, Application PCT/US04/28423, Jul. 13, 2005.
International Search Report and Written Opinion, Application PCT/US04/28438, Mar. 14, 2005.
International Search Report and Written Opinion, Application PCT/US05/28473, Sep. 1, 2006.
International Search Report and Written Opinion, Application PCT/US05/28642, Jul. 14, 2006.
International Search Report and Written Opinion, Application PCT/US05/28819, Aug. 3, 2006.
International Search Report and Written Opinion, Application PCT/US06/04809, Aug. 29, 2006.
international Search Report and Written Opinion, Application PCT/US06/09886, Dec. 4, 2006.
Written Opinion, Application PCT/US01/19014, Dec. 10, 2002.
Written Opinion, Application PCT/US01/23815, Jul. 25, 2002.
Written Opinion, Application PCT/US01/28960, Dec. 2, 2002.
Written Opinion, Application PCT/US01/30256, Nov. 11, 2002.
Written Opinion, Application PCT/US01/30256, Nov. 27, 2002.
Written Opinion, Application PCT/US02/00093, Apr. 21, 2003.
Written Opinion, Application PCT/US02/00677, Apr. 17, 2003.
Written Opinion, Application PCT/US02/04353, Apr. 11, 2003.
Written Opinion, Application PCT/US02/20256, May 9, 2003.
Written Opinion, Application PCT/US02/24399, Apr. 28, 2004.
Written Opinion, Application PCT/US02/25608, Sep. 13, 2004.
Written Opinion, Application PCT/US02/25608, Feb. 2, 2005.
Written Opinion, Application PCT/US02/25727, May 17, 2004.
Written Opinion, Application PCT/US02/39418, Jun. 9, 2004.
Written Opinion, Application PCT/US02/39425, Nov. 22, 2004.
Written Opinion, Application PCT/US02/39425, Apr. 11, 2005.
Written Opinion, Application PCT/US03/06544, Feb. 18, 2005.
Written Opinion, Application PCT/US03/11765, May 11, 2004.
Written Opinion, Application PCT/US03/13787, Nov. 9, 2004.
Written Opinion, Application PCT/US03/14153, Sep. 9, 2004.
Written Opinion, Application PCT/US03/14153, Nov. 9, 2004.
Written Opinion, Application PCT/US03/18530, Sep. 13, 2004.
Written Opinion, Application PCT/US03/19993, Oct. 15, 2004.
Written Opinion, Application PCT/US03/25675, May 9, 2005.
Written Opinion, Application PCT/US03/29858, Jan. 21, 2005.
Written Opinion, Application PCT/US03/38550, Dec. 10, 2004.
Written Opinion, Application PCT/US04/08171, May 5, 2005.
Written Opinion, Application PCT/US04/29025, Jan. 4, 2007.
Examination Report dated Feb. 13, 2007 on Australian Patent Application No. 2002367017.
Examination Report dated Oct. 13, 2006 on Australian Patent Application No. 200400246.
Examination Report dated Sep. 22, 2006 on Australian Patent Application No. 2004200248.
Examination Report dated Jun. 5, 2007 on Brazilian patent application No. PI 9906143-0.
Examination Report dated Jul. 3, 2007 on Canadian Patent Application No. 2536623.
Examination Report dated Jun. 12, 2007 on Canadian Patent Application No. 2516140.
Examination Report dated Feb. 20, 2007 on Canadian Patent Application No. 2428819.

Examination Report dated Feb. 26, 2007 on Canadian Patent Application No. 2389094.
Examination Report dated Jul. 4, 2007 on European Patent Application No. 3728326.4.
Examination Report dated Apr. 2, 2007 on European Patent Application No. 3701281.2.
Examination Report dated Mar. 15, 2007 on British patent application No. 602877.3.
Examination Report dated Sep. 17, 2007 on British patent application No. 602877.3.
Examination Report dated Sep. 18, 2007 on British patent application No. 604359.
Examination Report dated Sep. 13, 2007 on British Patent application No. 604360.8.
Examination Report dated May 23, 2007 on British patent application No. 621060.3.
Examination Report dated Jul. 23, 2007 on British patent application No. 621060.3.
Examination Report dated Jun. 21, 2007 on British patent application No. 621059.5.
Examination Report dated Aug. 8, 2007 on British patent application No. 621059.5.
Examination Report dated Jun. 21, 2007 on British patent application No. 621053.8.
Examination Report dated Aug. 13, 2007 on British patent application No. 621053.8.
Examination Report dated Aug. 17, 2007 on British patent application No. 603576.
Examination Report dated Aug. 7, 2007 on British patent application No. 613924.
Examination Report dated Feb. 28, 2007 on British patent application No. 621062.9.
Examination Report dated May 23, 2007 on British patent application No. 621062.9.
Examination Report dated Jul. 23, 2007 on British patent application No. 621062.9.
Examination Report dated Apr. 5, 2007 on British patent application No. 613406.8.
Examination Report dated Jun. 22, 2007 on British patent application No. 609173.
Examination Report dated Sep. 14, 2007 on British patent application No. 623634.3.
Examination Report dated Jul. 5, 2007 on British patent application No. 624328.1.
Examination Report dated Sep. 4, 2007 on British patent application No. 624328.1.
Examination Report dated Aug. 7, 2007 on British patent application No. 624327.3.
Examination Report dated Sep. 5, 2007 on British patent application No. 624394.3.
Examination Report dated Sep. 5, 2007 on British patent application No. 624768.
Examination Report dated Sep. 13, 2007 on British patent application No. 624779.5.
Examination Report dated Aug. 15, 2007 on British patent application No. 625615.
Examination Report dated Jul. 26, 2007 on British patent application No. 522049.6.
Examination Report dated Mar. 5, 2007 on British patent application No. 522049.6.
Examination Report dated Sep. 7, 2007 on British patent application No. 522049.6.
Examination Report dated Aug. 13, 2007 on British patent application No. 625636.6.
Examination Report dated Jul. 16, 2007 on British patent application No. 522155.1.
Search and Examination Report dated Aug. 16, 2007 on British patent application No. 621054.6.
Search and Examination Report dated Mar. 30, 2007 on British patent application No. 702797.2.
Search and Examination Report dated Aug. 2, 2007 on British Patent application No. 702797.2.
Search and Examination Report dated Mar. 19, 2007 on British patent application No. 624327.3.
Search and Examination Report dated Aug. 15, 2007 on British patent application No. 624327.3.
Search and Examination Report dated Mar. 19, 2007 on British patent application No. 625615.
Search and Examination Report dated Jun. 28, 2007 on British patent application No. 707073.3.
Search and Examination Report dated Jul. 31, 2007 on British patent application No. 706794.5.
Search and Examination Report dated Jun. 7, 2007 on British patent application No. 706799.4.
Search and Examination Report dated Sep. 3, 2007 on British patent application No. 715477.6.
Search and Examination Report dated Sep. 3, 2007 on British patent application No. 715478.4.
Search and Examination Report dated Sep. 3, 2007 on British patent application No. 715362.
Search and Examination Report dated Sep. 4, 2007 on British patent application No. 715357.
Search and Examination Report dated Sep. 4, 2007 on British patent application No. 715365.3.
Search and Examination Report dated Mar. 15, 2007 on British patent application No. 625636.6.
Search and Examination Report dated Mar. 15, 2007 on British patent application No. 624394.3.
Search and Examination Report dated Mar. 15, 2007 on British patent application No. 604357.4.
Search and Examination Report dated Mar. 15, 2007 on British patent application No. 623631.9.
Search and Examination Report dated Mar. 15, 2007 on British patent application No. 623634.3.
Search and Examination Report dated Apr. 24, 2007 on British patent application No. 702989.5.
Search and Examination Report dated Mar. 15, 2007 on British patent application No. 624779.5.
Search and Examination Report dated Mar. 15, 2007 on British patent application No. 624790.2.
Search and Examination Report dated Mar. 15, 2007 on British patent application No. 603995.2.
Search and Examination Report dated Mar. 15, 2007 on British patent application No. 6043593.
Search and Examination Report dated Mar. 15, 2007 on British patent application No. 604360.8.
Search Report Jun. 6, 2007 on British patent application No. 613406.8.
Substantive Examination dated Jul. 25, 2007 on Mexican patent application No. PA/A/2004/006681.
Examination Report dated Aug. 31, 2007 on Norwegian Patent Application No. 20002876.
Examination Report dated May 23, 2007 on Norwegian patent application No. 20001281.
Examination Report dated Jul. 26, 2007 on Norwegian patent application No. 20021613.
Examination Report dated Oct. 10, 2005 on Norwegian patent application No. 20000924.
Examination Report dated Aug. 3, 2007 on Norwegian patent application No. 20000924.
International Preliminary Exam Report, application PCT/US06/009886, May 23, 2007.

* cited by examiner

Modulus of Elasticity, $E = 30 \times 10^6$ psi, Poisson's Ratio, $\nu = 0.3$

EXPANSION CONE AND SYSTEM

CROSS REFERENCE TO RELATED APPLICATIONS

This application claims the benefit of the filing date of U.S. provisional patent application Ser. No. 60/746,813, filed on May 9, 2006, the disclosure of which is incorporated herein by reference.

This application is a continuation in part of application Ser. No. 10/571,086, filed on Mar. 6, 2006, which is a national stage PCT application number PCT/US2004/028889, filed on Sep. 7, 2004, which claims the benefit of application 60/500,435, filed on Sep. 5, 2003, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 2000, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep.

25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, no. 25791.12.02, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser.

No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application serial no. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application Ser. No. PCT/US2004/06246, filed on Feb. 26, 2004; (123) PCT patent application serial number PCT/US2004/08170, filed on Mar. 15, 2004; (124) PCT patent application serial number PCT/US2004/08171, filed on Mar. 15, 2004; (125) PCT patent application Ser. No. PCT/US2004/08073, filed on Mar. 18, 2004; (126) PCT patent application serial number PCT/US2004/07711, filed on Mar. 11, 2004; (127) PCT patent application serial number PCT/US2004/029025, filed on Mar. 26, 2004; (128) PCT patent application Ser. No. PCT/US2004/010317, filed on Apr. 2, 2004; (129) PCT patent application serial number PCT/US2004/010712, filed on Apr. 6, 2004; (130) PCT patent application serial number PCT/US2004/010762, filed on Apr. 6, 2004; (131) PCT patent application Ser. No. PCT/US2004/011973, filed on Apr. 15, 2004; (132) U.S. provisional patent application Ser. No. 60/495,056, filed on Aug. 14, 2003; (133) U.S. provisional patent application Ser. No. 60/600,679, filed on Aug. 11, 2004; (134) PCT patent application Ser. No. PCT/US2005/027318, filed on Jul. 29, 2005; (135) PCT patent application serial number PCT/US2005/028936, filed on Aug. 12, 2005; (136) PCT patent application serial number PCT/US2005/028669, filed on Aug. 11, 2005; (137) PCT patent application Ser. No. PCT/US2005/028453, filed on Aug. 11, 2005; (138) PCT patent application serial number PCT/US2005/028641, filed on Aug. 11, 2005; (139) PCT patent application serial number PCT/US2005/028819, filed on Aug. 11, 2005; (140) PCT patent application Ser. No. PCT/US2005/028446, filed on Aug. 11, 2005; (141) PCT patent application serial number PCT/US2005/028642, filed on Aug. 11, 2005; (142) PCT patent application serial number PCT/US2005/028451, filed on Aug. 11, 2005, and (143). PCT patent application Ser. No. PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005 (148) U.S. utility patent application Ser. No. 10/545,941, filed on Aug. 16, 2005, (149) U.S. utility patent application Ser. No. 546078, filed on Aug. 16, 2005, filed on Aug. 11, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application serial number PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No. 60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645,840, filed on Jan. 21, 2005, (161) PCT patent application serial number PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U.S. Provisional patent application No. 60/717,391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725,181, filed on Oct. 11, 2005; (171) U.S. National Stage application Ser. No. 10/553,094, filed on Oct. 13, 2005; (172) U.S. National Stage application Ser. No. 10/553,566, filed on Oct. 17, 2005; (173) PCT patent application No. PCT/US2006/002449, filed on Jan. 20, 2006, and (174) PCT Patent Application No. PCT/US2006/004809, filed on Feb. 9, 2006; (175) U.S. Utility Patent application Ser. No. 11/356,899, filed on Feb. 17, 2006, (176) U.S. National Stage application Ser. No. 10/568,200, filed on Feb. 13, 2006, (177) U.S. National Stage application Ser. No. 10/568,719, filed on Feb. 16, 2006, filed on Feb. 16, 2006, (178) U.S. National Stage application Ser. No. 10/569,323, filed on Feb. 17, 2006, (179) U.S. National State patent application Ser. No. 10/571,041, filed on Mar. 3, 2006; (180) U.S. National State patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006, (183) U.S. utility patent application Ser. No. 10/938,788, filed on Sep. 10, 2004, (184) U.S. utility patent application Ser. No. 10/938,225, filed on Sep. 10, 2004, (185) U.S. utility patent application Ser. No. 10/952,288, number 25791.332, filed on Sep. 28, 2004, (186) U.S. utility patent application Ser. No. 10/952,416, filed on Sep. 28, 2004, (187) U.S. utility patent application Ser. No. 10/950,749, filed on Sep. 27, 2004, (188) U.S. utility patent application Ser. No. 10/950,869, filed on Sep. 27, 2004; (189) U.S. provisional patent application Ser. No. 60/761,324, filed on Jan. 23, 2006, (190) U.S. provisional patent application Ser. No. 60/754,556, filed on Dec. 28, 2005, (191) U.S. utility patent application Ser. No. 11/380,051, filed on Apr. 25, 2006, and (192) U.S. utility patent application Ser. No. 11/380,055, filed on Apr. 25, 2006, the disclosures of which are incorporated herein by reference.

This application is related to the following co-pending applications: (193) U.S. utility patent application Ser. No. 10/522,039, filed on Mar. 10, 2006; (194) U.S. provisional patent application Ser. No. 60/746,813, filed on May 9, 2006; (195) U.S. utility patent application Ser. No. 11/456,584, filed on Jul. 11, 2006; and (196) U.S. utility patent application Ser. No. 11/456,587, filed on Jul. 11, 2006; (197) PCT patent application No. PCT/US2006/009886, filed on Mar. 21, 2006; (198) PCT patent application No. PCT/US2006/010674, filed on Mar. 21, 2006; (199) U.S. Pat. No. 6,409,175 which issued Jun. 25, 2002, (200) U.S. Pat. No. 6,550,821 which issued Apr. 22, 2003, (201) U.S. patent application Ser. No. 10/767,953, filed Jan. 29, 2004, now U.S. Pat. No. 7,077,211 which issued Jul. 18, 2006; (202) U.S. patent application Ser. No. 10/769,726, filed Jan. 30, 2004, (203) U.S. patent application Ser. No. 10/770,363 filed Feb. 2, 2004, (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; (212) U.S. utility patent application Ser. No. 11/074,266, filed on Mar. 7, 2005, (213) U.S. provisional patent application Ser. No. 60/832,909, filed on Jul. 24, 2006, (214) U.S. utility patent application Ser. No. 11/536,302, filed Sep. 28, 2006, (215) U.S. utility patent application Ser. No. 11/538,228, filed Oct. 3, 2006, (216) U.S. utility patent application Ser. No. 11/552,703, filed on Oct. 25, 2006, (217) U.S. utility application Ser. No. 11/553,240, filed on Oct. 26, 2006, (218) U.S. utility application Ser. No. 11/554,288, filed on Oct. 30, 2006, (219) U.S. utility application Ser. No. 11/560,154, filed on Nov. 15, 2006, (220) U.S. provisional application Ser. No. 60/866,536, filed on Nov. 20, 2006, (221) U.S. provisional application Ser. No. 60/866,543, filed on Nov. 20, 2006, (222) U.S. utility application Ser. No. 11/621,245, filed on Jan. 9, 2007; (223) U.S. utility application Ser. No. 11/621,129, filed on Jan. 9, 2007; (224) U.S. utility application Ser. No. 11/623,980, filed on Jan. 17, 2007; (225) U.S. utility application Ser. No. 11/669,338, filed on Jan. 31, 2007; (226) U.S. utility application Ser. No. 11/630,741, filed on Dec. 22, 2006; (227) U.S. utility application Ser. No. 11/573,018, filed on Jan. 31, 2007; (228) U.S. utility application Ser. No. 11/573,519, filed on Feb. 13, 2007; (229) U.S. utility application Ser. No. 11/573,467, filed on Feb. 13, 2007; (230) U.S. utility application Ser. No. 11/573,485, filed on Feb. 9, 2007; (231) U.S. utility application Ser. No. 11/573,486, filed on Feb. 9, 2007; (232) U.S. utility application Ser. No. 11/573,066, filed on Feb. 7, 2007; (233) U.S. utility application Ser. No. 11/573,482, filed on Feb. 9, 2007; (234) U.S. utility application Ser. No. 11/573,309, filed on Feb. 6, 2007; (235) U.S. utility application Ser. No. 11/573,470, filed on Feb. 13, 2007; (236) U.S. utility application Ser. No. 11/573,465, filed on Feb. 9, 2007, the disclosures of which are incorporated herein by reference.

BACKGROUND OF THE INVENTION

The present disclosure relates generally to wellbore casings and/or pipelines, and in particular to wellbore casings and/or pipelines that are formed using expandable tubing.

DETAILED DESCRIPTION

Figure 1:
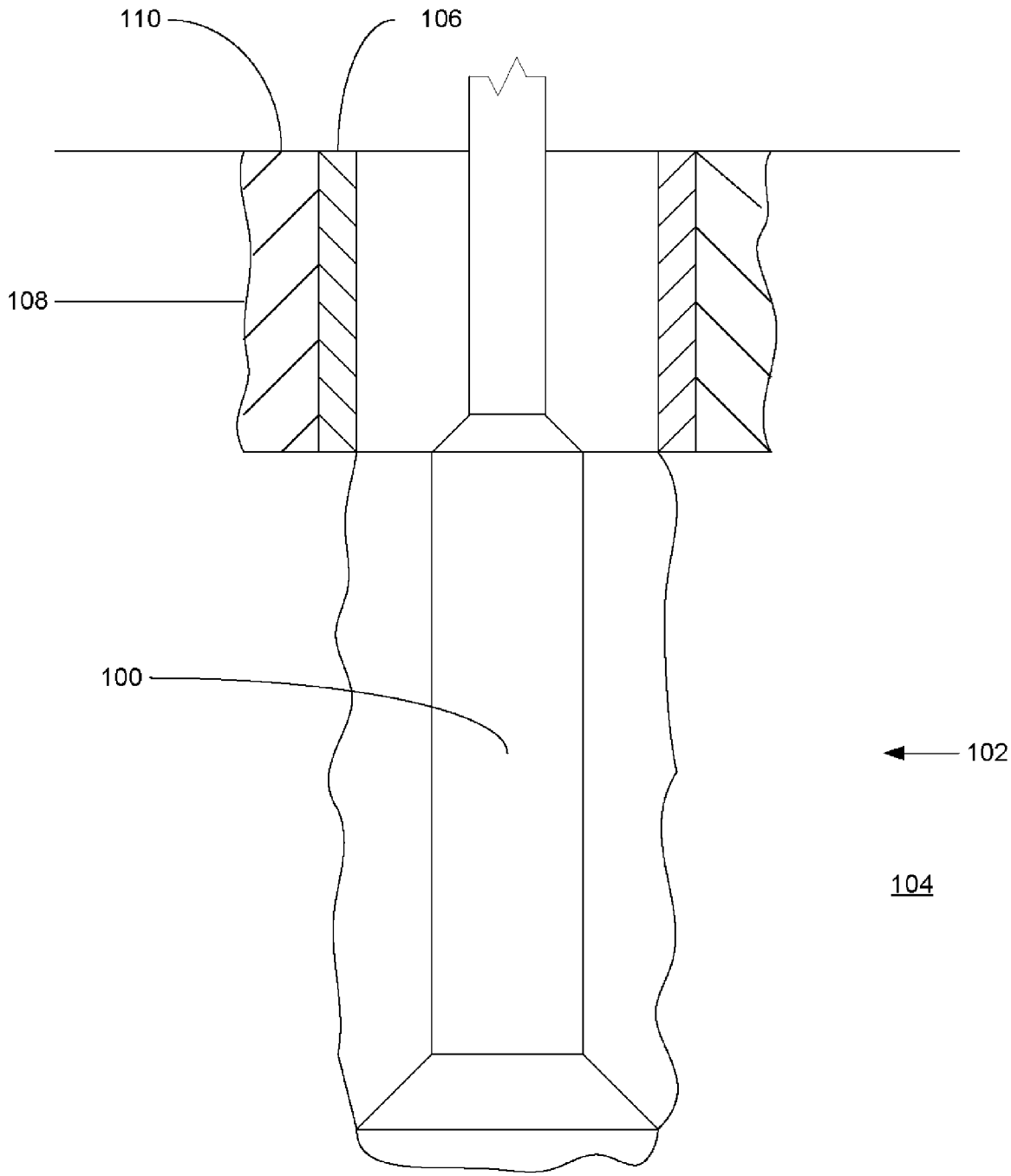
FIG. 1 is an illustration of a conventional method for drilling a borehole in a subterranean formation.

Referring initially to FIG. 1, a conventional device 100 for drilling a borehole 102 in a subterranean formation 104 is shown. The borehole 102 may be lined with a casing 106 at the top portion of its length. An annulus 108 formed between the casing 106 and the formation 104 may be filled with a sealing material 110, such as, for example, cement. In an exemplary embodiment, the device 100 may be operated in a conventional manner to extend the length of the borehole 102 beyond the casing 106.

Figure 2:
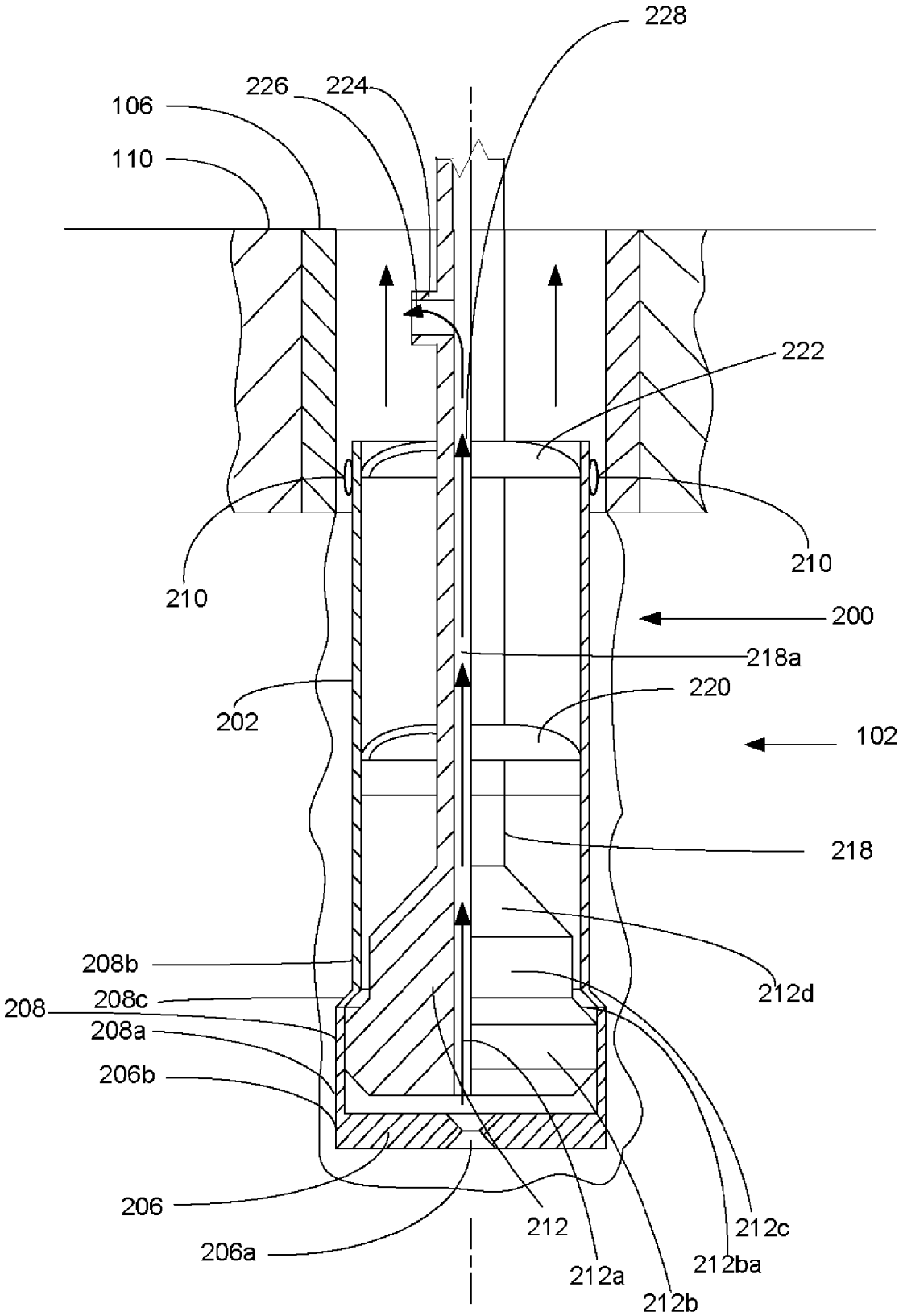
FIG. 2 is an illustration of a device for coupling an expandable tubular member to an existing tubular member.

Referring now to FIG. 2, a device 200 for coupling an expandable tubular member 202 to an existing tubular member, such as, for example, the existing casing 106, is shown. The device 200 includes a shoe 206 that defines a centrally positioned valveable passage 206*a* adapted to receive, for example, a ball, plug or other similar device for closing the passage. An end of the shoe 206*b* is coupled to a lower tubular end 208*a* of a tubular launcher assembly 208 that includes the lower tubular end, an upper tubular end 208*b*, and a tapered tubular transition member 208*c*. The lower tubular end 208*a* of the tubular launcher assembly 208 has a greater inside diameter than the inside diameter of the upper tubular end 208*b*. The tapered tubular transition member 208*c* connects the lower tubular end 208*a* and the upper tubular end 208*b*. The upper tubular end 208*b* of the tubular launcher assembly 208 is coupled to an end of the expandable tubular member 202. One or more seals 210 are coupled to the outside surface of the other end of the expandable tubular member 202.

An expansion device 212 is centrally positioned within and mates with the tubular launcher assembly 208. The expansion device 212 defines a centrally positioned fluid pathway 212*a*, and includes a lower section 212*b*, a middle section 212*c*, and an upper section 212*d*. The lower section 212*b* of the expansion device 212 includes an inclined expansion surface 212*ba* that supports the tubular launcher assembly 208 by mating with the tapered tubular transition member 208*c* of the tubular launcher assembly. The upper section 212*d* of the expansion device 212 is coupled to an end of a tubular member 218 that defines a fluid pathway 218*a*. The fluid pathway 218*a* of the tubular member 218 is fluidicly coupled to the fluid pathway 212*a* defined by the expansion device 212. One or more spaced apart cup seals 220 and 222 are coupled to the outside surface of the tubular member 218 for sealing against the interior surface of the expandable tubular member 202. In an exemplary embodiment, cup seal 222 is positioned near a top end of the expandable tubular member 202. A top fluid valve 224 is coupled to the tubular member 218 above the cup seal 222 and defines a fluid pathway 226 that is fluidicly coupled to the fluid pathway 218*a*.

During operation of the device 200, as illustrated in FIG. 2, the device 200 is initially lowered into the borehole 102. In an exemplary embodiment, during the lowering of the device 200 into the borehole 102, a fluid 228 within the borehole 102 passes upwardly through the device 200 through the valveable passage 206*a* into the fluid pathway 212*a* and 218*a* and out of the device 200 through the fluid pathway 226 defined by the top fluid valve 224.

Figure 3:
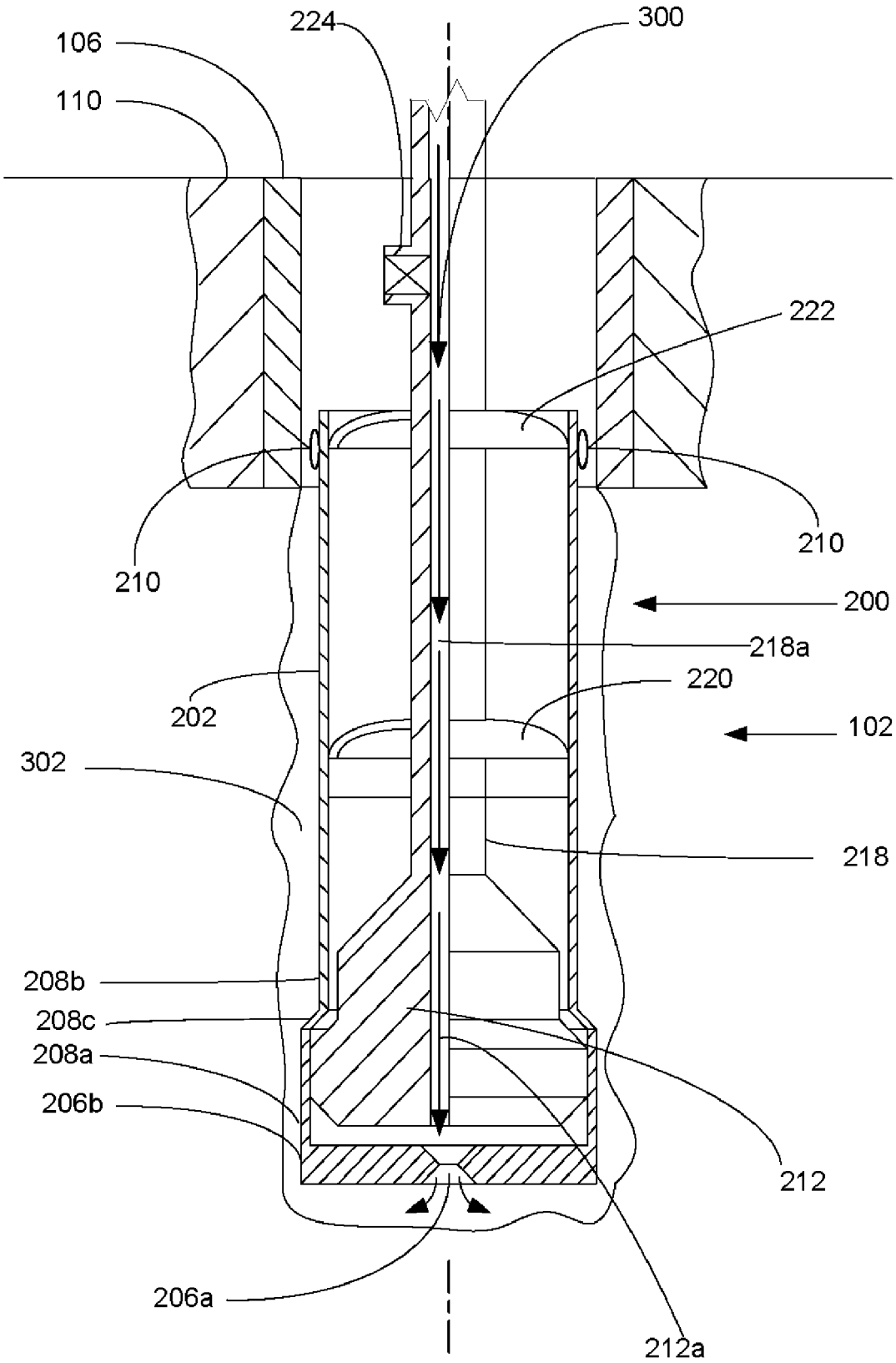
FIG. 3 is an illustration of a hardenable fluidic sealing material being pumped down the device of FIG. 2.

Referring now to FIG. 3, in an exemplary embodiment, a hardenable fluidic sealing material 300, such as, for example, cement, is then pumped down the fluid pathway 218*a* and 212*a* and out through the valveable passage 206*a* into the borehole 102 with the top fluid valve 224 in a closed position. The hardenable fluidic sealing material 300 thereby fills an annular space 302 between the borehole 102 and the outside diameter of the expandable tubular member 202.

Figure 4:
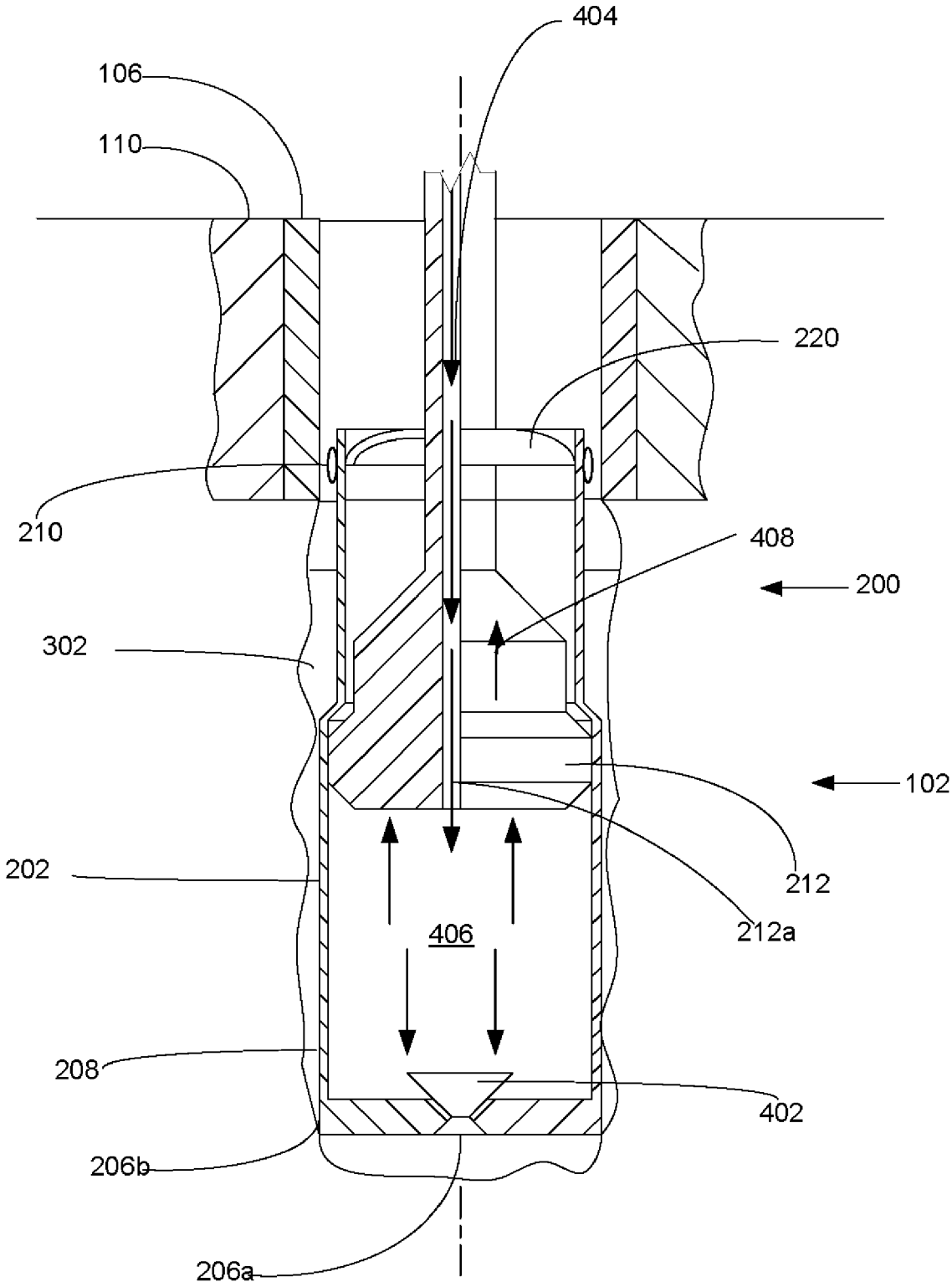
FIG. 4 is an illustration of the expansion of an expandable tubular member using the expansion device of FIG. 2.

Referring now to FIG. 4, a plug 402 is then injected with a fluidic material 404. The plug thereby fits into and closes the valveable passage 206*a* to further fluidic flow. Continued injection of the fluidic material 404 then pressurizes a chamber 406 defined by the shoe 206, the bottom of the expansion device 212, and the walls of the launcher assembly 208 and the expandable tubular member 202. Continued pressurization of the chamber 406 then displaces the expansion device 212 in an upward direction 408 relative to the expandable tubular member 202 thereby causing radial expansion and plastic deformation of the launcher assembly 208 and the expandable tubular member.

Figure 5:
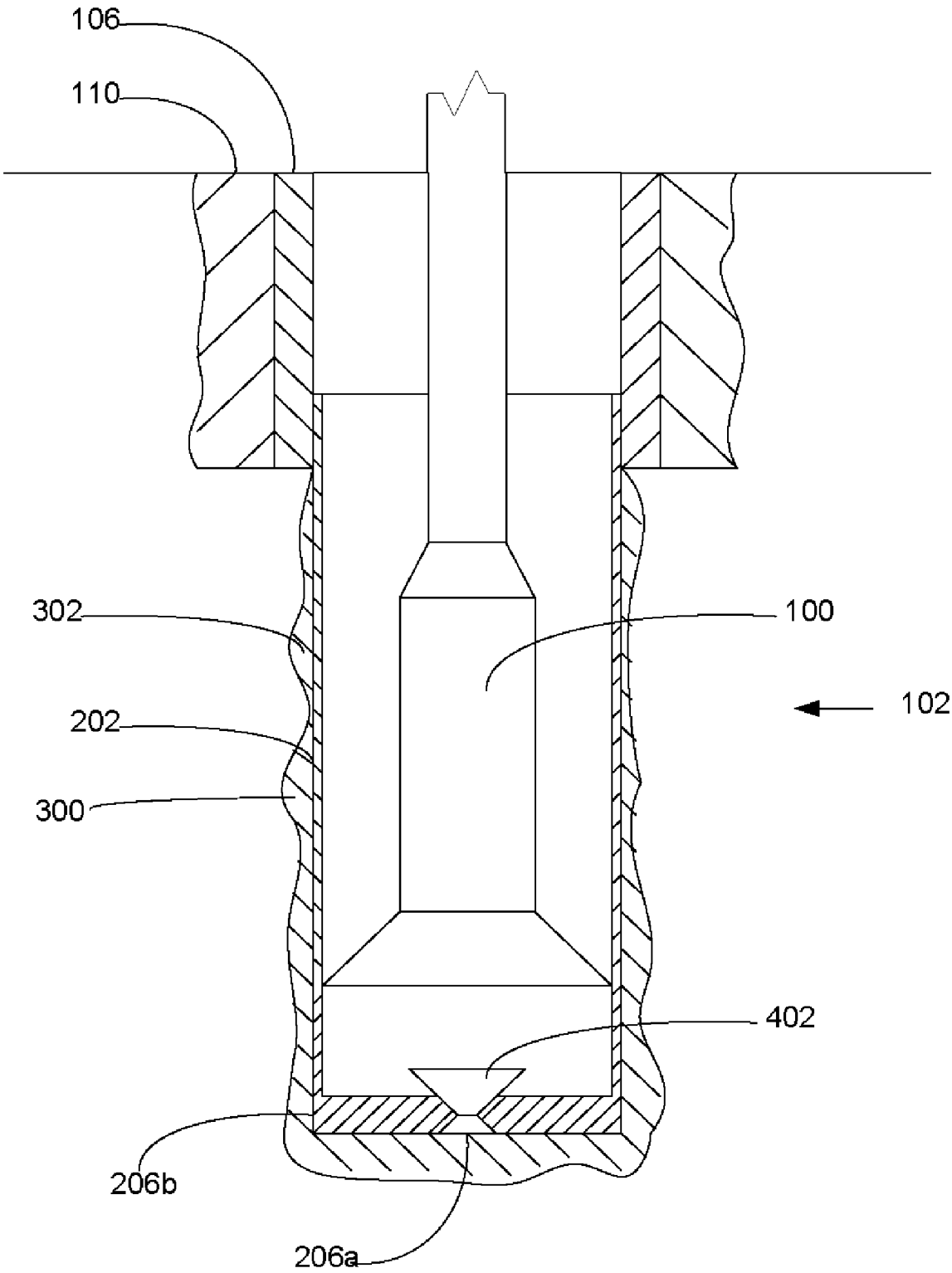
FIG. 5 is an illustration of the completion of the radial expansion and plastic deformation of an expandable tubular member.

Referring now to FIG. 5, the radial expansion and plastic deformation of the expandable tubular member 202 is then completed and the expandable tubular member is coupled to the existing casing 106. The hardenable fluidic sealing material 300, such as, for example, cement fills the annulus 302 between the expandable tubular member 202 and the borehole 102. The device 200 has been withdrawn from the borehole and a conventional device 100 for drilling the borehole 102 may then be utilized to drill out the shoe 206 and continue drilling the borehole 102, if desired.

Figure 6:
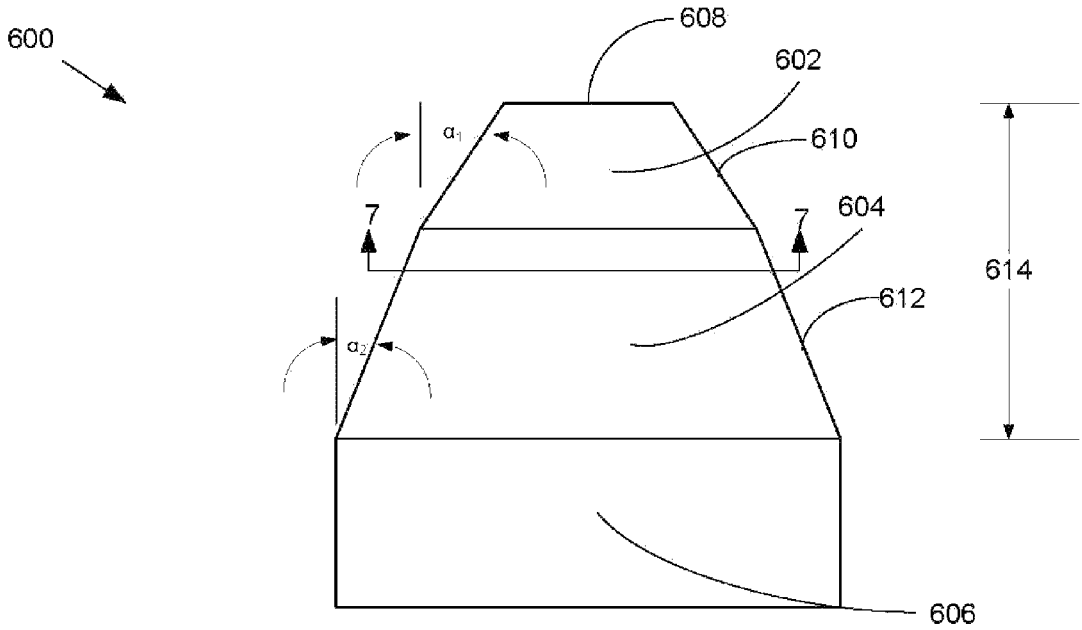
FIG. 6 is a side view of an exemplary embodiment of an expansion device of FIG. 2.
Figure 7:
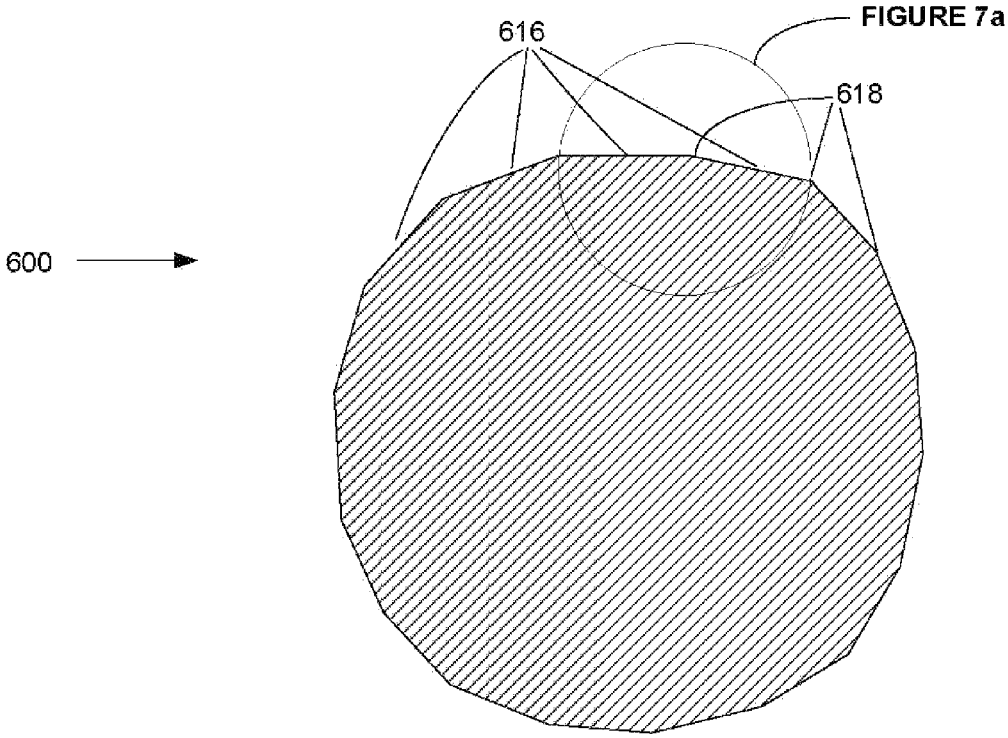
FIGS. 7 and 7*a* are cross sections of the exemplary embodiment of the expansion device of FIG. 6.
Figure 7A:
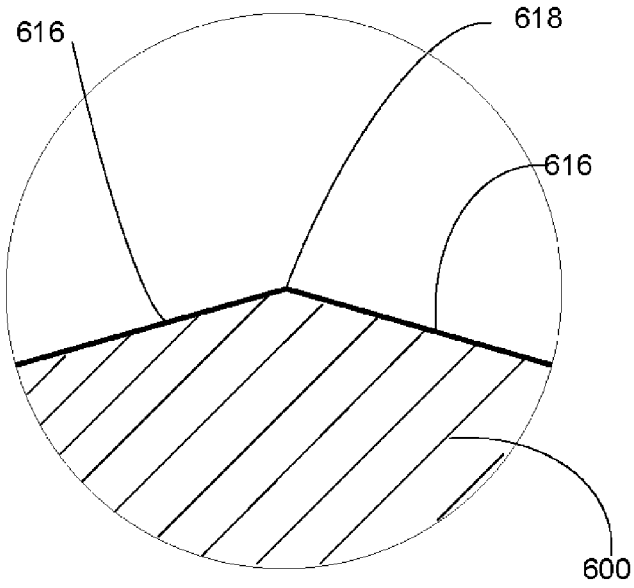

Referring now to FIGS. 6, 7 and 7*a*, an expansion cone 600 includes an upper cone 602, a middle cone 604, and a lower tubular end 606. The upper cone 602 has a leading surface 608 and an outer inclined surface 610 that defines an angle $\alpha_1$. The middle cone 604 has an outer inclined surface 612 that defines an angle $\alpha_2$. In an exemplary embodiment, the angle $\alpha_1$ is greater than the angle $\alpha_2$. The outer inclined surfaces 610 and 612 together form the expansion surfaces 614 that upon displacement of the expansion cone 600 relative to the expandable tubular member 202 radially expand and plastically deform the expandable tubular member. In an exemplary embodiment, the expansion cone 600 defines one or more outer inclined expansion faceted surfaces 616. In an exemplary embodiment, one or more contact points 618 are formed at the intersection of the one or more outer inclined expansion faceted surfaces 616.

Figure 8:
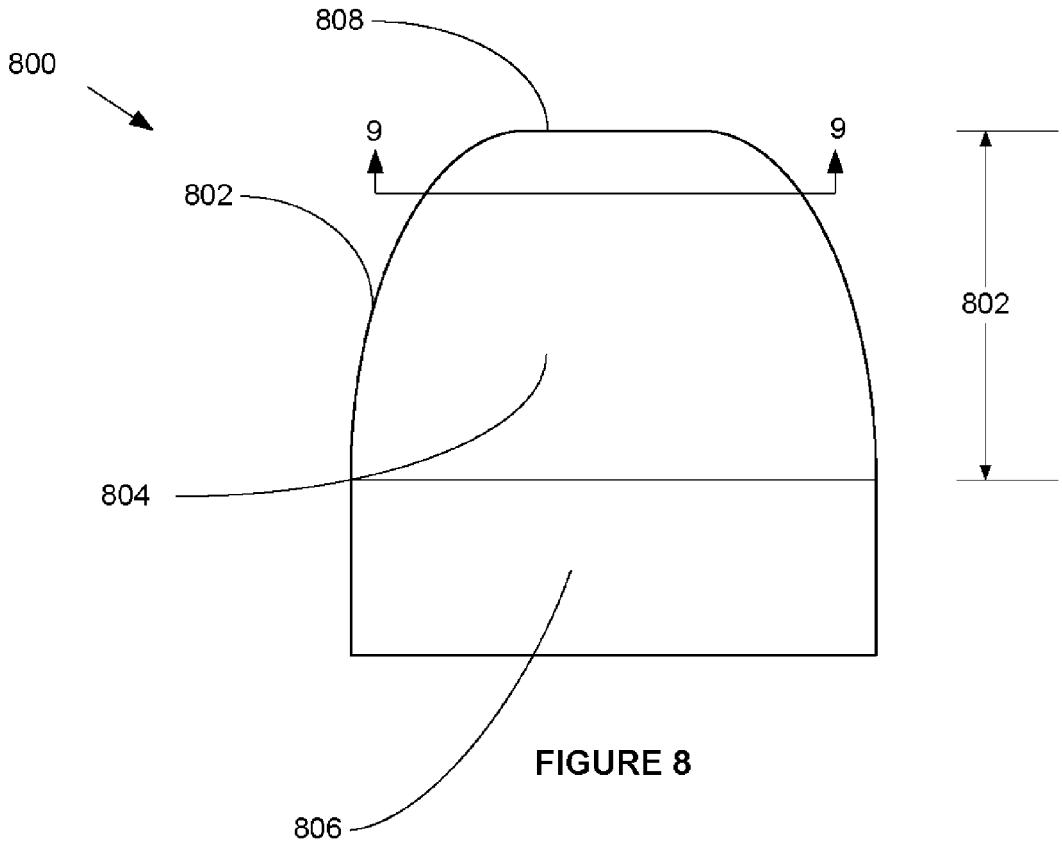
FIG. 8 is a side view of another exemplary embodiment of an expansion device of FIG. 2.
Figure 9:
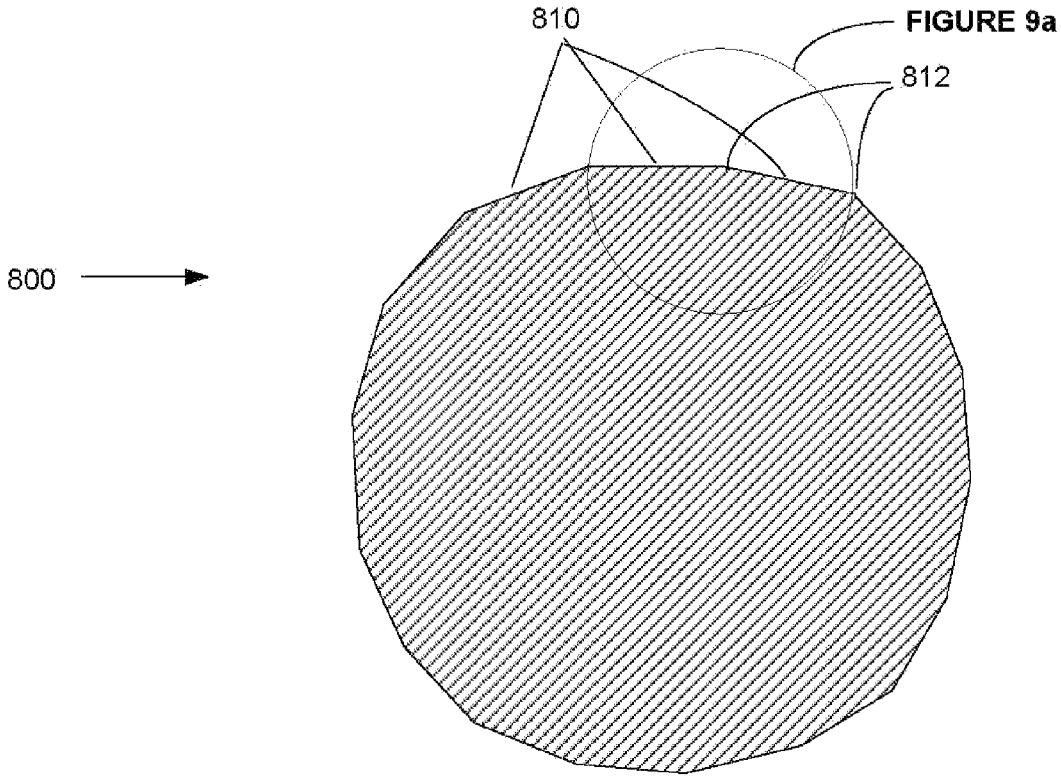
FIGS. 9 and 9*a* are cross sections of the exemplary embodiment of the expansion device of FIG. 8.
Figure 9A:
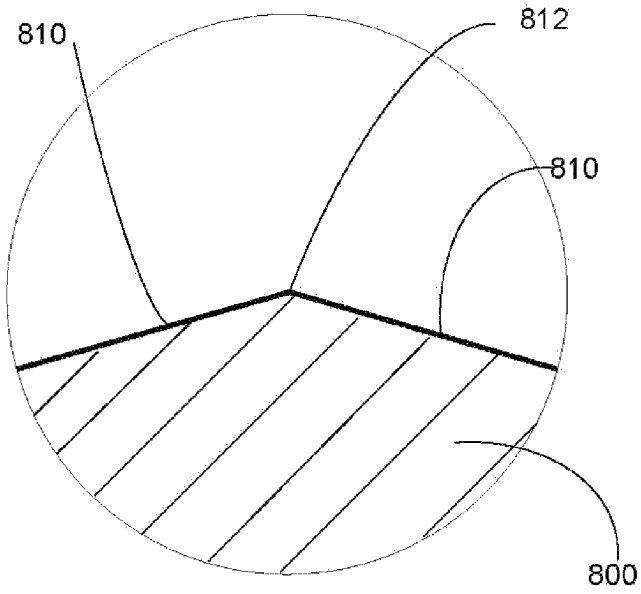

Referring now to FIGS. 8, 9 and 9*a*, an exemplary embodiment of an expansion cone 800 with an outside expansion surface 802 defining a parabolic equation, is shown. The expansion cone 800 has an upper expansion section 804 and a lower tubular end 806. The upper expansion section 804 has a leading surface 808 and the outside expansion surface 802 is defined by a parabolic equation. In an exemplary embodiment, the expansion cone 800 defines one or more outer inclined expansion faceted surfaces 810. In an exemplary embodiment, one or more contact points 812 are formed at the intersection of the outer inclined expansion faceted surfaces 810.

In an exemplary embodiment, the expansion device 212 consists of one or more of the expansion devices 600 and 800.

Figure 10:
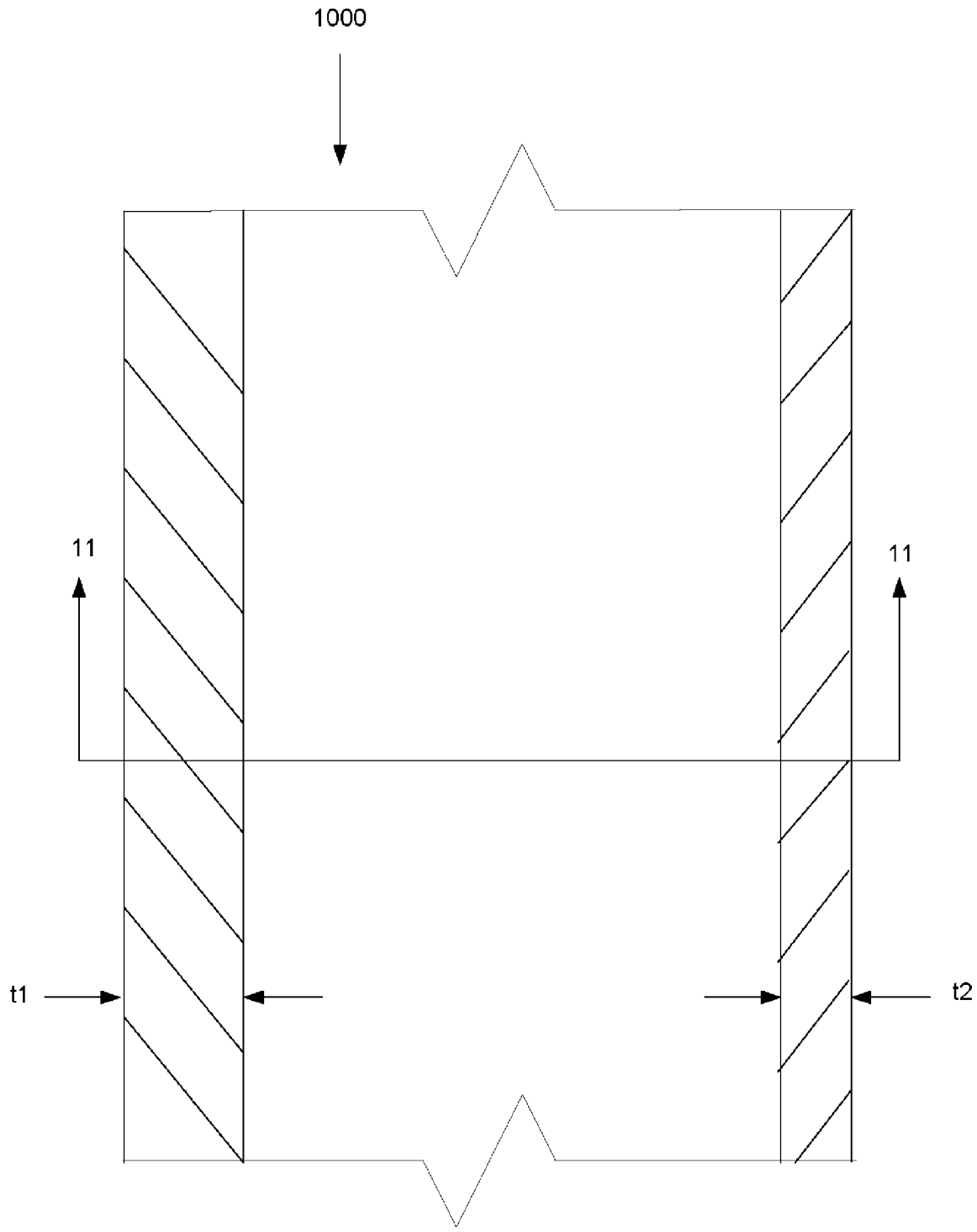
FIG. 10 is a longitudinal cross section of a seamless expandable tubular member.
Figure 11:
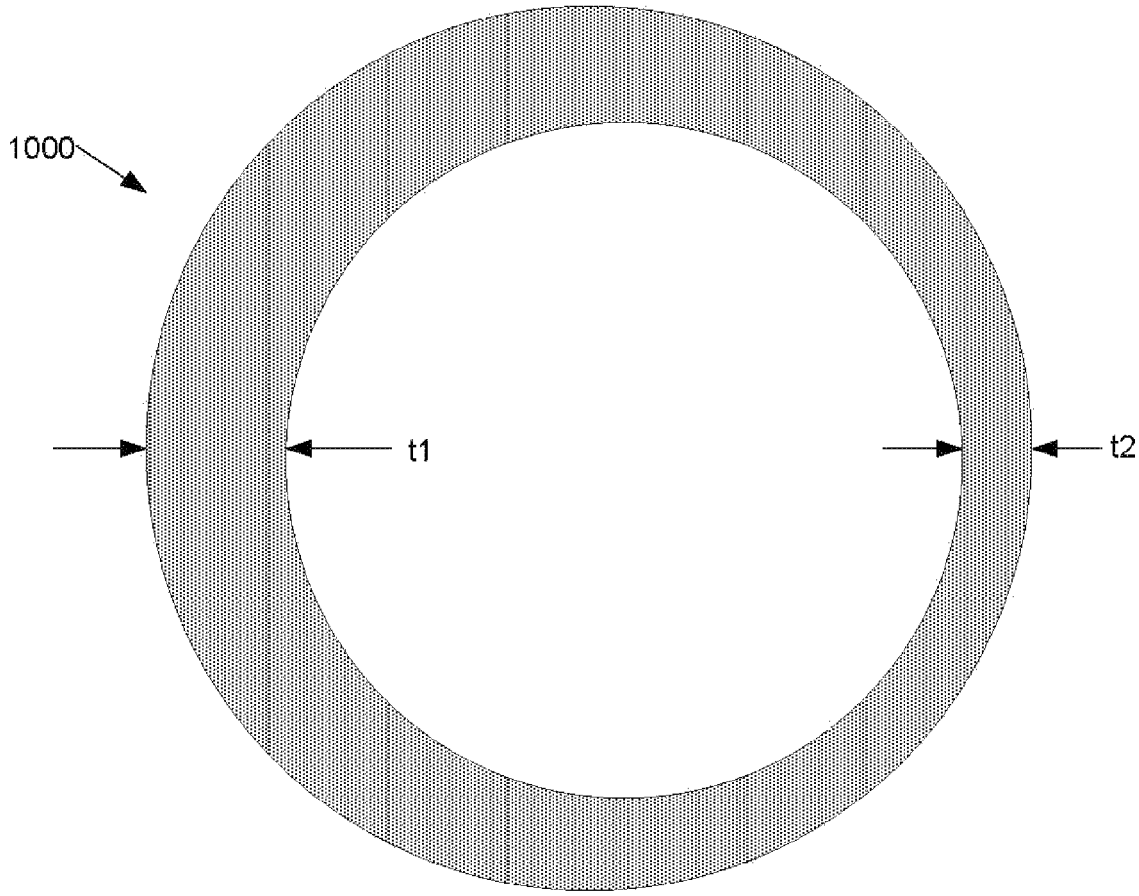
FIG. 11 is a radial cross section of the seamless expandable tubular member of FIG. 10.

Referring now to FIGS. 10 and 11, an exemplary embodiment of a seamless expandable tubular member 1000 is shown. The seamless expandable tubular member 1000 includes a wall thickness $t_1$ and $t_2$ where $t_1$ is not equal to $t_2$. In an exemplary embodiment, the seamless expandable tubular member 1000 has a non-uniform wall thickness.

In an exemplary embodiment, the expandable tubular member 202 consists of one or more of the seamless expandable tubular members 1000.

Figure 12:
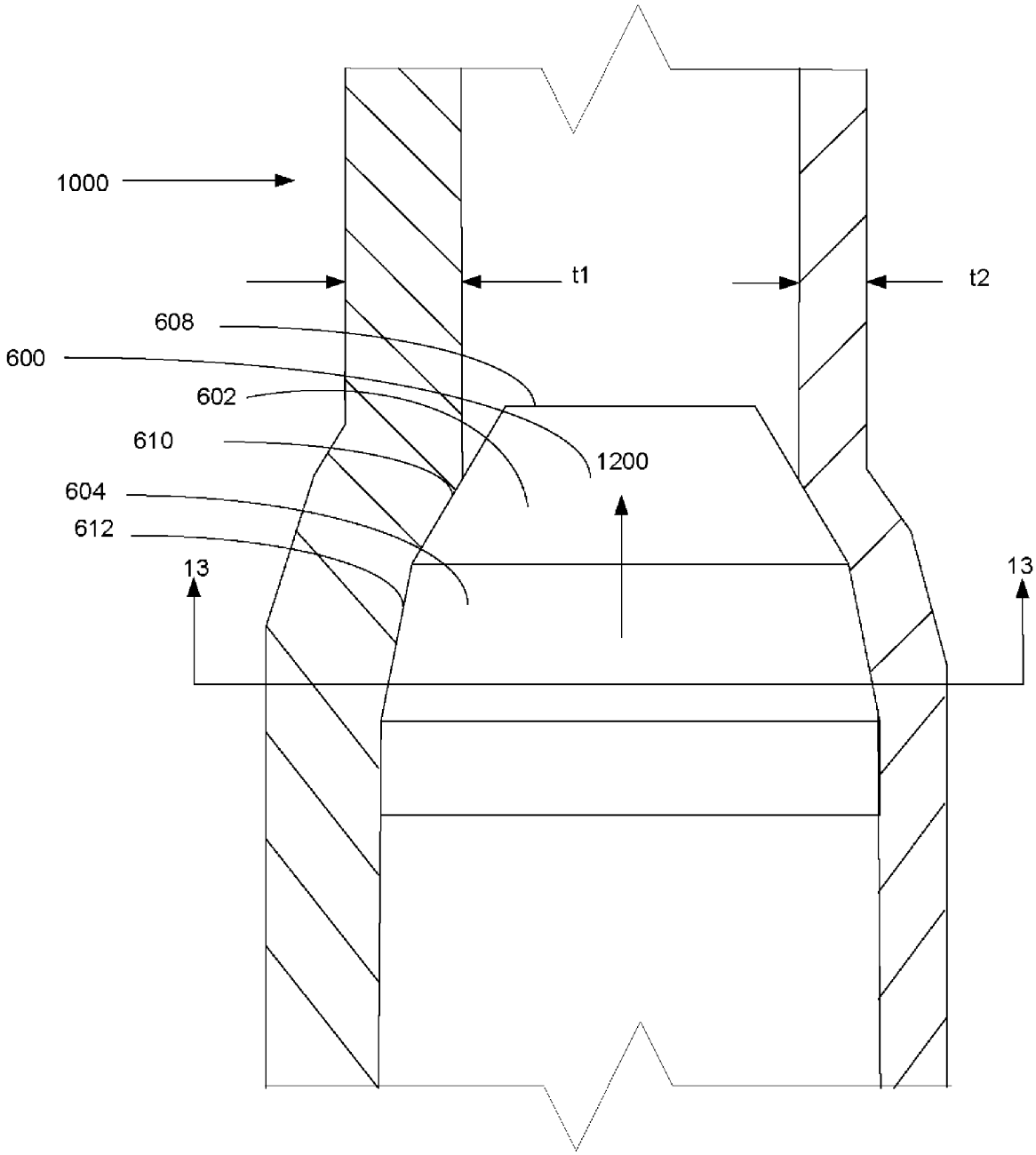
FIG. 12 is an illustration of the expansion of the seamless expandable tubular member of FIG. 10 using the expansion device of FIG. 6.
Figure 13:
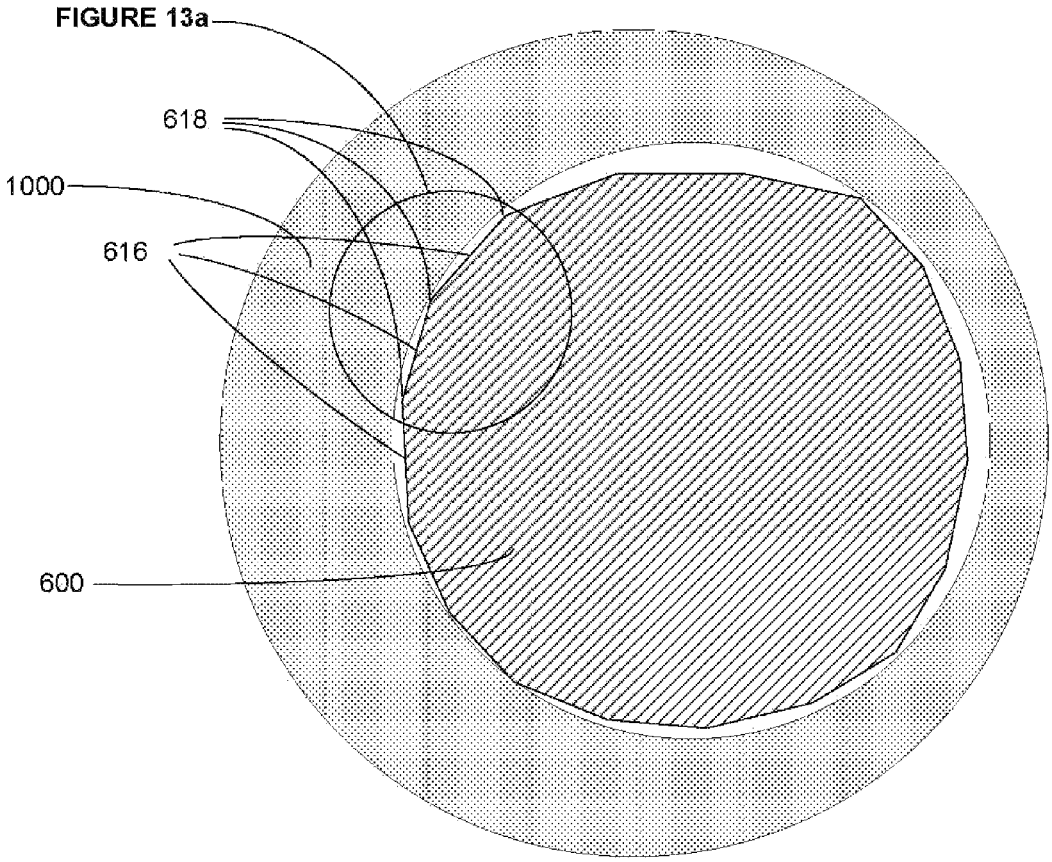
FIGS. 13 and 13*a* are top views of the expansion of the seamless expandable tubular member as shown in FIG. 12.
Figure 13A:
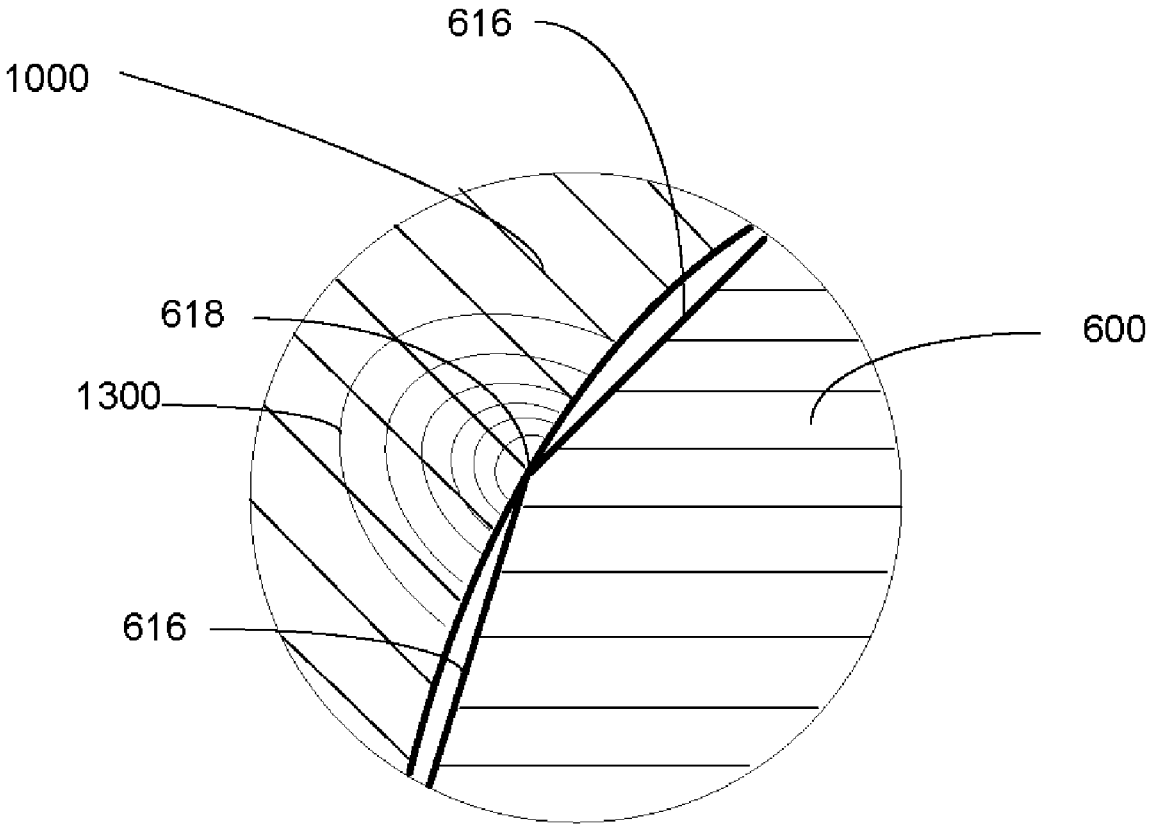

Referring now to FIGS. 12, 13 and 13*a*, in an exemplary embodiment the expansion cone 600 is displaced by a conventional expansion device, such as, for example, the expansion devices commercially available from Baker Hughes Inc., Enventure Global Technology, or Weatherford International, in an upward direction 1200 relative to the seamless expandable tubular member 1000 thereby causing radial expansion and plastic deformation of the seamless expandable tubular member. In an exemplary embodiment, stress concentrations 1300 are formed within the seamless expandable tubular member 1000 where the contact point 618 of the expansion cone 600 is displaced into the seamless expandable tubular member.

The use of seamless expandable tubular members, such as, for example the seamless expandable tubular member 100, with a variable wall thickness may require higher expansion forces when the expansion device encounters areas of increased wall thickness. An expansion device may take the path of least resistance when the expansion device encounters an area of increased wall thickness $t_1$ and over-expand the corresponding area of thin wall thickness $t_2$ of the seamless expandable tubular member in comparison to the thicker wall section $t_1$. The use of a faceted expansion cone, such as, for example, the expansion cone 600 creates areas of stress concentrations in the seamless expandable tubular member, which may assist in maintaining a proportional wall thickness during the radial expansion and plastic deformation process. In addition, the use of a faceted expansion cone, such as, for example, the expansion cone 600 creates areas of stress concentrations in the seamless expandable tubular member, which may result in reduced expansion and initiation forces.

Figure 14:
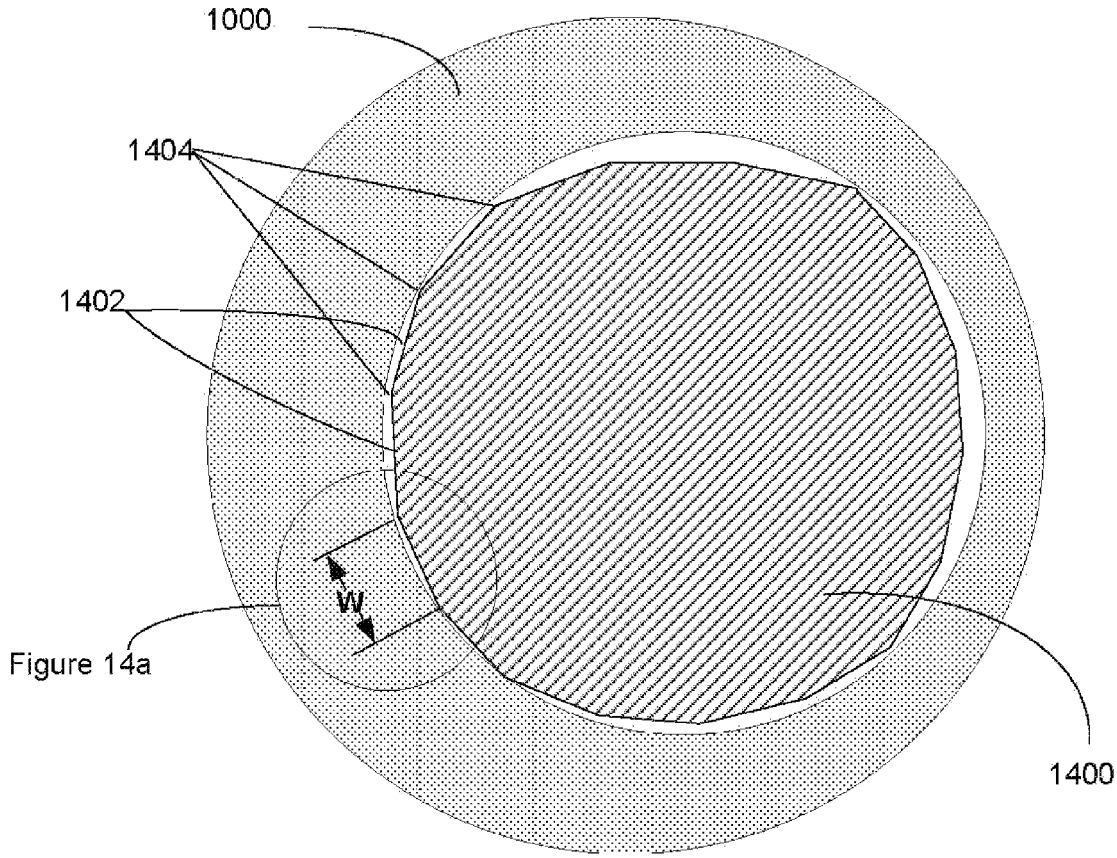
FIGS. 14 and 14*a* are the top views of another embodiment of the expansion of the seamless expandable tubular member of FIG. 10 using an expansion device.
Figure 14A:
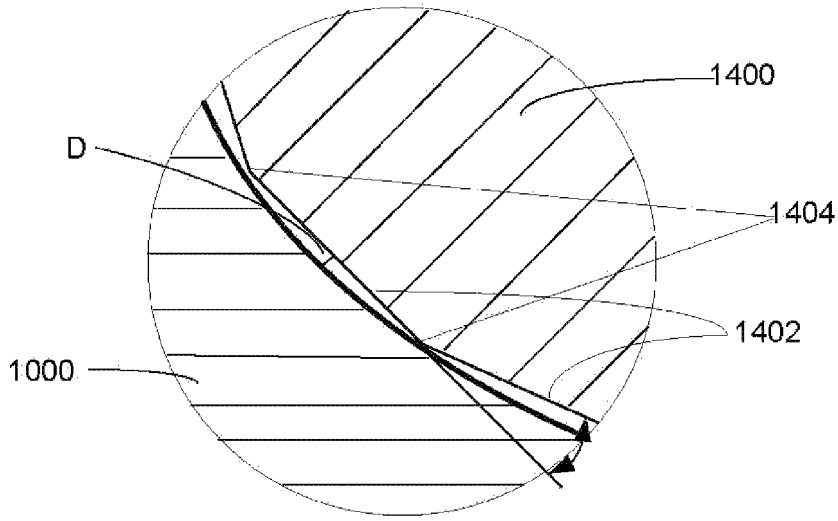

Referring to FIGS. 14 and 14*a*, in an exemplary embodiment, an expansion cone 1400 includes a plurality of outer inclined expansion faceted surfaces 1402, having corresponding widths (W), that intersect to form contact points 1404. Several factors may be considered when determining the appropriate number of outer inclined expansion faceted surfaces 1402, such as, for example, the coefficient of friction between the expansion cone and the expandable tubular member 1000, pipe quality, and data from lubrication tests. In an exemplary embodiment, for an expandable tubular member with uniform thickness, the number of circumferential spaced apart contact points may be infinity. In an exemplary experimental embodiment, the dimensions of the final design of an expansion cone may ultimately be refined by performing an empirical study.

In an exemplary embodiment, the following equations may be used to make a preliminary calculation of the optimum number of outer inclined expansion faceted surfaces 1402 on an expansion cone 1400 for expanding an expandable tubular member 1000:

$$R=(D_1+D_{exp})/2; \quad (1)$$

$$\mathrm{Sin}(\alpha/2)=1-(H/R); \text{ and} \quad (2)$$

$$N=360°/\alpha; \quad (3)$$

where, $D_1$=Original tubular member inside diameter;

$D_{exp}$=Expanded tubular member inside diameter;

H=Gap between gap surface and tubular member inside diameter;

R=Radius of polygon at midpoint of expansion cone;

$\alpha$=Angle between circumferential spaced apart contact points of polygon; and N=Number of polygon flat surfaces.

In an exemplary embodiment, expandable tubular member 1000 has an original inside diameter of 4.77" that is expanded to an inside diameter of 5.68" utilizing an expansion cone 1400. In an exemplary embodiment, there is a lubricant gap depth of 0.06". The optimum number of outer inclined expansion faceted surfaces 1402 is determined as follows:

$$R=(D_1+D_{exp})/2=(4.77-5.68)/2=0.42;$$

$$\mathrm{Sin}(\alpha/2)=1-(H/R)=1-(0.06/42);$$

$$\alpha/2=12.3°;$$

$$\alpha=24.6°;$$

$$N=360°/\alpha=360°/24.6°=15;$$

Accordingly, the theoretical number (N) of outer inclined expansion faceted surfaces 1402, on an expansion cone 1400 having a tapered faceted polygonal outer expansion surface is 15, but the actual number that may result from an empirical analysis may depend on tubular member quality, coefficient of friction, and data from lubrication tests. In an exemplary embodiment, a range for the actual number (N) of outer inclined expansion faceted surfaces 1402 necessary to expand an expandable tubular member having an original inside diameter of 4.77" to an inside diameter of 5.68" may range from 12 to 15.

Figure 15A:
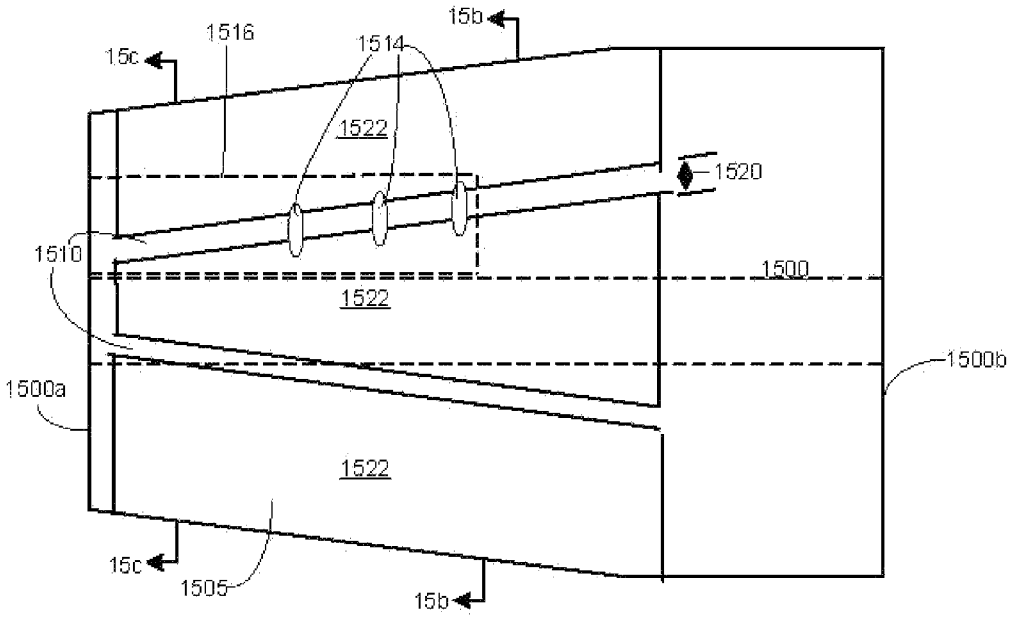
FIG. 15*a* is a side view of another embodiment of an expansion device.
Figure 15B:
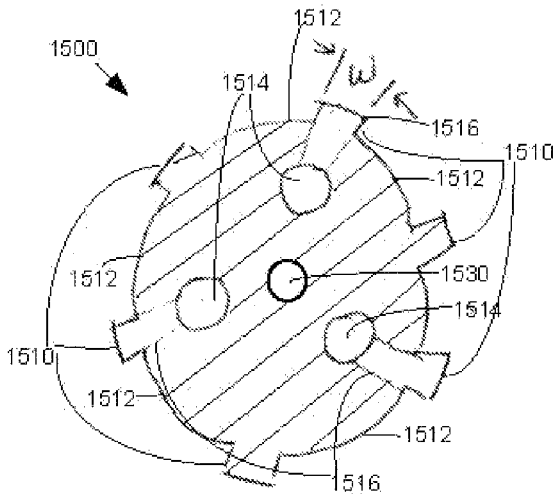
FIGS. 15*b* and 15*c* are cross sectional views of the expansion device of FIG. 15*a*.
Figure 15C:
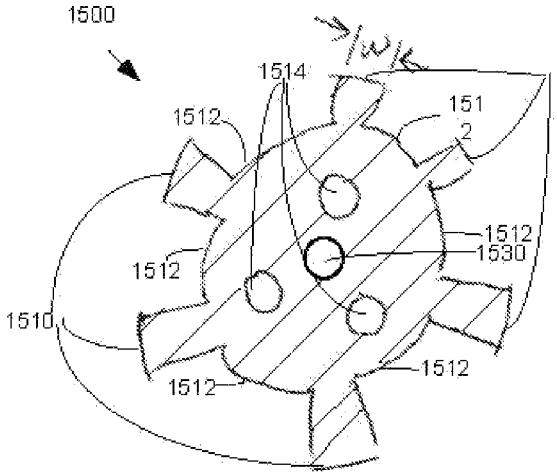

Referring to FIGS. 15*a*, 15*b* and 15*c*, in an exemplary embodiment, expansion cone 1500 includes tapered faceted polygonal outer expansion surfaces 1510, a front end 1500*a*, a rear end 1500*b*, recesses 1512, internal passage 1530 for drilling fluid, internal passages 1514 for lubricating fluids, and radial passageways 1516. The width 1520 of tapered faceted polygonal outer expansion surfaces 1510 of expansion cone 1500 may be constant for the length of the cone, resulting in trapezoidal shaped lubricant gap 1522 between each contact surface 1510. The following equations may be used for calculating the width (W) 1520 of the contact surface:

$$W=[2R\sin(\alpha/2)]/K; \quad (4)$$

$$R=(D1+D2)/4; \quad (5)$$

$$\alpha=360\text{ degrees}/N; \quad (6)$$

where:

W=Width of contact point;

D1=initial tubular member diameter;

D2=expanded diameter;

N=Number of polygon flat surfaces; and

K=System friction coefficient that must be determined.

In an exemplary embodiment, K is between 3 to 5 for an expandable tubular member having an original inside diameter of 4.77" and an expanded inside diameter of 5.68". N may range from 12 to 15. In an exemplary embodiment, K is 4.2.

Figure 16A:
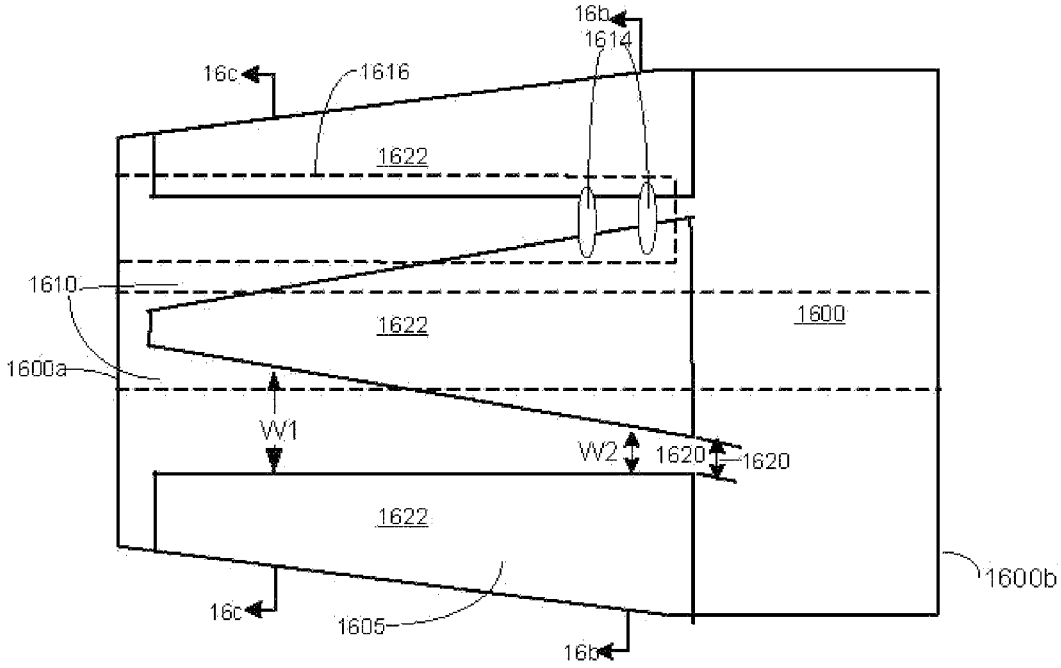
FIG. 16*a* is a side view of another embodiment of an expansion device.
Figure 16B:
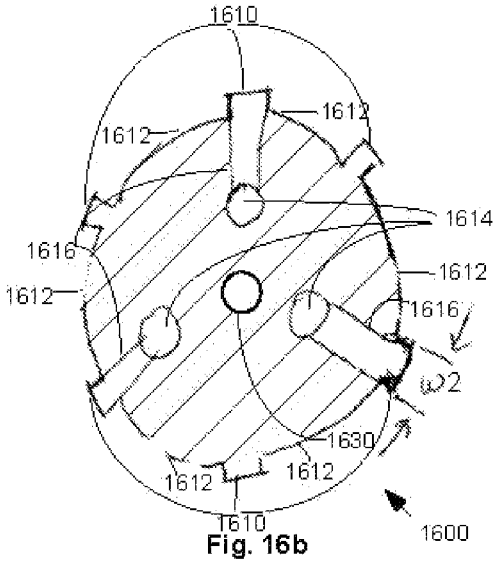
FIGS. 16*b* and 16*c* are cross sectional views of the expansion device of FIG. 16*a*.
Figure 16C:
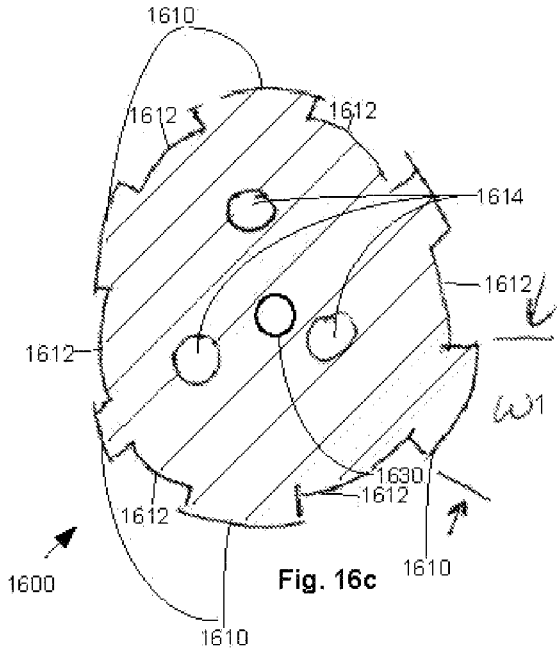

Referring now to FIGS. 16*a*, 16*b* and 16*c*, in an exemplary embodiment, expansion cone 1600 has a tapered faceted polygonal outer expansion surface 1610, a front end 1600*a*, a rear end 1600*b*, recesses 1612, internal passage 1630 for drilling fluid, internal passages 1614 for lubricating fluids, and radial passageways 1616. The width 1620 of tapered faceted polygonal outer expansion surfaces 1610 of expansion cone 1600 may vary the length of the cone. In an exemplary embodiment, width 1620 of tapered faceted polygonal outer expansion surfaces 1610 may be larger at the front end W1 and become smaller toward the rear end W2.

In several exemplary embodiments, the tapered faceted polygonal outer expansion surface of an expansion cone may be implemented in any expansion cone, including one or more of expansion cones 600, 800, 1404, 1500, and 1600. Furthermore, it may be implemented in any expansion device including one or more expansion surfaces.

The optimum taper angle θ of the tapered portion of each expansion cone, including the tapered portions in expansion cones 600, 800, 1400, 1500, and 1600, may be dependant on the amount of friction between the tapered portion of the expansion cone and the inside diameter of the tubular member. In an exemplary experimental embodiment, a cone angle of 8.5° to 12.5° was shown to be sufficient to expand an expandable tubular member having an original inside diameter of 4.77" to an inside diameter of 5.68". The optimum taper angle θ may be determined after testing the lubricant system to determine the exact coefficient of friction. A cone angle greater than 10° may be required to minimize the effect of thinning the tubular member wall during expansion and may potentially reduce failures related to collapsing.

Figure 17A:
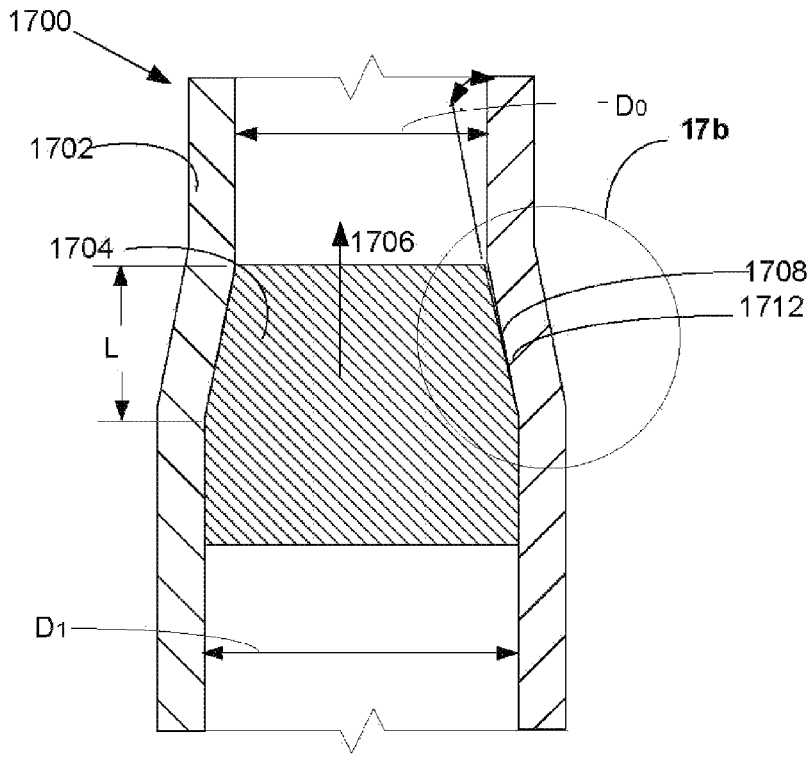
FIGS. 17*a* and 17*b* are illustrations of a computer model of a tapered expansion device and an expandable tubular member.
Figure 17B:
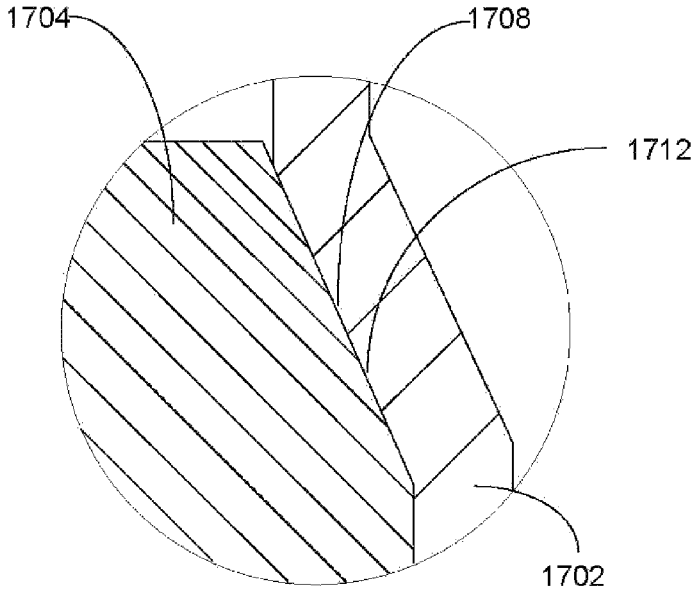

Referring to FIGS. 17*a* and 17*b*, in an exemplary experimental embodiment 1700, using finite element analysis ("FEA"), the radial expansion and plastic deformation of an expandable tubular member 1702 by a tapered expansion device 1704 displaced in direction 1706 relative to the expandable tubular member, was modeled using commercially available FEA software DEFORM-2D in order to predict the actual performance of a corresponding actual tapered expansion device during the radial expansion and plastic deformation of an actual expandable tubular member. The FEA optimized the taper angle θ of the tapered expansion device 1704 for minimum expansion forces. The tapered expansion device surface 1708 of the tapered expansion device 1704 has a length L. The tapered expansion device 1704 has an initial diameter $D_0$ and a final diameter $D_1$. Since the initial diameter $D_0$ and the final diameter $D_1$ are fixed in the tapered expansion device 1704, any increase in the taper angle θ would result in an increase in the length L of the expansion surface 1708.

Figure 17C:
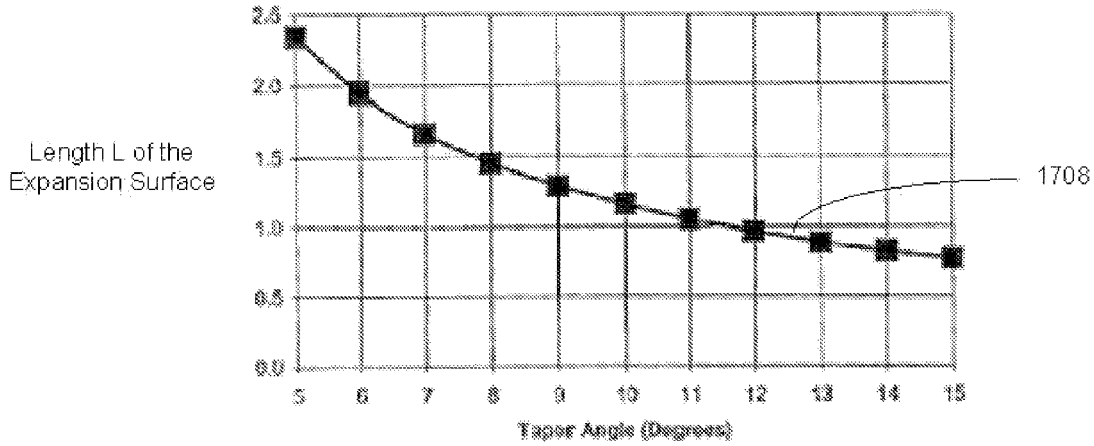
FIG. 17*c* is an illustration of experimental data for the length of the tapered expansion device surface versus the taper angle of the expansion device for the computer model of FIGS. 17*a* and 17*b*.

Referring to FIG. 17*c*, in the exemplary experimental embodiment 1700 using FEA, the length L of the expansion surface 1708 versus the taper angle θ is shown. The length L of the expansion surface 1708 increases as the taper angle θ decreases.

Figure 17D:
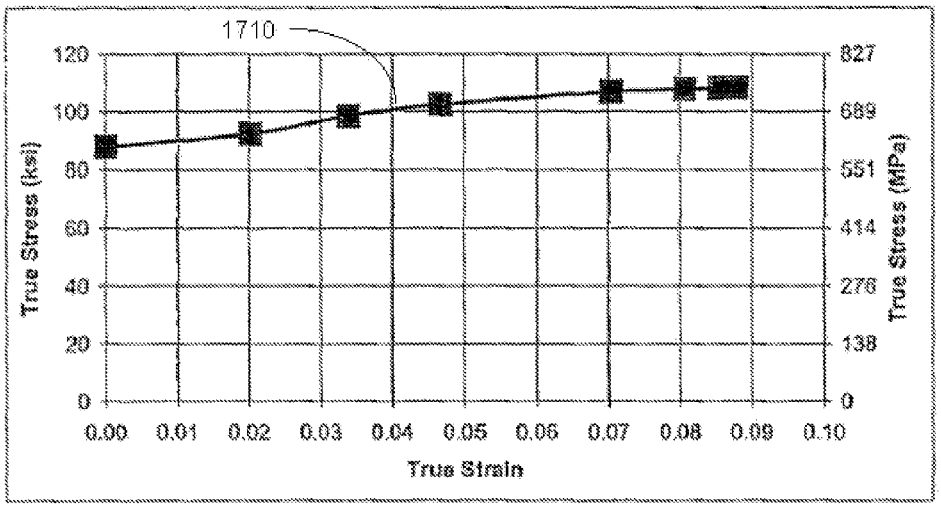
FIG. 17*d* is an illustration of the true stress-strain curve for the expandable tubular member in the computer model of FIGS. 17*a* and 17*b*.

Referring to FIG. 17*d*, in the exemplary experimental embodiment 1700 using FEA, a true stress-strain curve 1710 for the expandable tubular member 1702 with a modulus of elasticity of $E=30\times10^6$ psi and a Poisson's ratio of 0.3, is provided. In the FEA, the expansion device 1704 was modeled as rigid body while the expandable tubular member 1702 was modeled as an elastic-plastic object.

In an exemplar embodiment, friction conditions at the interface 1712 between the expansion device 1704 and the expandable tubular member 1702 influence metal flow and stresses acting on the expansion device. Interface friction conditions may be expressed quantitatively in terms of a factor or coefficients. The friction shear stress, $f_s$, may be expressed using Coulomb or shear friction. If Coulomb friction is assumed, the friction shear stress takes the following form $$f_s=up \quad (7)$$

p being a compressive normal stress at the interface and u being the coefficient of friction. However, if shear friction is assumed, the friction shear stress takes the form of $$f_s = mk = \frac{m}{\sqrt{3}}\bar{\sigma} \quad (8)$$

k being the instantaneous shear strength of the material and m being the friction shear factor, $0 \leqq m \leqq 1$. The instantaneous shear strength can be expressed as a function of instantaneous yield strength, δ, assuming the material obeys a von Mises yield criterion.

When contact pressures at the interface 1712 become large, the shear stress predicted by Coulomb friction can exceed the shear strength of the material. Therefore, shear friction should be used to model the interface friction conditions for operations that produce high contact stresses. Since there is potential for large contact stress in the radial expansion and plastic deformation of the expandable tubular member 1702 by the expansion device 1704, the shear friction model was used in all experimental embodiments.

Figure 18:
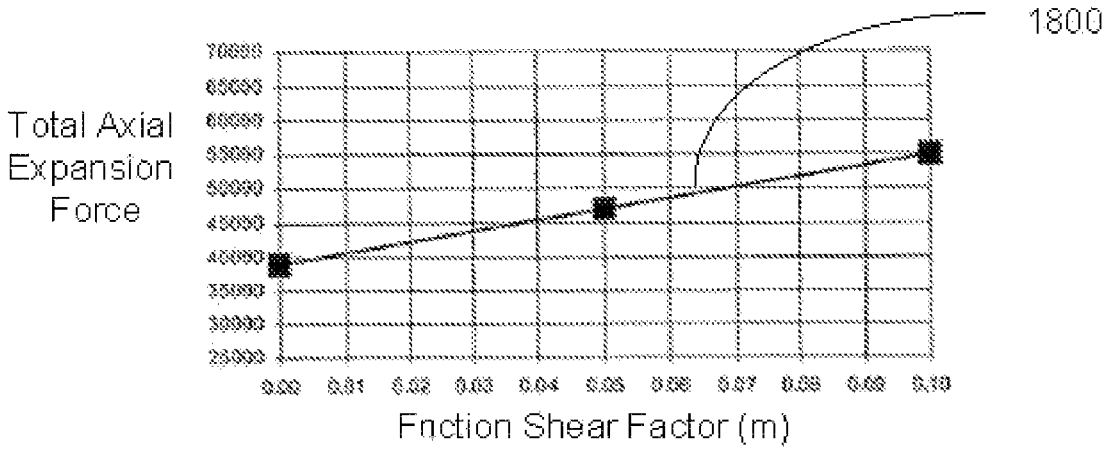
FIG. 18 is an illustration of the total axial expansion force versus the friction shear factor for the computer model of FIGS. 17*a* and 17*b*.

Referring to FIG. 18, in the exemplary experimental embodiment 1700 using FEA, a total axial expansion force curve 1800 shows axial expansion force as a function of the friction shear factor (m) for a given tapered expansion device surface 1708 angle of 10°. The total axial expansion force curve 1800 increases with increasing friction shear factor (m). In an exemplary embodiment, in cold forming of steels with lubrication, the friction shear factor (m) falls in the range $0.05 \leqq m \leqq 0.15$.

In an exemplary embodiment, the actual work $w_a$ required to cause radial expansion and plastic deformation of the expandable tubular member 1702 is comprised of three components, a) ideal work $w_i$, b) frictional work $w_f$ and c) redundant work $w_r$. The actual work $w_a$ required to cause deformation is the sum of the three components, $w_a=w_i+w_f+w_r$. Ideal work $w_i$, is the work required for homogeneous deformation, which exists only when plane sections remain plane during the deformation. Frictional work $w_f$, is consumed at the interface between the deforming metal and the tool faces that constrain the metal. Redundant work $w_r$, is due to internal shearing and bending that causes distortion of plane sections as they pass through the deformation zone, which increases the strain in the deforming metal.

Figure 19:
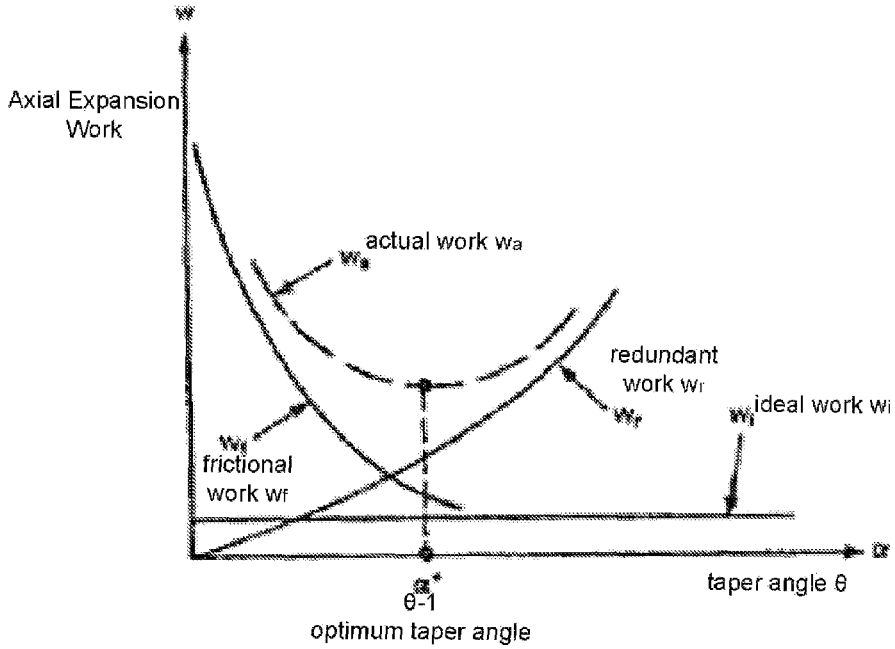
FIG. 19 is an illustration of the influence of the taper angle of an expansion device on the ideal work, frictional work, and redundant work, during the expansion of the expandable tubular member of the computer model of FIGS. 17*a* and 17*b*.

Referring to FIG. 19, in the exemplary experimental embodiment 1700 using FEA, the influence of the taper angle θ of the tapered expansion device surface 1708 on the actual work $w_a$, ideal work $w_i$, frictional work $w_f$, and redundant work $w_r$ is shown. The actual work $w_a$ is the sum of the frictional work $w_f$, the redundant work $w_r$, and the ideal work $w_i$. The ideal work $w_i$ remains constant and does not depend on the taper angle θ of the tapered expansion device surface 1708. However, the frictional work $w_f$ and redundant work $w_r$ largely depend on the taper angle θ of the tapered expansion device surface 1708. The frictional work $w_f$ increases with decreasing taper angle θ of the tapered expansion device surface 1708, while the redundant work $w_r$ increases with increasing taper angle θ of the tapered expansion device surface. The actual work $w_a$ is minimized, thereby minimizing the required total axial expansion force, at the low point θ−1 on the actual work $w_a$ curve. The low point θ−1 on the actual work $w_a$ curve thereby determines the optimum taper angle θ of the tapered expansion device surface 1708.

Figure 20:
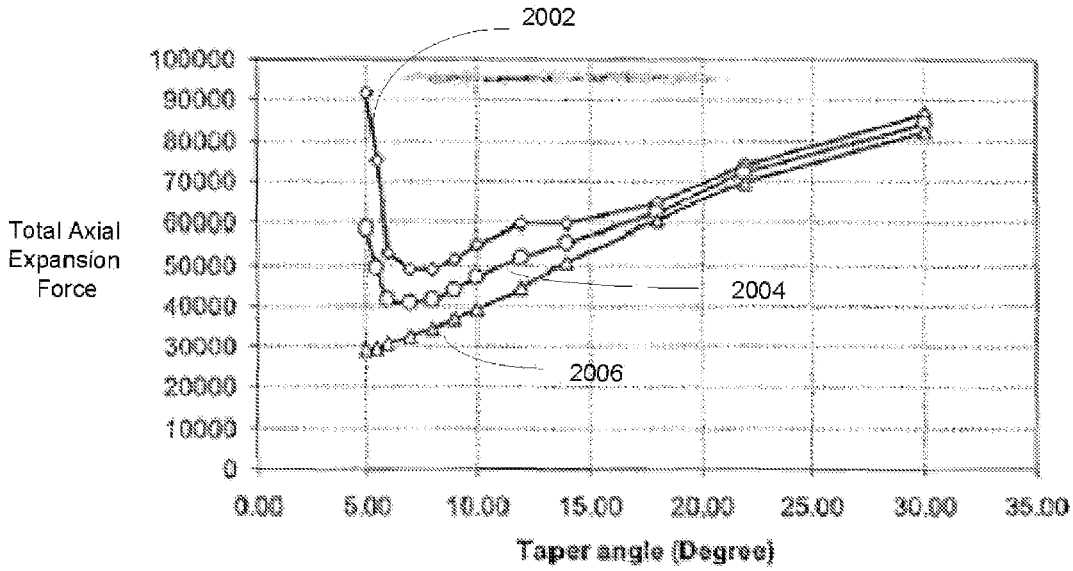
FIG. 20 is an illustration of the total axial expansion force versus the taper angle of an expansion device, during the expansion of the expandable tubular member of the computer model of FIGS. 17*a* and 17*b*.

Referring to FIG. 20, in the exemplary experimental embodiment 1700 using FEA, total axial expansion force curves 2002, 2004, and 2006 are shown as a function of taper angle θ for three different friction shear factors (m), is shown. Axial expansion force curve 2002 has a friction shear factor of m=0.10 and a minimum axial expansion force at a taper angle of 8°. Axial expansion force curve 2004 has a friction shear factor of m=0.05 and a minimum axial expansion force at a taper angle of 7°. Axial expansion force curve 2006 has a friction shear factor of m=0.0 and a minimum axial expansion force at a taper angle of 5°.

Figure 21:
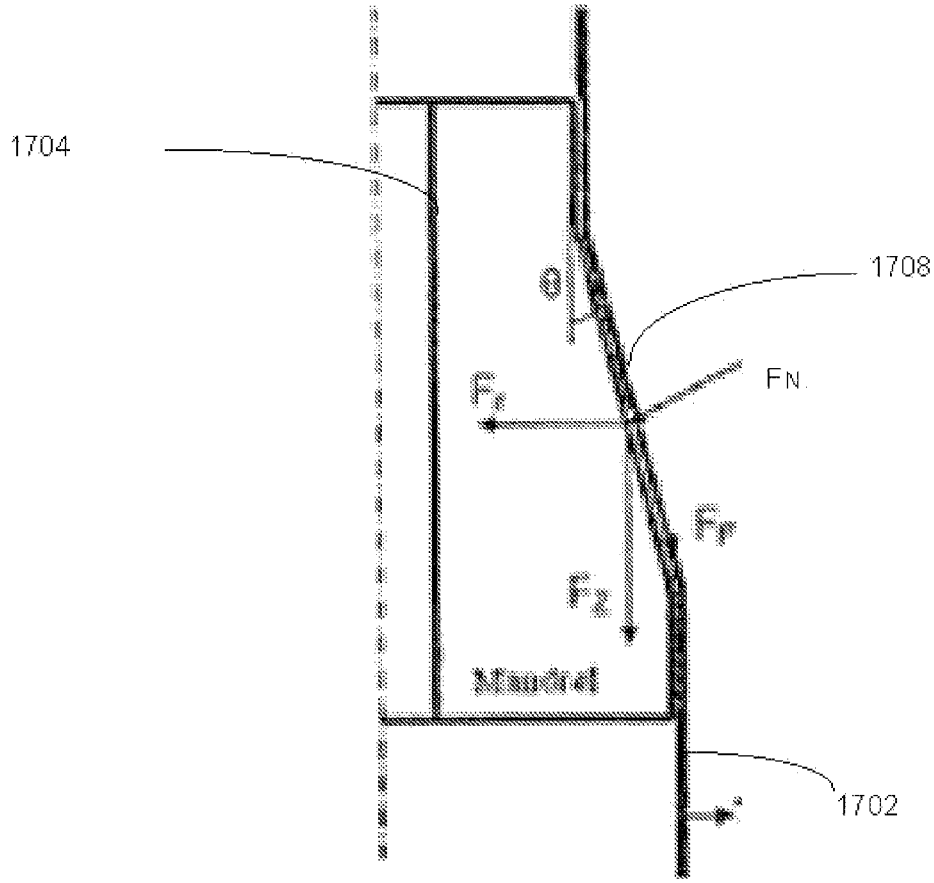
FIG. 21 is an illustration of a free body diagram of various forces acting on the tapered expansion device of the computer model of FIGS. 17*a* and 17*b*.

Referring to FIG. 21, in the exemplary experimental embodiment 1700 using FEA, a free-body diagram 2100 illustrates the forces acting on the tapered expansion device 1704 including the force required to deform the expandable tubular member 1702 $F_N$, the axial force component $F_z$, the radial force component $F_r$, and the friction force $F_f$. The following equations explain the forces acting on the tapered expansion device 1704:

$$F_r=F_N\cos(\theta)-F_f\sin(\theta) \text{ and} \tag{9}$$

$$F_z=F_N\sin(\theta)+F_f\cos(\theta); \tag{10}$$

where $F_N$=Normal force during deformation $F_f$=Frictional Force $F_r$=Radial force acting on the tapered expansion device 1704

$F_z$=Axial force acting on the tapered expansion device 1704

The axial force component $F_z$ increases with increase in the taper angle θ of the tapered expansion device surface 1708, while the contribution from friction force $F_f$ to the axial force component decreases with increase in the taper angle θ of the tapered expansion device surface 1708. This is because, with increase in taper angle θ, the cos(θ) term decreases while the sin(θ) term increase. In an exemplary embodiment, however, the initial increase in the axial force for small taper angles in the presence of friction is due to the contribution from the friction force because for smaller angles the cos(θ) is approximately one, while the sin(θ) term is negligible.

Figure 22:
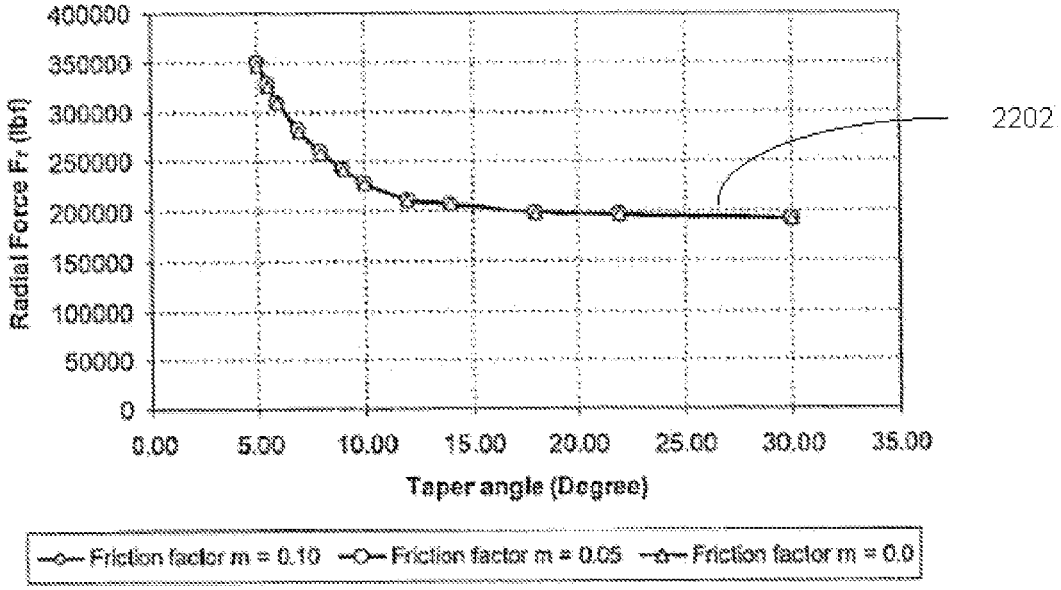
FIG. 22 is an illustration of the influence of the taper angle on the radial force acting on the expansion device of the computer model of FIGS. 17*a* and 17*b*.

Referring to FIG. 22, in the exemplary experimental embodiment 1700 using FEA, radial reaction force curve 2202 shows the radial reaction force $F_r$ on the expansion device 1704 as a function of taper angle θ and friction shear factor (m). In an exemplary embodiment, the radial reaction force $F_r$ decreases with increase in the taper angle θ, and the radial reaction force $F_r$ was independent of the friction shear factor (m). The radial reaction force curve 2202 was approximately linear for taper angles of 15 degrees or greater, and non-linear for taper angles less than 15 degrees.

Figure 23:
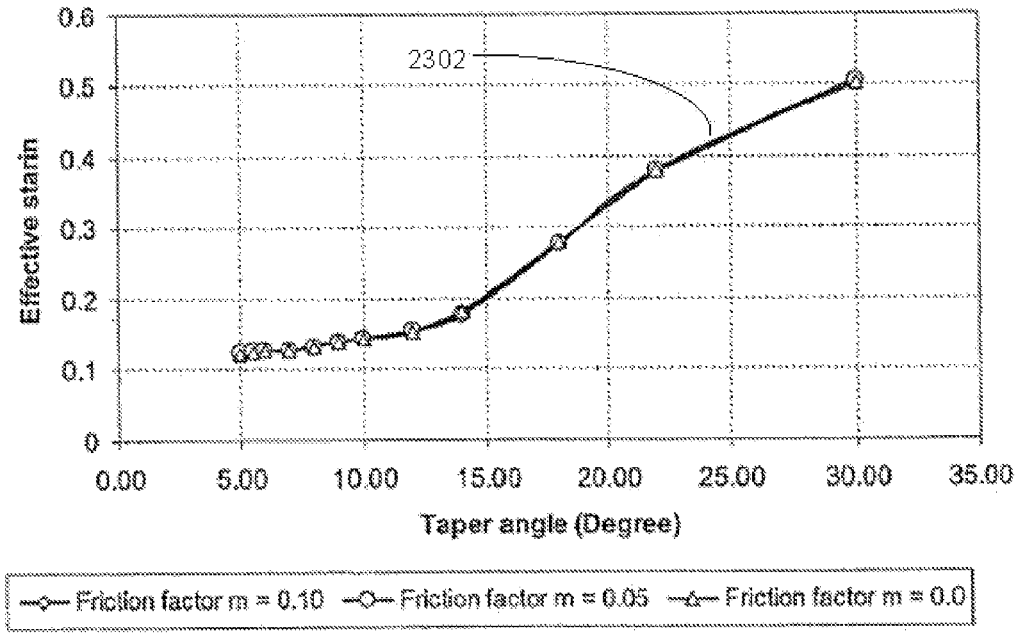
FIG. 23 is an illustration of the effective strain in the expandable tubular member versus the taper angle of an expansion device one of the computer model of FIGS. 17*a* and 17*b*.

Referring to FIG. 23, in the exemplary experimental embodiment 1700 using FEA, effective strain curve 2302 in the expandable tubular member 1702 as a function of taper angle θ for three different friction shear factors (m), is shown. In an exemplary embodiment, the maximum effective strain in the expandable tubular member 1702 increased with increasing taper angle θ, and was independent of friction shear factor (m). In an exemplary embodiment, the increase in the maximum effective strain with increasing taper angle θ is due to increased redundant deformation $w_r$ in the expandable tubular member 1702 for large taper angles. In an exemplary embodiment, taper angles of approximately 15 degrees or greater were more effective at straining the expandable tubular member 1702.

Figure 24A:
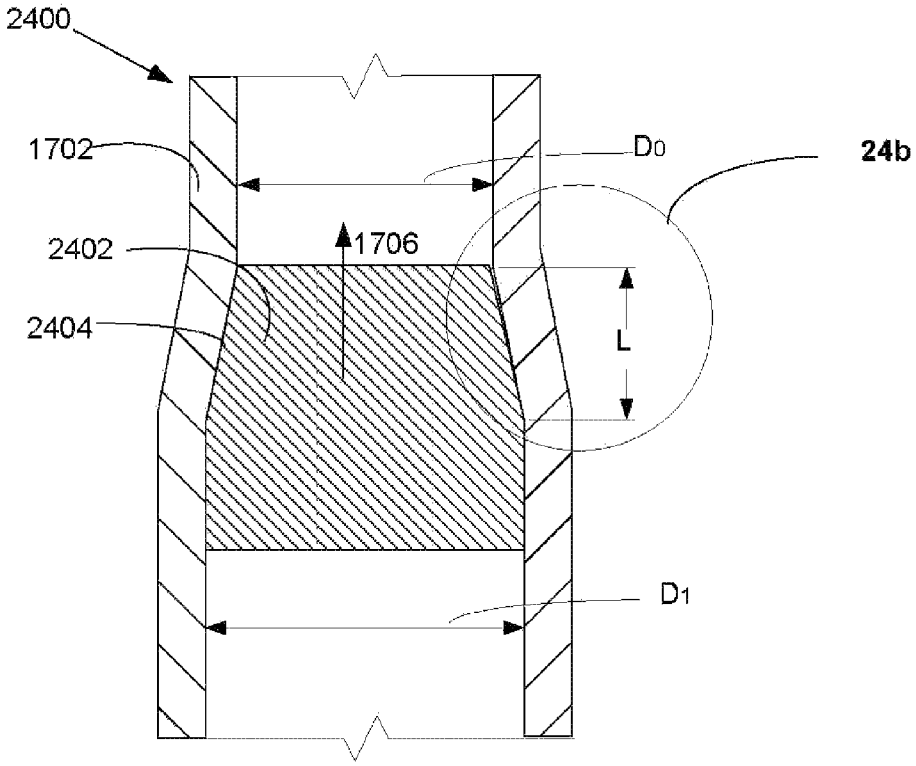
FIGS. 24*a* and 24*b* are illustrations of a computer model of a polynomial curvature expansion device and expandable tubular member.
Figure 24B:
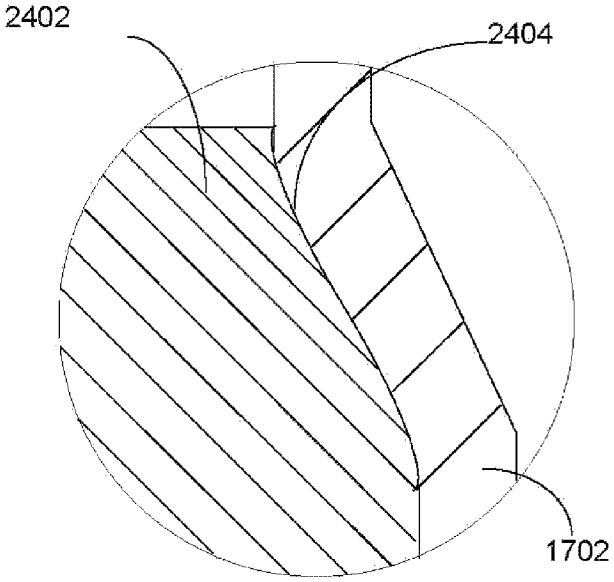

Referring to FIGS. 24*a* and 24*b*, in an exemplary experimental embodiment 2400 using finite element analysis ("FEA"), the radial expansion and plastic deformation of an expandable tubular member 1702 by a polynomial curvature expansion device 2402 displaced in direction 1706 relative to the expandable tubular member, was modeled using commercially available FEA software DEFORM-2D in order to predict the actual performance of a corresponding actual polynomial curvature expansion device during the radial expansion and plastic deformation of an actual expandable tubular member. In an exemplary embodiment, the FEA optimized the shape and length L of the polynomial curvature expansion device 2402 for minimum expansion forces. Polynomial curvature expansion device surface 2404 has a length L. In an exemplary embodiment, the polynomial curvature expansion device 2402 has an initial diameter $D_0$ at one end and a final diameter $D_1$ at another end.

Figure 25:
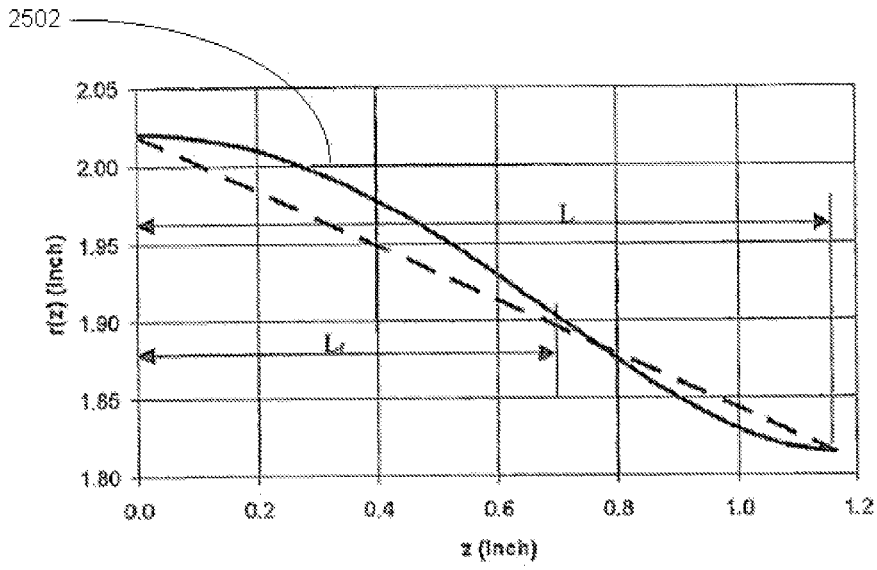
FIG. 25 is an illustration of experimental data for the location of an inflection point in the expansion surface of the polynomial curvature expansion device of the computer model of FIGS. 24*a* and 24*b*.

Referring to FIG. 25, in the exemplary experimental embodiment 2400 using FEA, the shape of a polynomial curvature expansion device surface 2502 is illustrated. The polynomial curvature expansion surface 2502 has a length L and an inflection point $L_f$. In an exemplary embodiment, the ratio of $L_f/L$ determines the shape of the polynomial curvature expansion surface 2502.

In the exemplary experimental embodiment 2400 using FEA, the polynomial curvature is expressed as:

$$r(z)=a_0+a_1z+a_2z^2+a_3z^3+a_4z^4 \tag{11}$$

$$a_0=R_1 \tag{12}$$

$$a_1=0 \tag{13}$$

$$a_2=\text{input} \tag{14}$$

$$a_3=\frac{2}{L}\left[a_2+\frac{2(R_1-R_0)}{L^2}\right] \tag{15}$$

$$a_4=\frac{1}{L^2}\left[a_2+\frac{2(R_1-R_0)}{L^2}\right] \tag{16}$$

where r(z)=radial distance from the centerline of the expansion cone; and z=longitudinal distance along the polynomial curvature expansion surface In an exemplary embodiment, the optimum polynomial curvature expansion surface for minimum axial expansion forces for a friction shear factor m=0.10 was $r(z)=2.020-0.150z^2-0.043z^3+0.055z^4$. In an exemplary embodiment, the optimum polynomial curvature expansion surface for minimum axial expansion forces for a friction shear factor m=0.05 was $r(z)=2.020-0.095z^2-0.023z^3+0.023z^4$.

Figure 26:
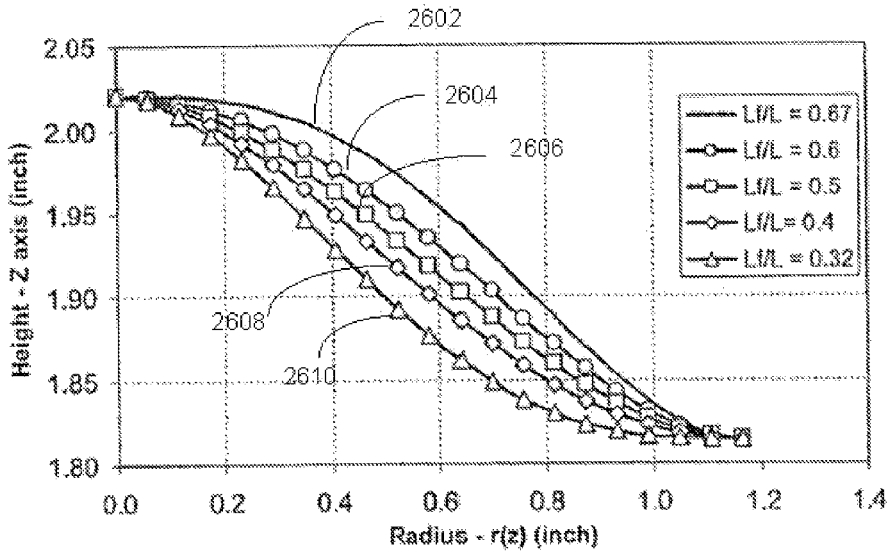
FIG. 26 is an illustration of polynomial curvature expansion device surface shapes with different ratios of $L_f/L$ of the computer model of FIGS. 24*a* and 24*b*.

Referring to FIG. 26, in the exemplary experimental embodiment 2400 using FEA, five different polynomial curvature expansion device surfaces 2602, 2604, 2606, 2608, and 2610, are shown. Polynomial curvature expansion device surface 2602 has a $L_f/L=0.67$. Polynomial curvature expansion device surface 2604 has a $L_f/L=0.60$. Polynomial curvature expansion device surface 2606 has a $L_f/L=0.50$. Polynomial curvature expansion device surface 2608 has a $L_f/L=0.40$. Polynomial curvature expansion device surface 2610 has a $L_f/L=0.32$.

Figure 27:
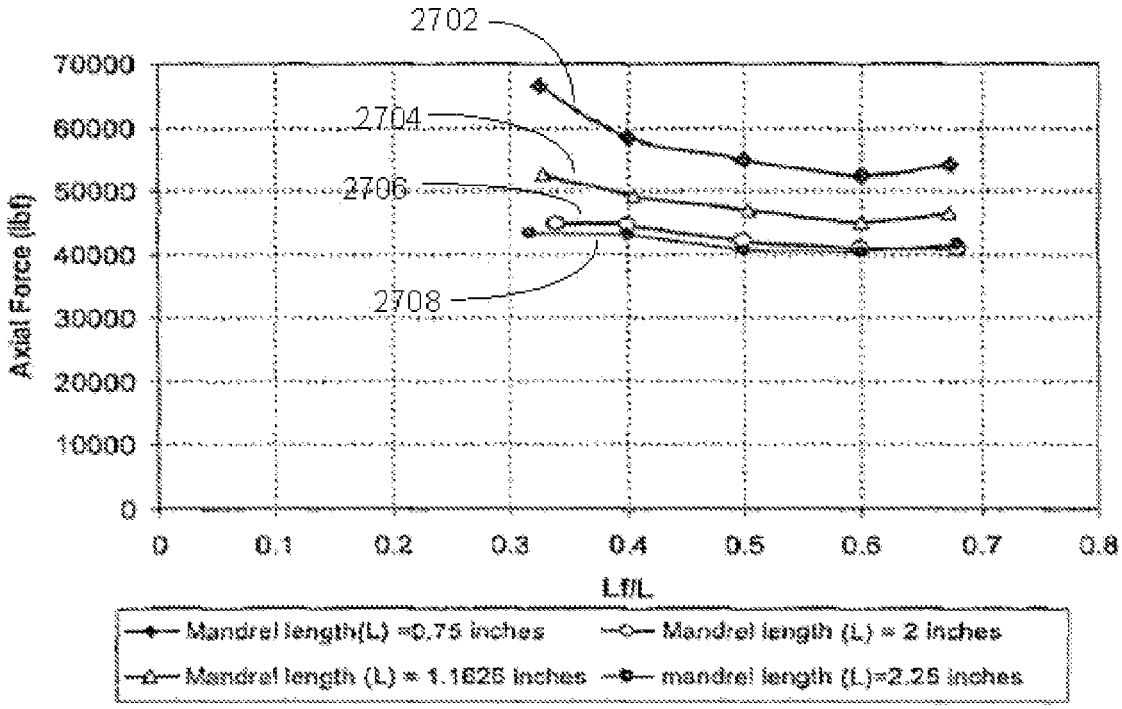
FIG. 27 is an illustration of the axial expansion force required for the polynomial curvature expansion device with different $L_f/L$ ratios and a constant length of the polynomial curvature expansion surface (L) and for a shear friction factor of m=0.05 of the computer model of FIGS. 24*a* and 24*b*.

Referring to FIG. 27, in the exemplary experimental embodiment 2400 using FEA, axial expansion force curves 2702, 2704, 2706, and 2708 are shown for increasing ratios of $L_f/L$ for four different polynomial curvature expansion device surface lengths at a constant friction shear factor of m=0.05. In an exemplary embodiment, the axial expansion force curve 2702 has a polynomial curvature expansion device surface length of 0.75 inches and the minimum axial expansion force was found at a $L_f/L$ ratio of 0.6. In an exemplary embodiment, the axial expansion force curve 2704 has a polynomial curvature expansion device surface length of 1.1626 inches and the minimum axial expansion force was found at a $L_f/L$ ratio of 0.6. In an exemplary embodiment, the axial expansion force curve 2706 has a polynomial curvature expansion device surface length of 2.0 inches and the minimum axial expansion force was found at a $L_f/L$ ratio of 0.6. In an exemplary embodiment, the axial expansion force curve 2708 has a polynomial curvature expansion device surface length of 2.25 inches and the minimum axial expansion force was found at a $L_f/L$ ratio of 0.6. In an exemplary embodiment, the minimum axial expansion force for the four axial expansion force curves 2702, 2704, 2706, and 2708, was found to be at the $L_f/L$ ratio of about 0.6, thus, the ratio $L_f/L$ at which the minimum axial expansion force occurs was found to be independent of the length of the polynomial curvature expansion surface for a given shear friction factor (m).

Figure 28:
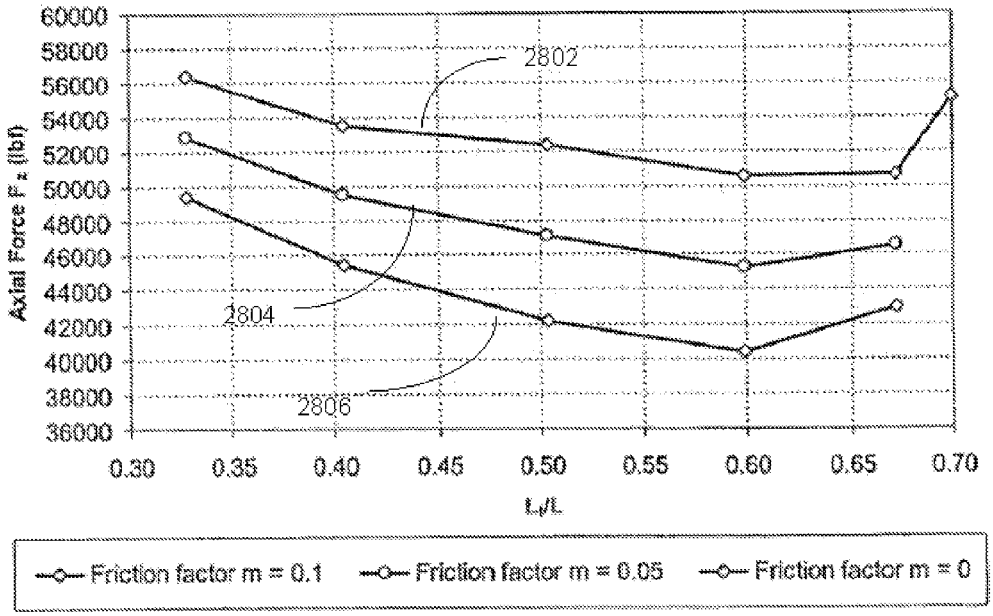
FIG. 28 is a comparison of the axial expansion force for the polynomial curvature expansion device for different $L_f/L$ ratios at various shear friction factors for a given length of the expansion surface of the computer model of FIGS. 24*a* and 24*b*.

Referring to FIG. 28, in the exemplary experimental embodiment 2400 using FEA, axial expansion force curves 2802, 2804, and 2806 are shown for increasing $L_f/L$ ratios at three different friction shear factors (m) and a constant polynomial curvature expansion surface length of 1.1626 inches. Axial expansion force curve 2802 has a friction shear factor of m=0.1 and a minimum axial expansion force at a $L_f/L$ ratio of 0.6. Axial expansion force curve 2804 has a friction shear factor of m=0.05 and a minimum axial expansion force at a $L_f/L$ ratio of 0.6. Axial expansion force curve 2806 has a friction shear factor of m=0.0 and a minimum axial expansion force at a $L_f/L$ ratio of 0.6. For the three axial expansion force curves 2802, 2804, and 2806, the minimum axial expansion force was found to be at the $L_f/L$ ratio of 0.6, thus, the ratio $L_f/L$ at which the minimum axial expansion force occurs was found to be independent of the shear friction factor (m) for a given length of the polynomial curvature expansion surface.

Figure 29:
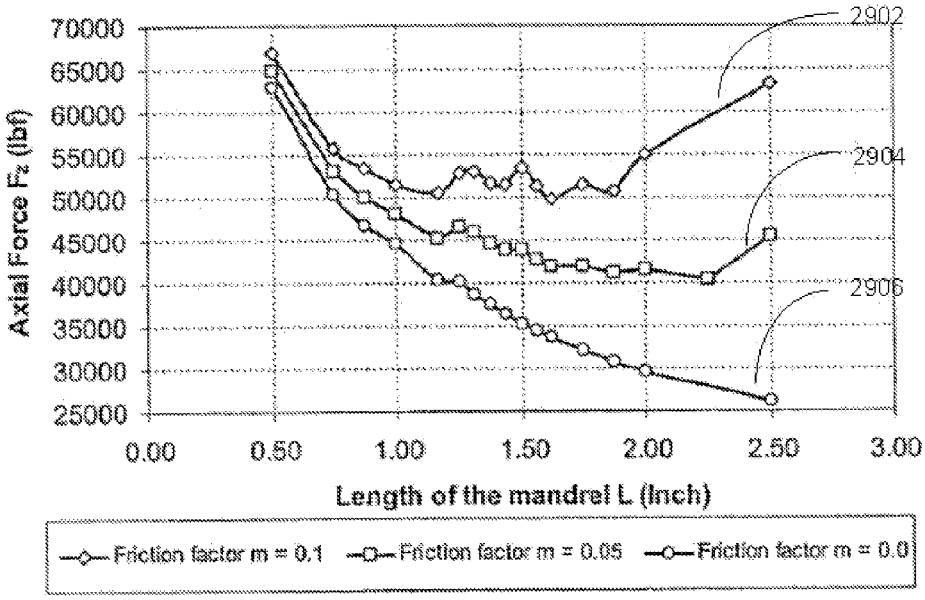
FIG. 29 is a comparison of the axial expansion force for the polynomial curvature expansion device for different lengths of the expansion surface at various shear friction factors for the optimum $L_f/L$ ratio of 0.6 of the computer model of FIGS. 24*a* and 24*b*.

Referring to FIG. 29, in the exemplary experimental embodiment 2400 using FEA, axial expansion force curves 2902, 2904, and 2906 are shown for increasing lengths of the polynomial curvature expansion device surface 2404 with the optimum $L_f/L$ ratio of 0.6 for three different shear friction factors (m). Axial expansion force curve 2902 has a friction shear factor of m=0.1, the optimum length of the polynomial curvature expansion device surface 2404 was found to be 1.625 inches for a expansion cone that is to achieve a 0.25" increase in diameter. Axial expansion force curve 2904 has a friction shear factor of m=0.05, the optimum length of the polynomial curvature expansion device surface 2404 was found to be 1.875 inches for a expansion cone that is to achieve a 0.25" increase in diameter. Axial expansion force curve 2906 has a friction shear factor of m=0.0, the optimum length of the polynomial curvature expansion device surface 2404 was found to be 2.5 inches for a expansion cone that is to achieve a 0.25" increase in diameter.

Figure 30:
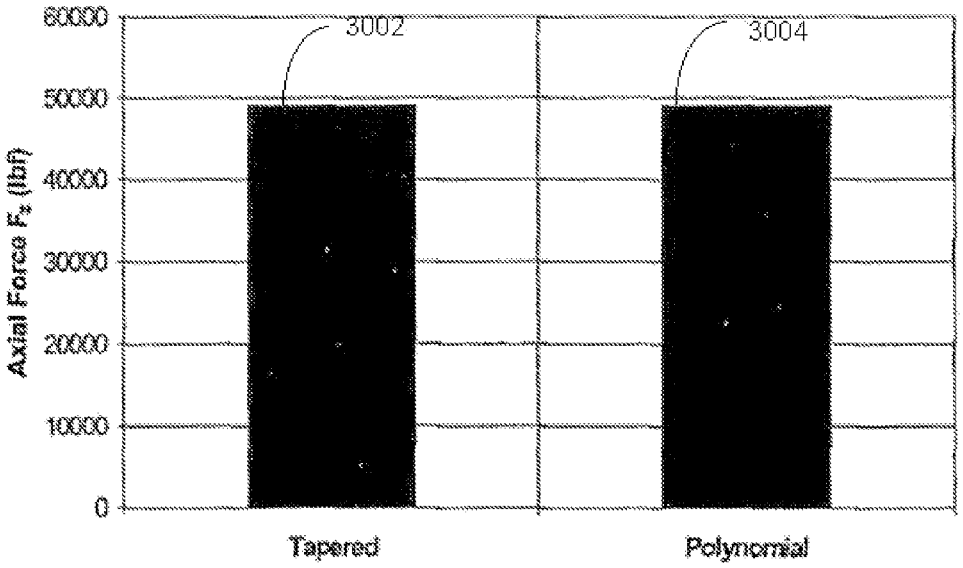
FIG. 30 is a comparison of the axial expansion force between the optimum tapered angle expansion device of the computer model of FIGS. 17*a* and 17*b* and the optimum polynomial curvature expansion device of the computer model of FIGS. 24*a* and 24*b* for a friction shear factor of m=0.10.

Referring to FIG. 30, in the exemplary experimental embodiments 1700 and 2400 using FEA, axial expansion force 3002 corresponding to an optimum taper angle of 8 degrees for the tapered expansion device surface 1708 is compared to the axial expansion force 3004 corresponding to an optimum polynomial curvature expansion device surface 2404 with an optimum $L_f/L$ ratio of 0.6 and a length of 1.625 inches, for a friction shear factor of m=0.10. The optimum tapered expansion device surface 1708 and the optimum polynomial curvature expansion device surface 2404 required approximately the same axial expansion force, for a friction shear factor of m=0.10.

Figure 31:
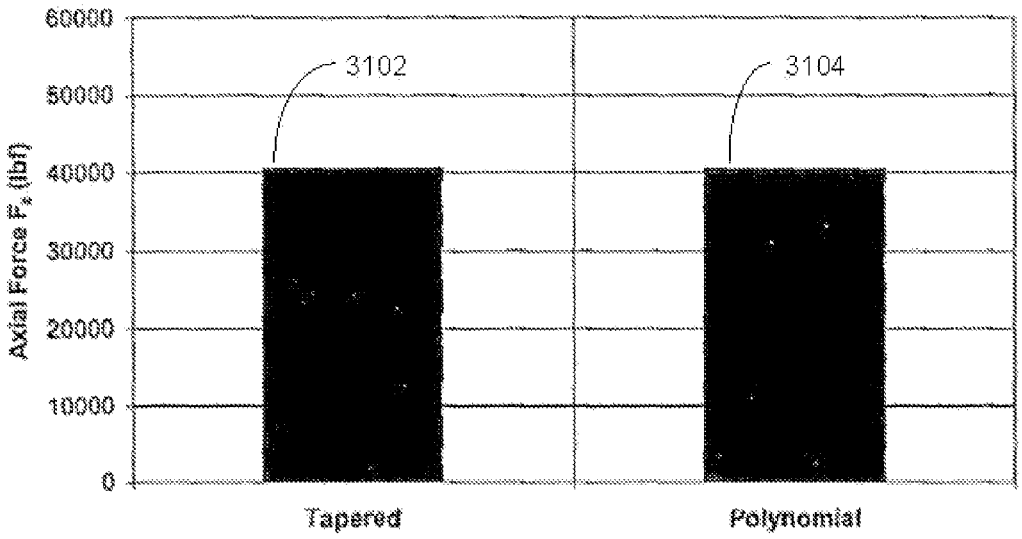
FIG. 31 is a comparison of the axial expansion force between the optimum tapered angle expansion device of the computer model of FIGS. 17*a* and 17*b* and the optimum polynomial curvature expansion device of the computer model of FIGS. 24*a* and 24*b* for a friction shear factor of m=0.05

Referring to FIG. 31, in the exemplary experimental embodiments 1700 and 2400 using FEA, axial expansion force 3102 corresponding to an optimum taper angle of 7 degrees for the tapered expansion device surface 1708 is compared to the axial expansion force 3104 corresponding to an optimum polynomial curvature expansion device surface 2404 with an optimum $L_f/L$ ratio of 0.6 and a length of 1.875 inches, for a friction shear factor of m=0.05. The optimum tapered expansion surface 1708 and the optimum polynomial curvature expansion surface 2404 required approximately the same axial expansion force, for a friction shear factor of m=0.05.

Figure 32:
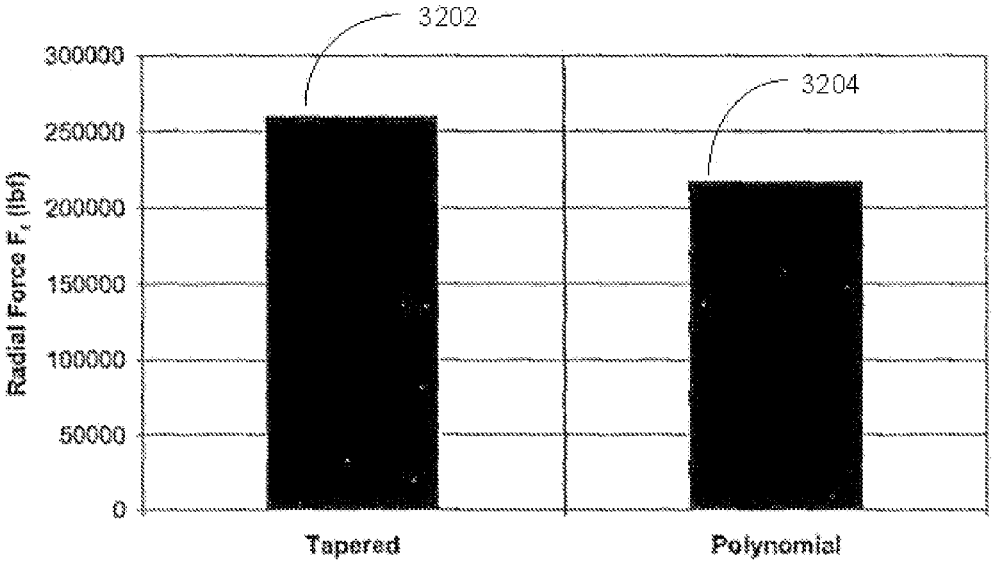
FIG. 32 is a comparison of the steady state radial force between the optimum tapered angle expansion device of the computer model of FIGS. 17*a* and 17*b* and the optimum polynomial curvature expansion device of the computer model of FIGS. 24*a* and 24*b* for a friction shear factor of m=0.10.

Referring to FIG. 32, in the exemplary experimental embodiments 1700 and 2400 using FEA, radial expansion force 3202 required for the optimum taper angle of 8 degrees for the tapered expansion surface 1708 is compared to the axial expansion force 3204 required for the optimum polynomial curvature expansion surface 2404 with the optimum $L_f/L$ ratio of 0.6 and a length of 1.625 inches, for a friction shear factor of m=0.10. The radial reaction force produced by the polynomial curvature expansion surface 2404 was 16.4% lower than that of the tapered expansion surface 1708, for a friction shear factor of m=0.10.

Figure 33:
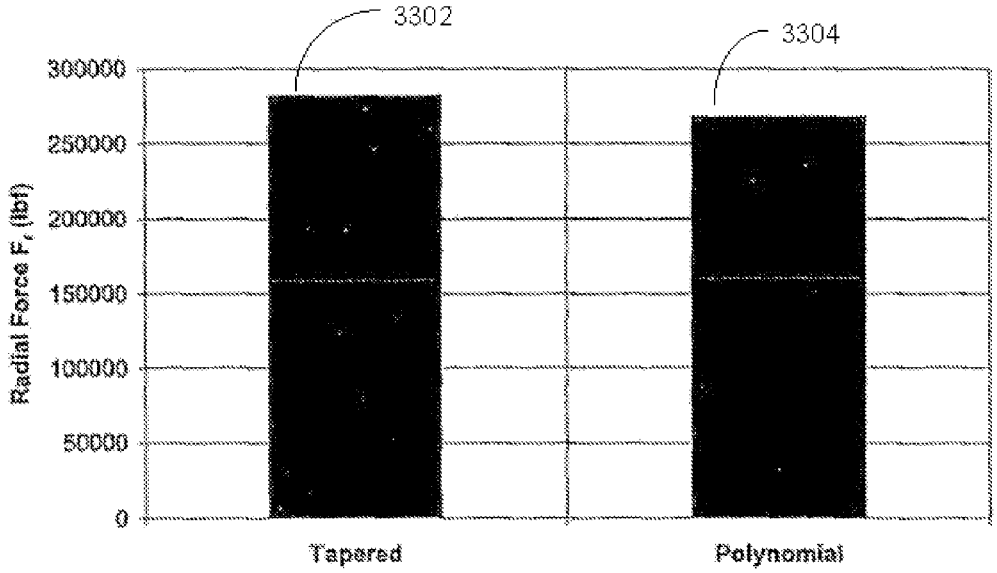
FIG. 33 is a comparison of the steady state radial force between the optimum tapered angle expansion device of the computer model of FIGS. 17*a* and 17*b* and the optimum polynomial curvature expansion device of the computer model of FIGS. 24*a* and 24*b* for a friction shear factor of m=0.05.

Referring to FIG. 33, in the exemplary experimental embodiments 1700 and 2400 using FEA, radial expansion force 3302 required for the optimum taper angle of 7 degrees for the tapered expansion surface 1708 is compared to the axial expansion force 3304 required for the optimum polynomial curvature expansion surface 2404 with the optimum $L_f/L$ ratio of 0.6 and a length of 1.875 inches, for a friction shear factor of m=0.05. The radial reaction force produced by the polynomial curvature expansion surface 2404 was 5% lower than that of the tapered expansion surface 1708, for a friction shear factor of m=0.05.

Figure 34:
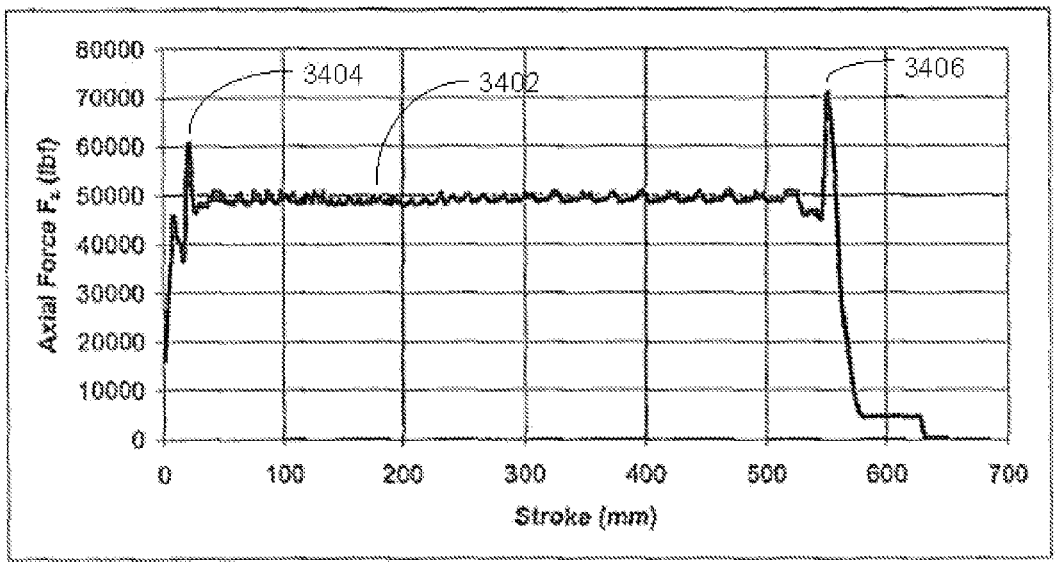
FIG. 34 is an illustration of the total axial expansion force versus expansion device displacement for the optimum tapered expansion device of the computer model of FIGS. 17*a* and 17*b* and a friction shear factor of m=0.10.

Referring to FIG. 34, in an exemplary experimental embodiment 1700 using FEA, total axial expansion force curve 3402 shows the total axial expansion force versus the displacement of the tapered expansion device 1704 with an optimum taper angle of 8 degrees for a friction shear factor of m=0.10. The total axial expansion force curve 3402 has transient force spike 3404 at the beginning of the displacement of the tapered expansion device 1704 and transient force spike 3406 at the end of the displacement of the tapered expansion device.

Figure 35:
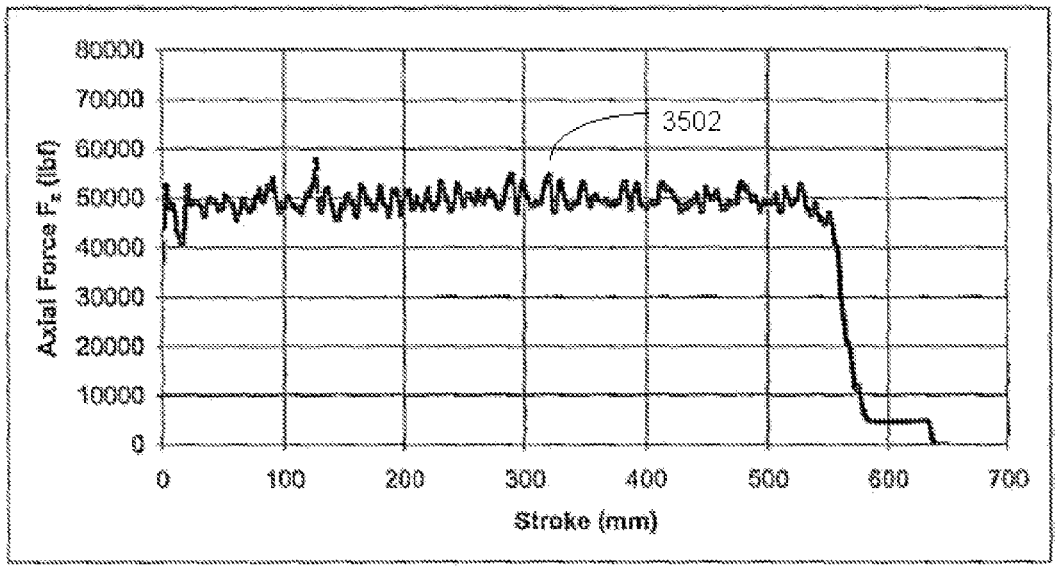
FIG. 35 is an illustration of the total axial expansion force versus expansion device displacement for the optimum polynomial expansion device of the computer model of FIGS. 24*a* and 24*b* and a friction shear factor of m=0.10.

Referring to FIG. 35, in an exemplary experimental embodiment 2400 using FEA, total axial expansion force curve 3502 shows the total axial expansion force versus the displacement of the polynomial curvature expansion device 2402 with the optimum polynomial curvature expansion surface 2404 with the optimum $L_f/L$ ratio of 0.6 and a length of 1.625 inches for a friction shear factor of m=0.10. There are no transient force spikes at the beginning or at the end of the displacement of the polynomial curvature expansion device 2402 for a friction shear factor of m=0.10. The lack of transient force spikes may result in longer equipment life in comparison to the corresponding tapered expansion device 1704.

Figure 36:
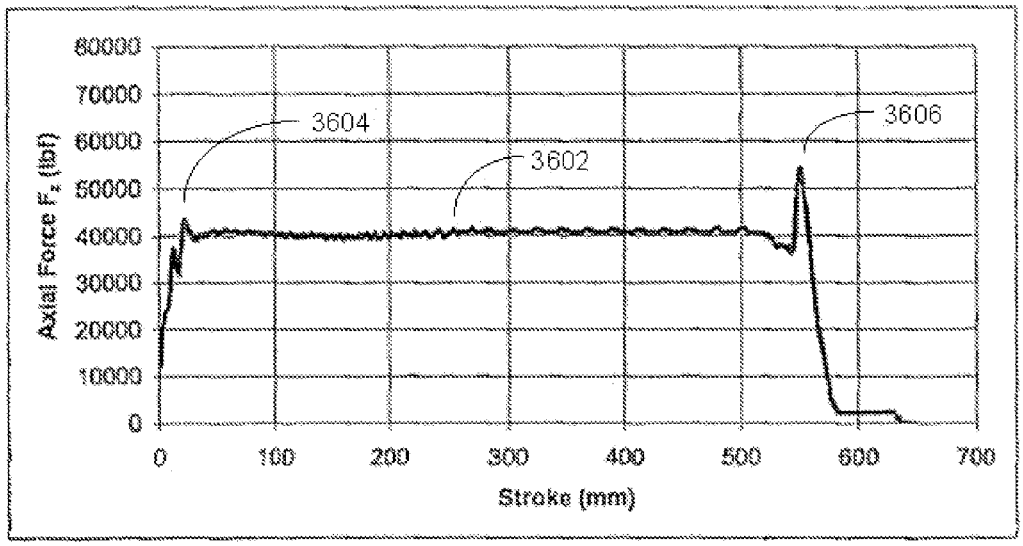
FIG. 36 is an illustration of the total axial expansion force versus expansion device displacement for the optimum tapered expansion device of the computer model of FIGS. 17*a* and 17*b* and a friction shear factor of m=0.05.

Referring to FIG. 36, in an exemplary experimental embodiment 1700 using FEA, total axial expansion force curve 3602 shows the total axial expansion force versus the displacement of the tapered expansion device 1704 with an optimum taper angle of 7 degrees for a friction shear factor of m=0.05. The total axial expansion force curve 3602 has transient force spike 3604 at the beginning of the displacement of the tapered expansion device 1704 and transient force spike 3606 at the end of the displacement of the tapered expansion device.

Figure 37:
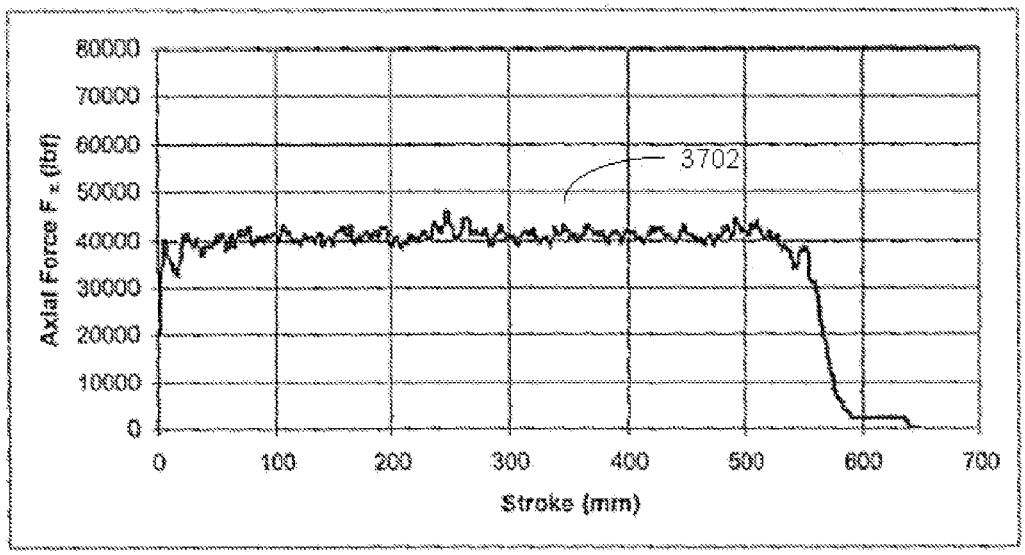
FIG. 37 is an illustration of the total axial expansion force versus expansion device displacement for the optimum polynomial curvature expansion device of the computer model of FIGS. 24*a* and 24*b* and a friction shear factor of m=0.05.

Referring to FIG. 37, in an exemplary experimental embodiment 2400 using FEA, total axial expansion force curve 3702 shows the total axial expansion force versus the displacement of the polynomial curvature expansion device 2402 with the optimum polynomial curvature expansion surface 2404 with the optimum $L_f/L$ ratio of 0.6 and a length of 1.875 inches for a friction shear factor of m=0.05. There are no transient force spikes at the beginning or at the end of the displacement of the expansion device 2402 for a friction shear factor of m=0.05. The lack of transient force spikes may result in longer equipment life in comparison to the corresponding tapered expansion device 1704.

Figure 38:
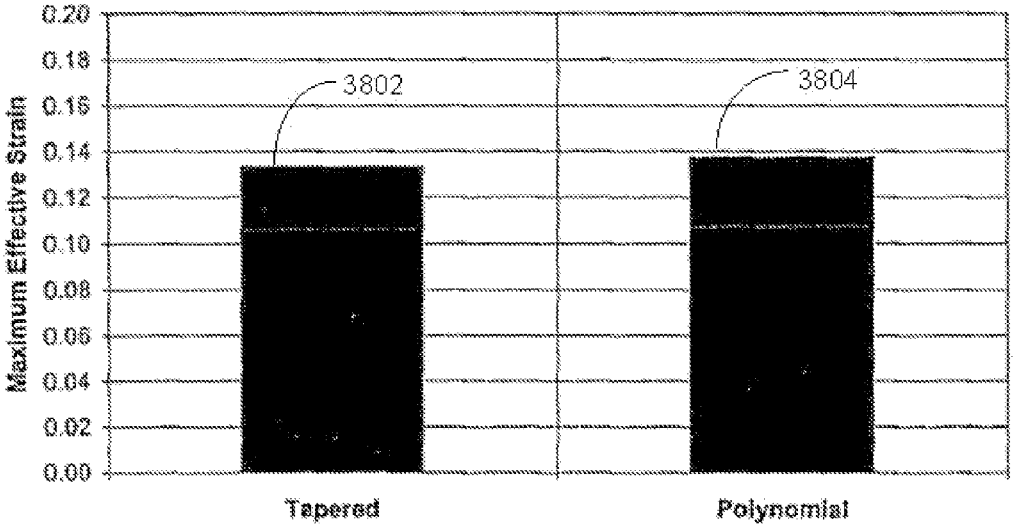
FIG. 38 is a comparison of the maximum effective strain between the optimum tapered angle expansion device of the computer model of FIGS. 17*a* and 17*b* and the optimum polynomial curvature expansion device of the computer model of FIGS. 24*a* and 24*b* for a friction shear factor of m=0.10.

Referring to FIG. 38, in an exemplary experimental embodiment using FEA, the maximum effective strain 3802 corresponding to an optimum taper angle of 7 degrees for the tapered expansion surface 1708 is compared to the maximum effective strain 3804 corresponding to an optimum polynomial curvature expansion surface 2404 with an optimum $L_f/L$ ratio of 0.6 and a length of 1.625 inches, for a friction shear factor of m=0.10. The maximum effective strain 3802 produced by the optimum tapered expansion surface 1708 was approximately the same as the maximum effective strain 3804 produced by the optimum polynomial curvature expansion surface 2404, for a friction shear factor of m=0.10.

Figure 39:
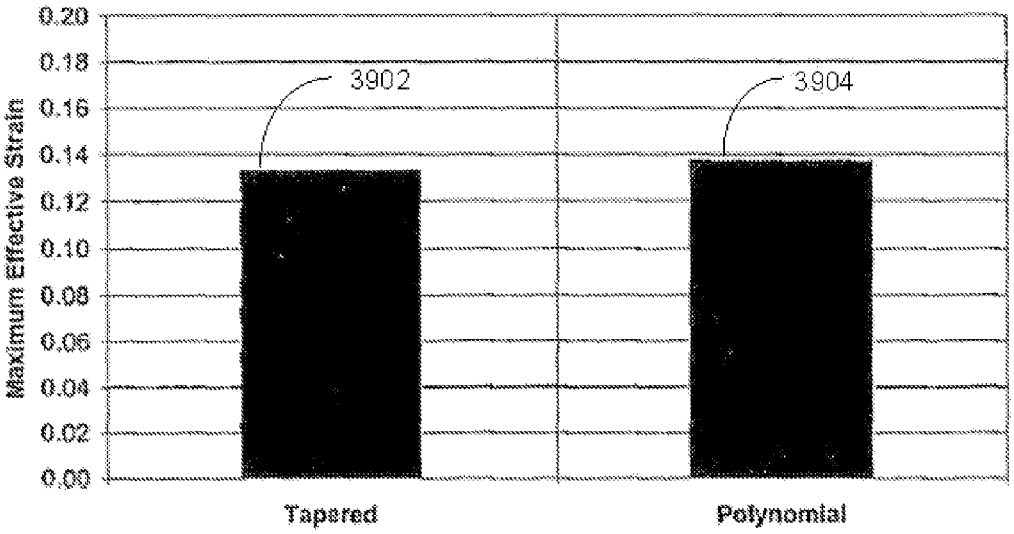
FIG. 39 is a comparison of the maximum effective strain between the optimum tapered angle expansion device of the computer model of FIGS. 17*a* and 17*b* and the optimum polynomial curvature expansion device of the computer model of FIGS. 24*a* and 24*b* for a friction shear factor of m=0.05.

Referring to FIG. 39, in an exemplary experimental embodiment using FEA, the maximum effective strain 3902 corresponding to an optimum taper angle of 7 degrees for the tapered expansion surface 1708 is compared to the maximum effective strain 3904 corresponding to an optimum polynomial curvature expansion surface 2404 with an optimum $L_f/L$ ratio of 0.6 and a length of 1.875 inches, for a friction shear factor of m=0.05. The maximum effective strain 3902 produced by the optimum tapered expansion surface 1708 was approximately the same as the maximum effective strain 3904 produced by the optimum polynomial curvature expansion surface 2404, for a friction shear factor of m=0.05.

An expansion device for radially expanding a tubular member has been described that includes a first tapered outer surface.

An expansion device for radially expanding a tubular member has been described that includes: a first tapered outer surface defined by a polynomial equation.

An expansion device for radially expanding a tubular member has been described that includes: a first tapered outer surface defined by a polynomial equation; wherein the polynomial equation has a $L_f/L$ ratio ranging from about 0.32 to 0.67.

An expansion device for radially expanding a tubular member has been described that includes: a first tapered outer surface defined by a polynomial equation; wherein the polynomial equation has a $L_f/L$ ratio ranging from about 0.32 to 0.67; wherein the length of the first tapered outer surface ranges from 0.5 inches to 2.5 inches.

An expansion device for radially expanding a tubular member has been described that includes: a first tapered outer surface defined by a polynomial equation; wherein the polynomial equation has a $L_f/L$ ratio ranging from about 0.32 to 0.67; wherein the length of the first tapered outer surface ranges from 1.6 inches to 1.9 inches.

An expansion device for radially expanding a tubular member has been described that includes: a first tapered outer surface defined by a polynomial equation; wherein the polynomial equation has a $L_f/L$ ratio ranging from about 0.32 to 0.67; and wherein the first tapered outer surface comprises one or more facets in cross section.

An expansion device for radially expanding a tubular member has been described that includes: a first tapered outer surface defined by a polynomial equation; wherein the polynomial equation has a $L_f/L$ ratio ranging from about 0.32 to 0.67; wherein the first tapered outer surface comprises one or more facets in cross section; wherein the number of facets ranges from about 12 to 16.

An expansion device for radially expanding a tubular member has been described that includes: a first tapered outer surface defined by a polynomial equation; wherein the polynomial equation has a $L_f/L$ ratio ranging from about 0.32 to 0.67; wherein the first tapered outer surface comprises one or more facets in cross section; wherein the number of facets ranges from about 12 to 16; wherein the faceted surfaces are wider near the front of the expansion device and become narrower toward the rear end of the expansion device.

An expansion device for radially expanding a tubular member has been described that includes a first tapered outer surface; wherein the first tapered outer surface comprises an angle of attack ranging from about 6 to 10 degrees.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; wherein the first angle of attack ranges from about 6 to 20 degrees; and wherein the second angle of attack ranges from about 4 to 15 degrees.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; wherein the angle of attack of the intermediate tapered outer surfaces continually decreases from the first tapered outer surface to the second tapered outer surface.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; wherein the angle of attack of the intermediate tapered outer surfaces decreases in steps from the first tapered outer surface to the second tapered outer surface.

An expansion device for radially expanding a tubular member has been described that includes a first tapered outer surface; wherein the first tapered outer surface comprises an angle of attack ranging from about 6 to 10 degrees; wherein the first tapered outer surface comprises one or more facets in cross section.

An expansion device for radially expanding a tubular member has been described that includes a first tapered outer surface; wherein the first tapered outer surface comprises an angle of attack ranging from about 6 to 10 degrees; wherein the first tapered outer surface comprises one or more facets in cross section; wherein the number of facets ranges from about 12 to 16.

An expansion device for radially expanding a tubular member has been described that includes a first tapered outer surface; wherein the first tapered outer surface comprises an angle of attack ranging from about 6 to 10 degrees; wherein the first tapered outer surface comprises one or more facets in cross section; wherein the faceted surfaces are wider near the front of the expansion device and become narrower toward the rear end of the expansion device.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; wherein the number of facets ranges from about 12 to 16.

An expansion device for radially expanding a tubular member has been described that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; wherein the faceted surfaces are wider near the front of the expansion device and become narrower toward the rear end of the expansion device.

An expansion device for radially expanding a tubular member has been described that includes: a first tapered outer surface defined by a polynomial equation; wherein the polynomial equation has a $L_f/L$ ratio ranging from about 0.32 to 0.67; wherein the length of the tapered outer surface ranges from about 1.6 inches to 1.9 inches; wherein the tapered outer surface comprises one or more facets in cross section; wherein the number of facets ranges from about 12 to 16; wherein the faceted surfaces are wider near the front of the expansion device and become narrower toward the rear end of the expansion device.

An expansion system for radially expanding a tubular member has been described that includes a first tapered outer surface; and means for displacing the expansion device relative to the expandable tubular member.

An expansion system for radially expanding a tubular member has been described that includes: an expansion device that includes a first tapered outer surface defined by a polynomial equation; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; and means for displacing the expansion device relative to the expandable tubular member; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; wherein the length of the first tapered outer surface ranges from 0.5 inches to 2.5 inches; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; wherein the length of the first tapered outer surface ranges from 1.6 inches to 1.9 inches; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; and wherein the first tapered outer surface comprises one or more facets in cross section; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; wherein the first tapered outer surface comprises one or more facets in cross section; wherein the number of facets ranges from about 12 to 16; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; wherein the first tapered outer surface comprises one or more facets in cross section; wherein the number of facets ranges from about 12 to 16; wherein the faceted surfaces are wider near the front of the expansion device and become narrower toward the rear end of the expansion device; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; and means for displacing the expansion device relative to the expandable tubular member.

An expansion system for radially expanding a tubular member has been described that includes: an expansion device that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; wherein the first angle of attack ranges from about 6 to 20 degrees; and wherein the second angle of attack ranges from about 4 to 15 degrees; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; wherein the angle of attack of the intermediate tapered outer surfaces continually decreases from the first tapered outer surface to the second tapered outer surface; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; wherein the angle of attack of the intermediate tapered outer surfaces decreases in steps from the first tapered outer surface to the second tapered outer surface; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; wherein the first tapered outer surface comprises one or more facets in cross section; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; wherein the first tapered outer surface comprises one or more facets in cross section; wherein the number of facets ranges from about 12 to 16; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; wherein the first tapered outer surface comprises one or more facets in cross section; wherein the faceted surfaces are wider near the front of the expansion device and become narrower toward the rear end of the expansion device; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; wherein the number of facets ranges from about 12 to 16; and means for displacing the expansion device relative to the expandable tubular member.

An expansion system for radially expanding a tubular member has been described that includes an expansion device that includes a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; wherein the faceted surfaces are wider near the front of the expansion device and become narrower toward the rear end of the expansion device; and means for displacing the expansion device relative to the expandable tubular member.

An expansion system for radially expanding a tubular member has been described that includes: an expansion device that includes a first tapered outer surface defined by a polynomial equation; wherein the polynomial equation has a $L_f/L$ ratio ranging from about 0.32 to 0.67; wherein the length of the tapered outer surface ranges from about 1.6 inches to 1.9 inches; wherein the tapered outer surface comprises one or more facets in cross section; wherein the number of facets ranges from about 12 to 16; wherein the faceted surfaces are wider near the front of the expansion device and become narrower toward the rear end of the expansion device; and means for displacing the expansion device relative to the expandable tubular member.

A method of radially expanding a tubular member has been described that includes radially expanding at least a portion of the tubular member by extruding at least a portion of the tubular member off of an expansion device; wherein the expansion device comprises a first tapered outer surface.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67; wherein the length of the first tapered outer surface ranges from 0.5 inches to 2.5 inches.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67; wherein the length of the first tapered outer surface ranges from 1.6 inches to 1.9 inches.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67; and wherein the first tapered outer surface comprises one or more facets in cross section.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67; wherein the first tapered outer surface comprises one or more facets in cross section; wherein the number of facets ranges from about 12 to 16.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67; wherein the first tapered outer surface comprises one or more facets in cross section; wherein the number of facets ranges from about 12 to 16; wherein the faceted surfaces are wider near the front of the expansion device and become narrower toward the rear end of the expansion device.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; wherein the first angle of attack ranges from about 6 to 20 degrees; and wherein the second angle of attack ranges from about 4 to 15 degrees.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; wherein the angle of attack of the intermediate tapered outer surfaces continually decreases from the first tapered outer surface to the second tapered outer surface.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; wherein the first angle of attack is greater than the second angle of attack; and one or more intermediate tapered outer surfaces coupled between the first and second tapered outer surfaces; wherein the angle of attack of the intermediate tapered outer surfaces decreases in steps from the first tapered outer surface to the second tapered outer surface.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; wherein the first tapered outer surface comprises one or more facets in cross section.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; wherein the first tapered outer surface comprises one or more facets in cross section; wherein the number of facets ranges from about 12 to 16.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; wherein the first tapered outer surface comprises one or more facets in cross section; wherein the faceted surfaces are wider near the front of the expansion device and become narrower toward the rear end of the expansion device.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; wherein the number of facets ranges from about 12 to 16.

A method of radially expanding a tubular member has been described that includes radially expanding at least a portion of the tubular member by extruding at least a portion of the tubular member off of an expansion device; wherein the expansion device comprises a first tapered outer surface; wherein the first tapered outer surface comprises an angle of attack ranging from about 6 to 10 degrees; a second tapered outer surface comprising a second angle of attack coupled to the first tapered outer surface; and wherein the first angle of attack is greater than the second angle of attack; wherein the first tapered outer surface and the second tapered outer surface comprise one or more facets in cross section; wherein the faceted surfaces are wider near the front of the expansion device and become narrower toward the rear end of the expansion device.

A method of radially expanding a tubular member has been described that includes radially expanding at least a portion of the tubular member by extruding at least a portion of the tubular member off of an expansion device; wherein the expansion device comprises a first tapered outer surface defined by a polynomial equation; wherein the polynomial equation has a $L_f/L$ ratio ranging from about 0.32 to 0.67; wherein the length of the tapered outer surface ranges from about 1.6 inches to 1.9 inches; wherein the tapered outer surface comprises one or more facets in cross section; wherein the number of facets ranges from about 12 to 16;

wherein the faceted surfaces are wider near the front of the expansion device and become narrower toward the rear end of the expansion device.

The teaching of the present disclosure may be applied to the construction and/or repair of wellbore casings, pipelines, and/or structural supports.

Although illustrative embodiments of the invention have been shown and described, a wide range of modification, changes and substitution is contemplated in the foregoing disclosure. In some instances, some features of the present invention may be employed without a corresponding use of the other features, and some steps of the present invention may be executed without a corresponding execution of other steps. Accordingly, all such modifications, changes and substitutions are intended to be included within the scope of this invention as defined in the following claims, and it is appropriate that the claims be construed broadly and in a manner consistent with the scope of the invention. In the claims, means-plus-function clauses are intended to cover the structures described herein as performing the recited function and not only structural equivalents, but also equivalent structures.

What is claimed is:

1. An expansion device for radially expanding and plastically deforming a tubular member, the expansion device comprising:

a first end having a first diameter;

a second end having a second diameter greater than the first diameter; and a first tapered outer surface comprising one or more of the following:

a curvature having an in inflection point and defined by a polynomial equation with an $L_f/L$ ratio ranging from about 0.32 to about 0.67; and a first angle of attach ranging from about 6 degrees to about 20 degrees;

wherein the $L_f/L$ ratio is a ratio of $L_f$ to L, wherein L is length of the first tapered outer surface measured relative to a longitudinal axis through the expansion device and $L_f$ is the distance between the second end and the inflection point measured relative to the longitudinal axis.

2. The expansion device of claim 1, wherein the first tapered surface comprises the curvature defined by the polynomial equation; and wherein the length of the first tapered outer surface ranges from about 0.5 inches to about 2.5 inches.

3. The expansion device of claim 2, wherein the length of the first tapered outer surface ranges from about 1.6 inches to about 1.9 inches.

4. The expansion device of claim 1, wherein the first tapered outer surface comprises one or more facets in cross section.

5. The expansion device of claim 4, wherein the number of facets ranges from about 12 to about 16.

6. The expansion device of claim 4, wherein the faceted surfaces are wider near the first end of the expansion device and become narrower toward the second end of the expansion device.

7. The expansion device of claim 1, wherein the expansion device comprises the first angle of attack ranging from about 6 degrees to about 20 degrees;

wherein the expansion device further comprises a second tapered outer surface comprising a second angle of attack coupled to the first tapered outer surface; and wherein the first angle of attack is greater than the second angle of attack.

8. The expansion device of claim 7, wherein the second angle of attack ranges from about 4 degrees to about 15 degrees.

9. The expansion device of claim 7, further comprising one or more intermediate tapered outer surfaces coupled between the first and second tapered outer surfaces.

10. The expansion device of claim 9, wherein the angle of attack of the one or more intermediate tapered outer surfaces continually decreases from the first tapered outer surface to the second tapered outer surface.

11. The expansion device of claim 9, wherein the angle of attack of the one or more intermediate tapered outer surfaces decreases in steps from the first tapered outer surface to the second tapered outer surface.

12. The expansion device of claim 7, wherein the first tapered outer surface and the second tapered outer surface comprise one or more facets in cross section.

13. The expansion device of claim 12, wherein the number of facets ranges from about 12 to about 16.

14. The expansion device of claim 12, wherein the faceted surfaces are wider near the first end of the expansion device and become narrower toward the second end of the expansion device.

15. A method of radially expanding a tubular member, the method comprising:

radially expanding at least a portion of the tubular member by extruding at least a portion of the tubular member off of expansion device;

wherein the expansion device comprises:

a first end having a first diameter;

a second end having a second diameter greater than the first diameter; and a first tapered outer surface comprising one or more of the following:

a curvature having an inflection point and defined by a polynomial equation with an $L_f/L$ ratio ranging from about 0.32 to about 0.67; and a first angle of attack ranging from about 6 degrees to about 20 degrees;

wherein the $L_f/L$ ratio is a ratio of $L_f$ to L, wherein L is length of the first tapered outer surface measured relative to a longitudinal axis through the expansion device and $L_f$ is the distance between the second end and the inflection point measured relative to the longitudinal axis.

16. The method of claim 15, wherein the first tapered surface comprises the curvature defined by the polynomial equation; and wherein the length of the first tapered outer surface ranges from about 0.5 inches to about 2.5 inches.

17. The method of claim 16, wherein the length of the first tapered outer surface ranges from about 1.6 inches to about 1.9 inches.

18. The method of claim 15 wherein the first tapered outer surface comprises one or more facets in cross section.

19. The method of claim 18, wherein the number of facets ranges from about 12 to about 16.

20. The method of claim 18, wherein the faceted surfaces are wider near the first end of the expansion device and become narrower toward the second end of the expansion device.

21. The method of claim 15, wherein the expansion device comprises the first angle of attack ranging from about 6 degrees to about 20 degrees;

wherein the expansion device further comprises a second tapered outer surface comprising a second angle of attack coupled to the first tapered outer surface; and wherein the first angle of attack is greater than the second angle of attack.

22. The method of claim 21, wherein the second angle of attack ranges from about 4 degrees to about 15 degrees.

23. The method of claim 21, further comprising one or more intermediate tapered outer surfaces coupled between the first and second tapered outer surfaces.

24. The method of claim 23, wherein the angle of attack of the intermediate tapered outer surfaces continually decreases from the first tapered outer surface to the second tapered outer surface.

25. The method of claim 23, wherein the angle of attack of the intermediate tapered outer surfaces decreases in steps from the first tapered outer surface to the second tapered outer surface.

26. The method of claim 21, wherein the first tapered outer surface and the second tapered outer surface comprise one or more facets in cross section.

27. The method of claim 26, wherein the number of facets ranges from about 12 to about 16.

28. The method of claim 26, wherein the faceted surfaces are wider near the first end of the expansion device and become narrower toward the second end of the expansion device.

29. An expansion device for radially expanding a tubular member comprising:

a first end having a first diameter;

a second end having a second diameter greater than the first diameter; and a tapered outer surface having a curvature with an inflection point and defined by a polynomial equation;

wherein the polynomial equation has a $L_f/L$ ratio ranging from about 0.32 to about 0.67, the $L_f/L$ ratio being a ratio of $L_f$ to L, wherein L is length of the tapered outer surface measured relative to a longitudinal axis through the expansion device and $L_f$ is the distance between the second end and the inflection point measured relative to the longitudinal axis;

wherein the length of the tapered outer surface ranges from about 1.6 inches to about 1.9 inches;

wherein the tapered outer surface comprises one or more facets in cross section;

wherein the number of facets ranges from about 12 to about 16; and wherein the faceted surfaces are wider near the first end of the expansion device and become narrower toward the second end of the expansion device.

30. A method of radially expanding a tubular member comprising:

radially expanding at least a portion of the tubular member by extruding at least a portion of the tubular member off of an expansion device;

wherein the expansion device comprises:

a first end a first diameter;

a second end having a second diameter greater than the first diameter; and a tapered outer surface;

wherein the tapered outer surface has a curvature with an inflection point and defined by a polynomial equation;

wherein the polynomial equation has a $L_f/L$ ratio ranging from about 0.32 to about 0.67 the $L_f/L$ ratio being a ratio of $L_f$ to L, wherein L is length of the tapered outer surface measured relative to a longitudinal axis through the expansion device and $L_f$ is the distance between the second end and the inflection point measured relative to the longitudinal;

wherein the length of the tapered outer surface ranges from about 1.6 inches to about 1.9 inches;

wherein the tapered outer surface comprises one or more facets in cross section;

wherein the number of facets ranges from about 12 to about 16; and wherein the faceted surfaces are wider near the first end of the expansion device and become narrower toward the second end of the expansion device.

* * * * *